US006367517B1

(12) United States Patent
Hoermann

(10) Patent No.: US 6,367,517 B1
(45) Date of Patent: Apr. 9, 2002

(54) ARRANGEMENT FOR DOSING POURABLE SUBSTANCES AND ASSOCIATED USES

(76) Inventor: Karl Ludwig Haral Hoermann, Unterschrift des ersten Erfinders, Wohsitz, Munich (DE)

( * ) Notice: Subject to any disclaimer, the term of this patent is extended or adjusted under 35 U.S.C. 154(b) by 0 days.

(21) Appl. No.: 09/401,192

(22) Filed: Sep. 23, 1999

Related U.S. Application Data

(60) Provisional application No. 60/101,823, filed on Sep. 25, 1998.

(51) Int. Cl.[7] ..... B65B 1/04

(52) U.S. Cl. ..... 141/67; 141/83; 222/181.1

(58) Field of Search ..... 141/83, 346, 348, 141/349, 350, 367, 369, 370, 378, 383, 386, 18, 67; 222/181.1, 181.3

(56) References Cited

U.S. PATENT DOCUMENTS 5,937,920 A * 8/1999 Simmel et al.
5,967,383 A * 10/1999 Hidalgo
6,056,027 A * 5/2000 Patterson
6,179,167 B1 * 1/2001 Boot et al.

* cited by examiner

*Primary Examiner*—Steven O. Douglas

(57) ABSTRACT

Arrangement for dosing granular materials, propellants, explosives, gunpowder and other pourable substances comprising at least a container with a closure and a dosing unit comprising a measuring chamber for the take up of said substance, said dosing unit is defined connectable with the container via a means of association for the purpose of dosing, whereby said closure is held self-powered in a closed position and is transferable by a means of actuating into an open position for opening. At least one means of locking is provided securing the closure in the closed position in order to prevent unintentional release of substance, whereby the means of locking is releasable preferentially by the dosing unit while connecting with the container latest while attaining the filling location in order to rest the closure in the closed position as possible long and effect an constrained control. For additional security at least one means of holding my be provided in order to rest the association of dosing unit and container in the filling position. Said arrangement comprising a container for taking up of the substances, which is utilizing an active generation of a throttle effect by means of a field of lateral force. The container may be equipped with a funnel-shaped section being closable by means of a lid for the easier clearing of the container. Said arrangement further comprises a preferred clamping holder for taking up the container and a preferred holding device comprising a means of pressure equalization; furthermore preferred uses of the dosing unit and the arrangement and a preferred adhesive-joint for the container increasing the stability under load, particularly at swelling loads as well as three-dimensional stress condition. And finally a preferred tenter tool preventing the dosing unit from damages while assembling it.

15 Claims, 36 Drawing Sheets

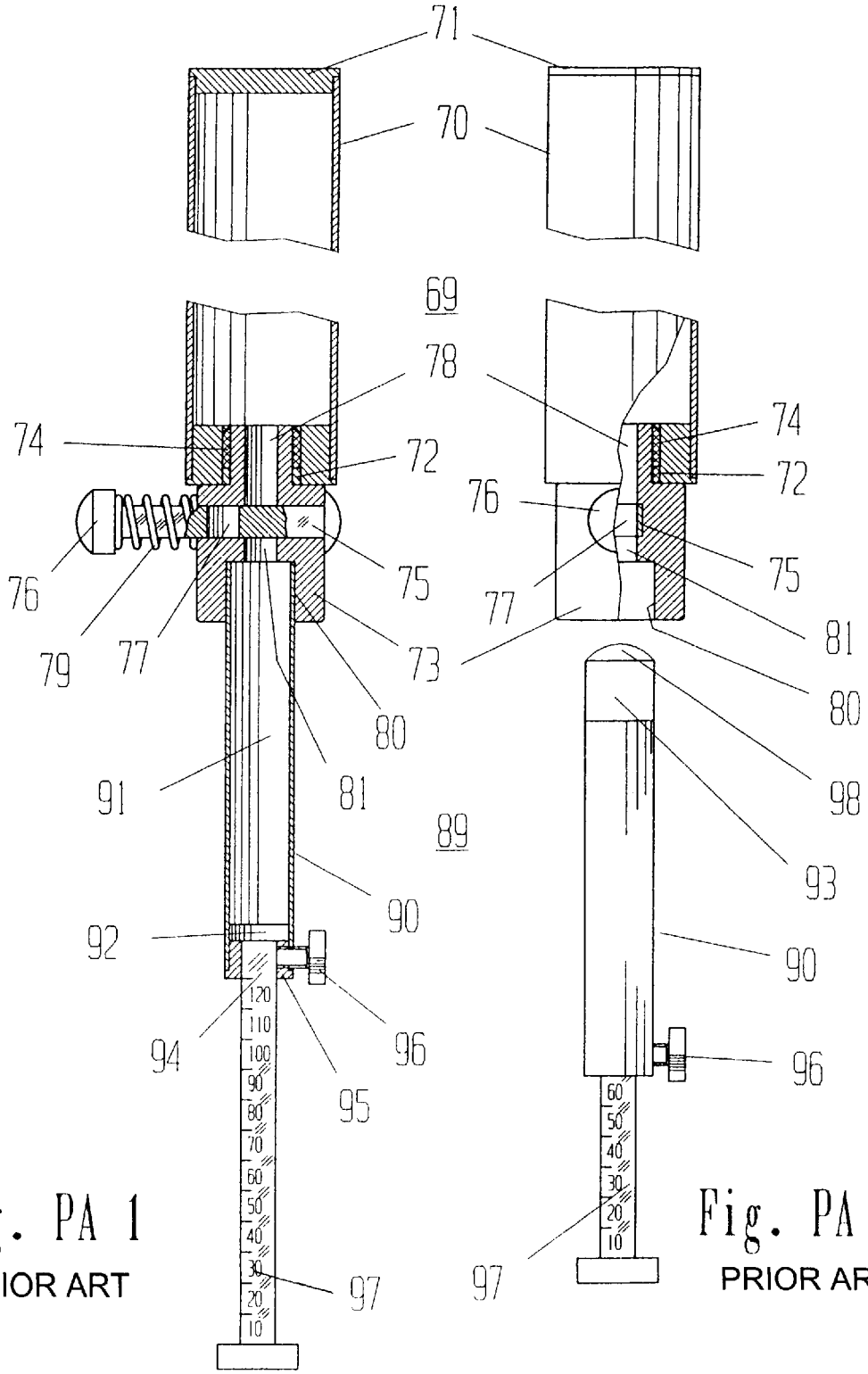
Fig. PA 1
PRIOR ART
Fig. PA 2
PRIOR ART

Fig. 9 D
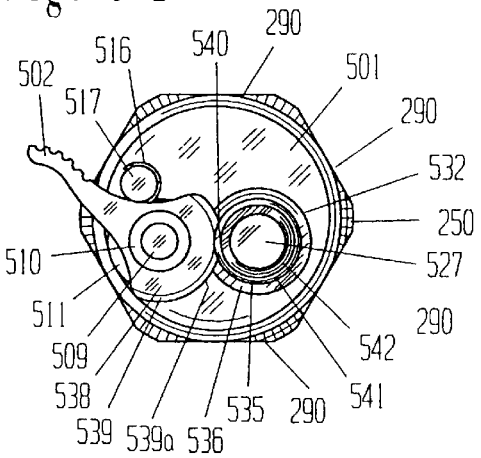
Fig. 9 F
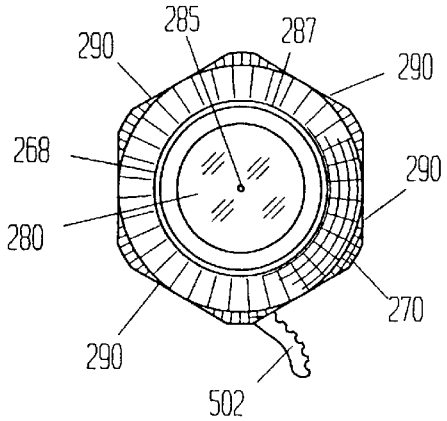
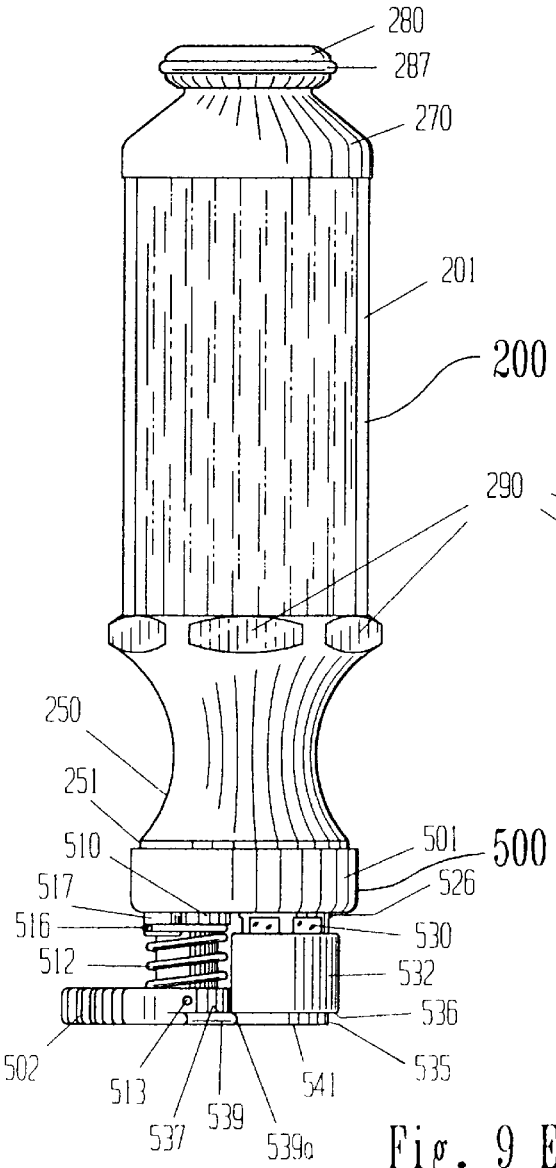
Fig. 9 E
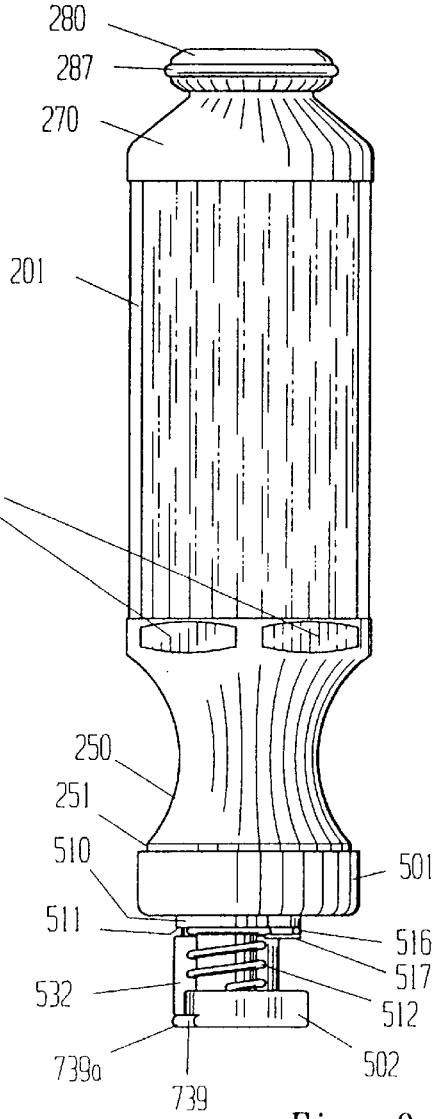
Fig. 9 G

Fig. 36
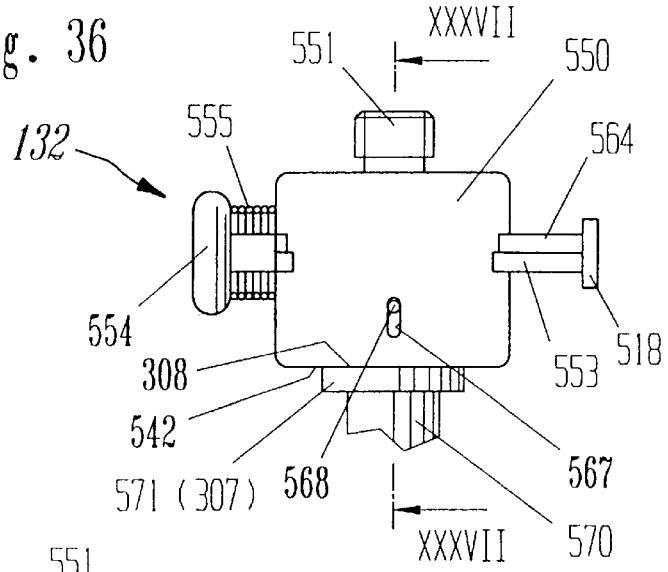
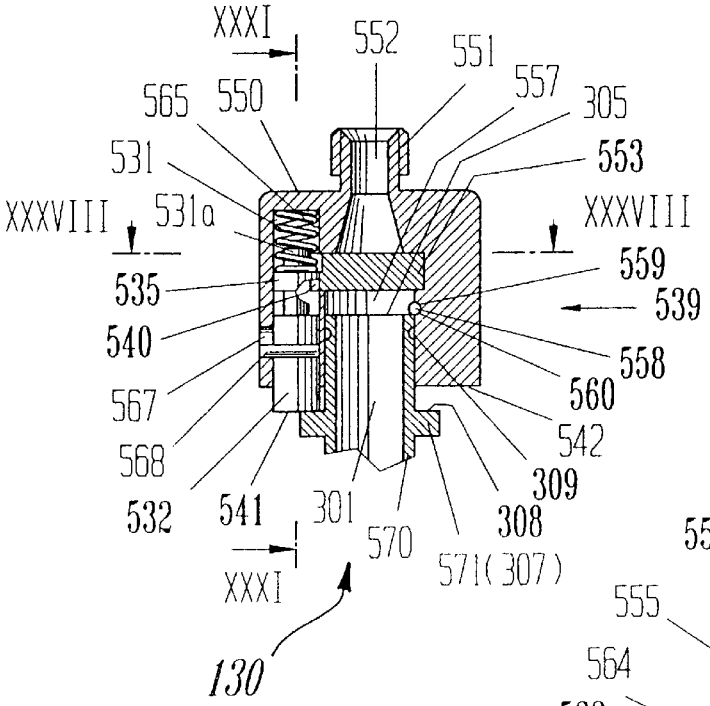
Fig. 37
Fig. 38
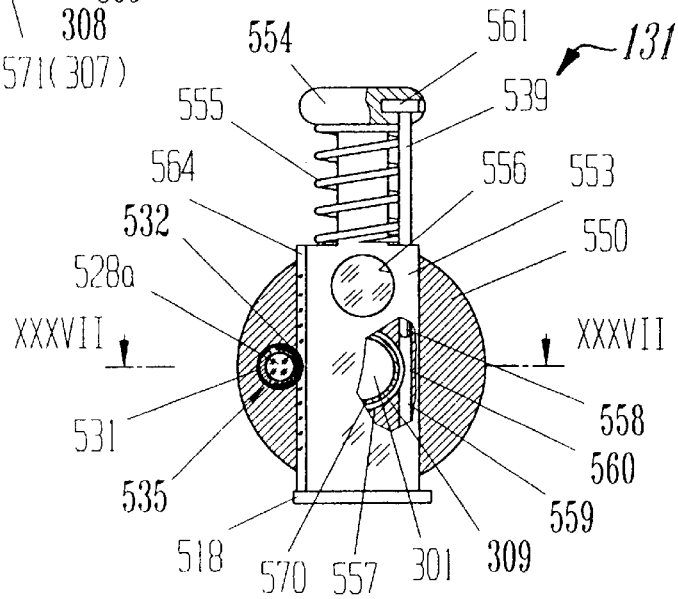

710

Fig. 57
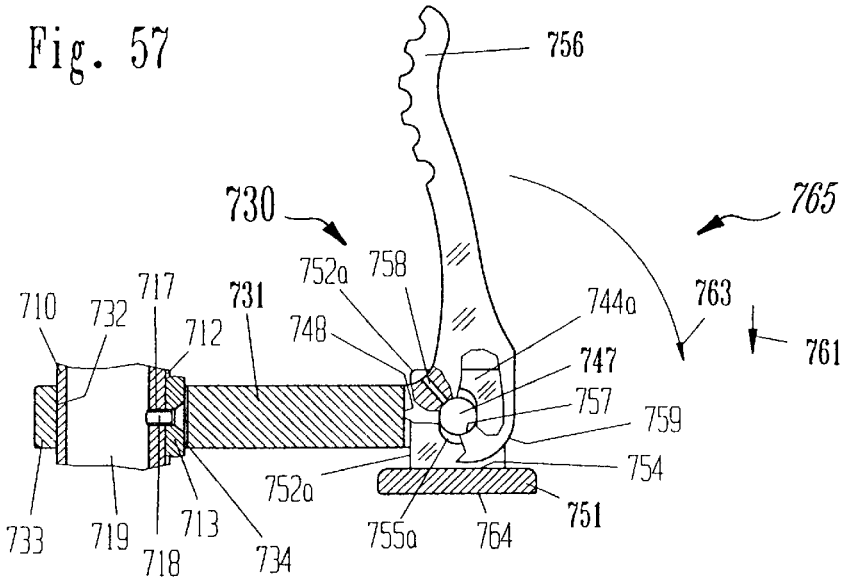
Fig. 58
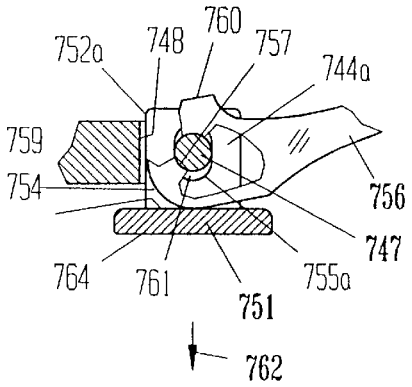
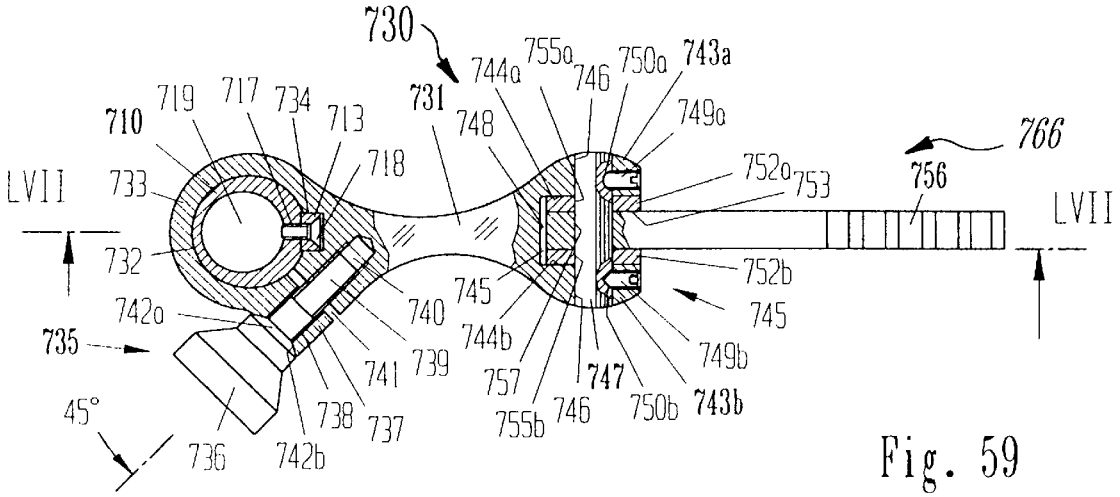
Fig. 59

Fig. 60
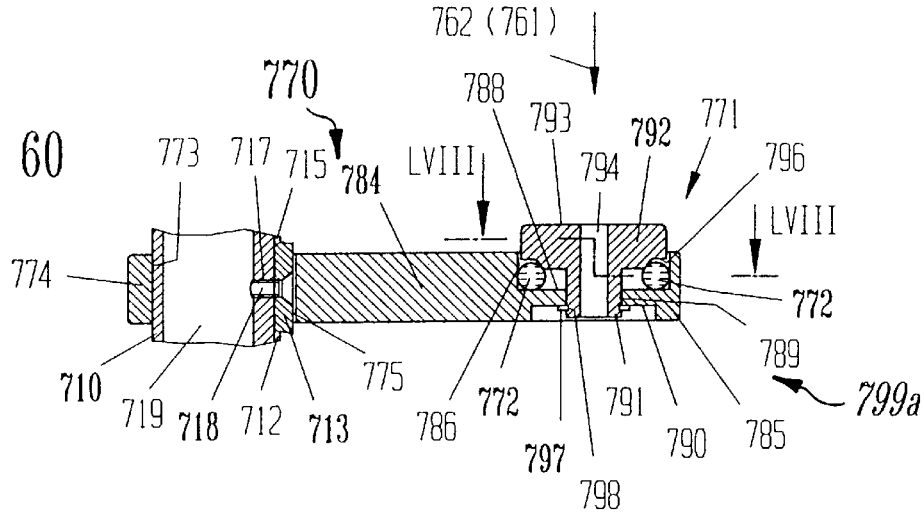
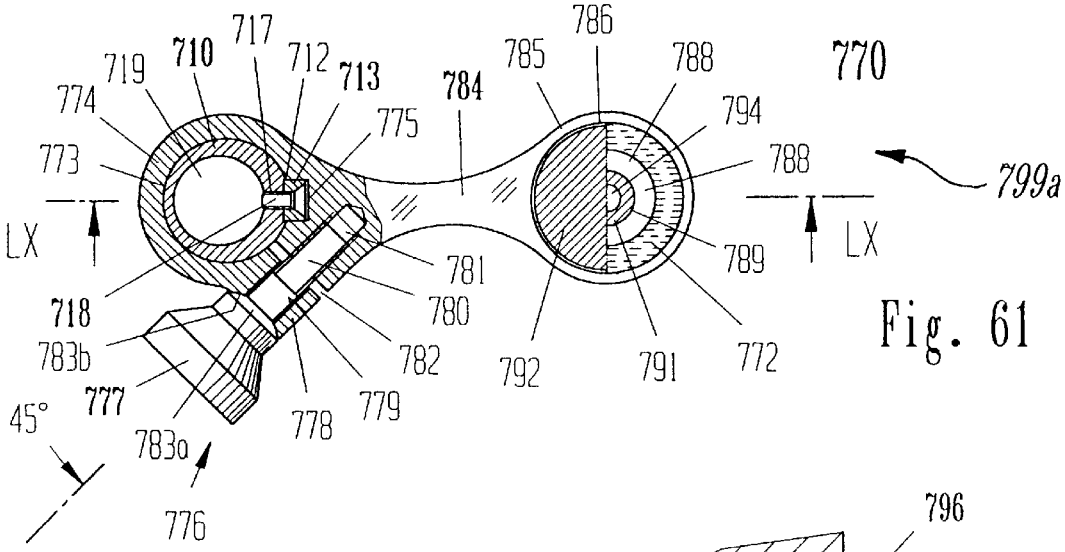
Fig. 61
Fig. 62 B
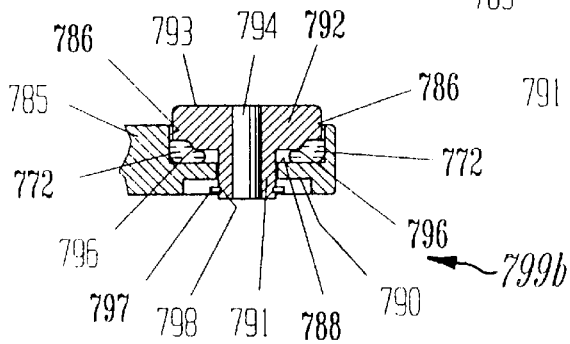
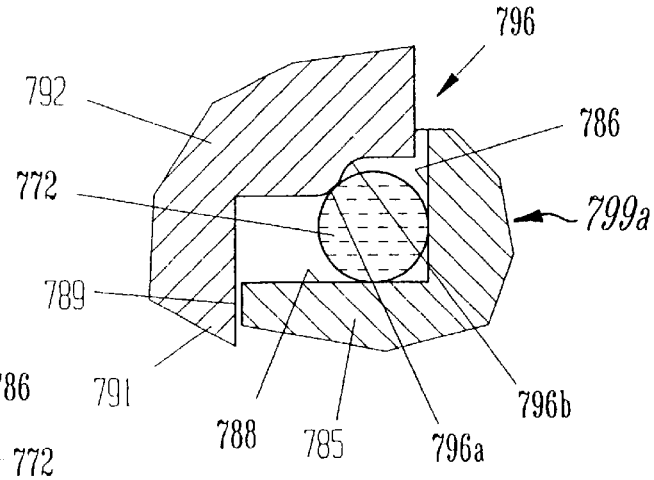
Fig. 62 A

ARRANGEMENT FOR DOSING POURABLE SUBSTANCES AND ASSOCIATED USES

This application claims the benefit of U.S. Provisional Application No. 60/101,823, filed Sep. 25, 1998.

BACKGROUND

1. Field of Invention

The invention relates to an arrangement for dosing granular materials, propellants, explosives, gunpowder and other pourable substances comprising at least a dosing unit with a measuring chamber for the taking up at least one effective volume of such a substance and a container for the substance with a closure, being transferable from a closed position into an open position, as well as an adhesive-joint to join the components of the container, a clamping holder to carry the container and a holding device for the vertical holding of the container attached at the clamping holder.

Furthermore, the invention concerns a preferred use for the adjustment of a desired nominal quantity SM of the substance on the dosing unit, as well as preferred uses of the device for the arrangement for dosing such substances by utilization of gravity.

In as much as in the following it is spoken about charge, thereby is generally meant an amount of such a substance. The term powder is used in the technical sense as a synonym for all pourable substances. The term powder flask is generally to be understood as a storage container for powder. If, furthermore, it is spoken about a user, a person is designated wanting to produce a predetermined amount of a substance.

2. Description of Prior Art

A standard publication with respect to propellants is the book of Dynamite Nobel titled "Wiederladen", 1995, 7th edition. In particular, the section "Pulver einfüllen" (page 93 following) is concerned with the dimensioning of charges.

Caution is required for while handling granular materials or other pourable substances or explosives. Particularly with propellants such as black powder or that like, a hazard exists, that, after the shot, glowing residuals adhering to the muzzle of the weapon, while leading up the storage container, for example a classical powder flask or a powder horn with a measuring socket attached to it, to the muzzle of the weapon, igniting the powder contained therein and thus brings the content of the powder flask to blast. Such an adjustable measuring socket for a powder flask is known from DE 99220.

Since the powder flask is at this moment close to the upper body and the face, such an incident leads to grave and possibly lethal injuries of the user and persons surrounding him. Therefore, in many countries it is no longer permissible to load a muzzleloader weapon directly from the powder flask. It is only permitted to fill a desired load of an accordingly separated quantity into the muzzle or into the chamber bores of muzzleloader revolvers. Besides, there is a latent hazard that powder gets spilled. It is also to be to consider that on shooting grounds on which also modern weapons are fired whose cartridges are loaded with nitrocellulose powder, serious accidents occurred in the past. While firing, particularly with short-barreled magnum-weapons, unburned nitrocellulose powder is released at shot. This is spread into the room by air circulation on a large scale. Especially on closed shooting ranges the hazard exists that residuals mix with the remains of spilled black powder. This can lead to an imperceptibly critical state. The residuals form an easily inflammable mixture, whereby the easily inflammable black powder acts as an ignition medium of the deflagrating nitrocellulose powder. Furthermore, this deflagration may bring to reaction other propellants or explosives held in containers in the rooms. Accidents of this kind always claimed human life in the past.

A device for filling gun cartridges with powder is known from the DE-16879 dating from the year 1881. The device consists of a supply container filled with powder, which is placed on an L-shaped angle bar at the short leg, whereby the long leg of the angle bar is standing upright connected to a vise. A track is placed at the long leg, being movable and fixable along the long leg of the L-shaped angle bar and arranged movable parallel to the short side. Between the short leg and the track there are two tubes which fit into each other and are movable horizontally between the leg and the track towards a outlet. At the long leg of the L-shaped angle bar, a scale is arranged, by means of which a variable quantum of powder can be determined by vertically shifting the tubes to each other, which then exits in the toward the outlet shifted position via same.

It is disadvantageous that the tubes are in close proximity of the supply container. Particularly black powder weapons are operated with their muzzle close to the supply container. The hazard described before can be avoided only through careful, difficult handling.

From DE-35 25 764, a powder-filling device for muzzleloader weapons became known, which allows the use of historical powder flasks with a measuring socket and a closure, being popular with muzzleloader shooters. The powder-filling device consists of a tube on which a funnel is attached.

The tube is functionally separated from the funnel by a closure. The user is measuring the charge in traditional art by means of a measuring socket attached to the powder flask, and then fill it into the funnel. After activating the closure the charge drops into the barrel of the weapon trough the tube.

Alternatively, the user may screw the measuring socket onto the tube and fill it with the powder flask. Spilled powder is collected in the funnel around the measuring socket. After activating the closure, the charge falls down from the measuring socket through the tube down into the barrel. The known powder-filling device did not meet wide acceptance.

Another method to portion charges consists in filling a powder measure from a powder flask, a storage container, or the like. An excess of powder, formed at the powder measure is stripped shearingly off by means of a funnel element mounted to and swivable across the powder measure. However, this is not permissible in closed shooting-ranges, since the stripped powder falls onto the ground and is only removable by difficulty from gaps. In addition, powder is wasted. With the funnel piece in turned in state, the charge is then filled into the barrel, a closable small loading tube or a cartridge case.

Some users also employ a ladle as is known for example from DE-27 49 831 finding application in pharmaceutics and chemistry for dimensioning small quantities as well as in reloading for filling cartridge cases. However, this has the great disadvantage, particularly when firing with muzzleloaders, that the storage container is often not closed from lack of time after removing the desired quantity. This can lead to a serious explosion of the powder contained in the storage container. This equally applies to laboratories or workshops.

Many users, therefore, utilize charges which are preportioned into small closable loading tubes produced in advance before entering the shooting-ranges or laboratories, either in described manner or by means of weighing. Especially performance-oriented users, such as sports shooters, opt for the time-consuming weighing of the charge to obtain adequate accuracy. In both instances, the charge quantity is dimensioned more or less precisely, but determined in its quantity as such. While firing, a problem often occurs with regard to the hit point respectively the reach. This is due to the powder characteristic, especially of black powder, to absorb humidity from the air. Because of the slowed-down ignition front the yield of powder converted into gas drops, resulting in the described loss of performance. Since a change of the charge on site in closed rooms is not possible on account of the conditions described earlier, the users compensate the loss of performance by changing the aiming point according to 'feel' more or less successfully.

From the U.S. Pat. No. 3,014,400 a shot cases filling device is known, with that shot contained in a container, which is equipped with a closure may be applied to cases. At opened closure, shot reaches freely rolling over a cone directly into the case. A pre adjustable measuring chamber as such is missing.

From the U.S. Pat. No. 4,971,229 a flask-type dispenser for powder is known, with that a measuring chamber is adjustable by means of screw threads placed in a casing and arranged swingable with respect to the container. A room is provided in the container for a reservoir and parallel to this an outlet channel is arranged which is closed by a swivable cover fixed at top of the casing. The measuring chamber is preset by means of a setting tool. By swinging the casing with respect to the container the measuring chamber becomes separated from the reservoir and fed powder towards the outlet. After twist of the dispenser, the content of the measuring chamber can leak while opening the cover. Therefor, the dispenser is not comprising a spatially separation of reservoir and measuring chamber.

Users mostly employ a stationery footed device for dimensioning the charges, as became known for example from DE-83 18 414, the U.S. Pat. No. 4,890,535 or by the label Harrell's Benchrest Powder Measure or the according Upgrade Kit distributed by Sinclair, Inc., Indiana, USA, in order to refill shot-off cartridge cases or empty loading tubes and to avoid the time-consuming weighing.

On the device shown in DE-83 18 414, a measuring chamber swivable connected with a storage container. In the closed position, the swivel mechanism unblocks the entry of powder into the measuring chamber. When turning the measuring chamber into a clearing position, the entry is blocked and the charge is released from the measuring chamber on account of its own weight. This type of stationery footed device is widespread since it is universally applicable for portioning small amounts of pourable substance. It appeared, however, that the filling pressure has a strong influence on the quantity of the charge. With the swivel mechanism in the closed position, powder pours into the measuring chamber according to its volume. The space between the individual powder particles is more or less extensive. Depending on the filling level of the storage container, the weight of the pillar of powder differently affects the filling pressure and thus, the accuracy of the charge. The clearing also presents a problem since residuals remain easily in the storage container.

Another device became known from the U.S. Pat. No. 4,890,535 with which a storage space of helix shape is moved from a filling position into an emptying position by a lever. The storage space is closed on one side by a bottom with hollow-bulged shape, which is connected to a micrometer for adjusting the desired amount of powder. On the open side, the storage space has a reduced opening. In the filling position, the storage space is standing upright. The reduced opening communicates with a supply opening of a basic body, in which the storage space is swivably mounted and to which a storage vessel with a flat bottom is associated. The supply opening feeds into a vertical passage.

This passage has an only minimally larger cross-section than that of the supply opening. Furthermore, the passage is placed eccentrically on the edge of the storage vessel.

However, it turned out that the required accuracy is, in practice, hardly achievable as the filling status of the storage space is contrary to expectations a subject of high variations. It occurs particularly with black powder and other pourable substances where the graining is subject to a relatively large variation range. Moreover, gunpowder tends to clotting.

Another, motor-operated device for dimensioning pourable material is known from U.S. Pat. No. 5,361,811. However, this is only suitable for stationery application. Moreover, it needs electric power for operation, which should be avoided.

A hand-operated device for the dimensioning of propellant charges became known by Warren Muzzleloading Co., Inc, Ozone, Ark., USA. A device of this type "500 g W/APM" (500 grain=32.4 g of capacity; 1 grain=0.0647989 g; Catalog number 73256); "SAFETY FLASK 500 GR" and an "Adjustable Black Powder Measure" (catalog number 16500)—as was delivered in 1998—is represented in FIGS. PA 1 and PA 2 and esteemed as closest prior art.

A container body 70 forming a cylindrical storage container 69 is, on one side, securely closed by a non-detachable lid 71. On the other side, it is provided with a holding thread 72 which holds a valve body 73 by means of a connection thread 74. The valve body 73 comprises a closure piece 75 that is crosswise movable and is resting pressurized by a pressure spring 79 in a closed position. With an operating device 76, the closure piece 75 can be moved into an open position, by which a passage-opening 77 located in the closure piece 75 opens a connecting path 78. On the side of the valve body 73 opposite to the connection thread 74, a bore 80 is located. A cylindrically formed outlet channel 81 is located between the closure piece 75 and the bore 80.

As is shown in FIG. PA 2, the "Adjustable Black Powder Measure", furthermore refered to as 'measure of capacity' 89, consists of a cylindrical tube 90 and a cylindrical measuring chamber 91, into which a slider 92 is immersed. At the end of the measuring chamber 91 opposite to the slider 92, the tube 90 shows an outside knurling 93. The slider 92 forms into a square cross-section 94 and is, in the passage area 95 opposite to the knurling 93, form-fittingly guided axially movable and fixable by a pressure screw 96. The slider 92 has a measuring scale 97 scaled in 10-grain steps from 0 to 120 grain. The amount of a charge is more or less correctly adjusted by shifting the slider 92 axially. In order to fill the measuring chamber 91, the measure of capacity 89 is being fed with the knurling 93 into the cylindrical bore 79 of the valve body 73, the device with the storage container 69 is placed upwards and the operating device 76 is operated for a filling time period. During this time, the storage container 69 and the measure of capacity 89 are held up more or less vertically by hand. When pressing down the operating device, powder attains via the connecting path 78, the passage-opening 77 and the outlet channel 81 into the measuring chamber 91. A release of the operating device 76 results in a closing of the connection path 78.

Firstly, it is a disadvantage that the powder charge produced in such way is relatively inaccurate. In addition, powder remains in the outlet channel 80 after closing the connection path 78, protruding like a small cap 98 which can easily be cast off inadvertently, either partially or in full, and falls onto the ground while taking the measure of capacity 89 out from the bore 79. Furthermore, the storage container 69 may not be emptied completely when changing from black powder to nitrocellulose powder. After removing the valve body, residues of powder are easily left in the container body 70. This should be avoided for aforementioned reasons. The operating device 76 may also be activated unintentionally, thus releasing powder uncontrolled and without being noticed. Finally, the association of the dosing unit to the closure may easily become disturbed during handling, which leads, in the least case, to an inaccurate amount of powder, and in the worst case to an unintentional release of powder. Furthermore, the clotting of substance leads to an incomplete filling of the measuring chamber 91.

OBJECTS OF THE INVENTION

The general object of the present invention consists in overcoming the disadvantages occurring in the prior art and to provide an applicable, flexible and easily transportable arrangement as well as to determine uses by which amounts of a pourable substance can be produced as safely, rapidly, easily and precisely as possible without danger of unintentional release of the substance. In addition, the functioning should be upheld also with substances which tend to clotting.

Another object of the invention consists in providing expedient support mediums for the stationery support of the container containing the powder.

Furthermore, the arrangement should also be rapidly applicable on site in laboratories or when firing, particularly in closed rooms, and be manageable in accordance with the dangers that must primarily be avoided in the operative range.

SUMMARY OF THE INVENTION AND ADVANTAGES

For the person skilled in the art, the principal safety object of the closely entwined, partial objects, is solved surprisingly easily according to the invention with an Arrangement for dosing granular materials, propellants, explosives, gunpowder and other pourable substances comprising at least a container with a closure and a dosing unit comprising a measuring chamber for the take up of said substance, said dosing unit is defined connectable with the container via a means of association for the purpose of dosing, whereby said closure is held self-powered in a closed position and is transferable by a means of actuating into an open position for opening, in that at least one means of locking is provided securing the closure in the closed position in order to prevent unintentional release of substance, whereby the means of locking is releasable preferentially by the dosing unit while connecting with the container latest while attaining the filling location in order to rest the closure in the closed position as possible long and effect an constrained control.

With the arrangement according to the invention, the requirement for a flexible but nevertheless secure handling of pourable substances is met in a particularly easy way as no powder may escape unintentionally at transport and operation. The closure is held reliably in the closed position by the means of locking and protected against unintentional opening. Only in the connected condition of closure and dosing unit, the means of locking is ineffective. Consequently, a misapplication of the closure is effectively prevented. The means of locking is preferably releasable by the dosing unit while connecting closure and dosing unit, whereby the means of locking becomes only ineffective, when the filling position is taken.

According to the invention by a further feature, the means of locking is associated to the means of association, and interacts locking with the means of actuating of the closure, due to this an unintentional opening of the closure especially during transportation or during handling is effectively prevented. In addition, the functionality of the means of locking can easily be visually verified.

If on account of the properties of the substance or in the field of application the problems exists, to both absolutely exclude the unintentional release of powder during production of the charge as well as the possibility of an unintentional release of powder during transportation and handling, then according to a further feature of the invention at least one means of holding is provided which is holding after connecting the dosing unit in the means of association in the filling position while filling it, whereby the means of holding is preferably associated to the means of actuating, in order to rest the association of dosing unit and container in the filling position already while opening the closure by that a separation of the dosing unit and the closure being in the open position during the filling process is prevented particularly effectively. Simultaneously, the repetition accuracy increases due to the unambiguous association. The coupling of the means of holding and the means of locking have the effect on the one hand, that the means of actuating is only actuable when the dosing unit inside the closure is brought into the filling position, then, however, the means of holding becomes effective and arrests the filling position. This creates in a convincingly simple way optimum operating reliability as well as excellent repetition accuracy. Concurrently, unintentional spilling of the substance is reliably prevented. The locking and holding function are functionally coordinated in their joint action according to the invention. This offers the advantage that an optimum handling safety is warranted when dealing with pourable substances, particularly with propellants and explosives or other similarly dangerous substances.

According to a further feature of the invention, the means of holding is preferably associated to the means of actuating and interacts by preference with the dosing unit, whereby a separation of the dosing unit and the closure being in the open position during the filling process is prevented particularly effectively. Simultaneously, the repetition accuracy increases due to the unambiguous association.

According to a further feature of the invention, the means of locking interacts in the closed position with the means of holding, in order to achieve a mechanical operational reliability which is as high as possible and a compact constructional form.

Advantageously the dosing unit comprises according to the invention at least one measuring holder, holding a means of measuring and at least one measuring body, which is connectable to said measuring holder via a connecting section, whereby the measuring-body being connected with the measuring holder comprises the measuring chamber. A dial indicator is well suitable as means of measuring. Du to this embodiment the relative precision of measurement is increased in a simple way, that means the load in relation to a pre-adjusted nominal quantity, for example caused by climatic circumstances prevailing at the shooting-range, can be read precisely and easily corrected accordingly.

Alternatively, the dosing unit is according to a further feature of the invention the dosing unit comprises at least a measuring holder holding a means of measuring, to said measuring holder is via a connecting section a measuring body associable comprising the measuring chamber;

or to said measuring holder is via a connecting section a measuring body associable comprising the measuring chamber and to that arranged ahead a measuring cavity whose volume is eqivalent by preference to at least one integer k-fold multiple of the effective volume WV of the measuring chamber with k=1 to n;

or to said measuring holder is via a connecting section a measuring body associable comprising the measuring chamber whose volume is equivalent by preference to at least one integer k-fold multiple of the effective volume WV of the measuring chamber with k=1 to n.

Thus, it is possible to satisfy the demand for individual quantities. Moreover, the dosing device is still easy to handle, since only as much sockets are needed as are absolutely necessary to obtain the desired quantity. This allows, in a surprisingly simple way and with as few parts as possible, to produce precisely portioned charges over a big dosing range, since the components are exchangeable and combinable in integer steps of the measuring range of the means of measuring with regard to the required quantity. Thus, a uniform measuring and repeating accuracy is achievable with a minimum of expense of components. Additional the number of measuring-bodies is optimizable.

Preferably the means of holding according to the invention interacts with the measuring body arranged next to the closure, thus keeping the mechanical design simple.

According to a further feature of the invention, the maximum measuring range of the means of measuring corresponds to the volume-related piled weight VG of substance of the effective volume WV of the measuring chamber, whereby the adjustment of the measuring chamber is bound with the effective volume.

As an option, the measure carrier comprises at least one shock-dampening means of absorption, whereby the means of absorption is preferentially a shock-absorbing body contained in a polygon-radial groove, and the polygon-radial groove has rounded corners in order to avoid buckle points.

If the priority is to surely avoid the hazard of releasing powder unintentionally during production of the charge, the arrangement is provided with at least one means of holding, holding the dosing unit within the means of association in the filling position in order to rest the relationship of the container and the dosing unit in the filling position and according to the invention the means of holding is beneficially associated to the means of actuating and interacts by preference with the dosing unit while opening the closure. On the one hand, the axial association-position is warranted by the means of holding. On the other hand, unintentional spilling of pourable material is effectively prevented. Furthermore, it is guaranteed that the association-position during the filling process cannot be changed unintentionally. Moreover, it renders possible a high reproducibility of the charge.

If the closure, according to another feature of the invention, is detachably connected with the container, the user may utilize any receptacles such as cans or canisters or historical powder flasks and the like.

Is the means of association according to a further feature of the invention detachably connected with the closure, various piled weights can be matched through exchange of differently sized means of association and appropriately adapted measuring-bodies. If the device is to be suitable for such flexible use, the association of the means of measuring to the measuring chamber has to be mediate implemented, for example by an exchangeable plate dipping into the measuring chamber and corresponding to the cross-section thereof. If a means of measuring is to be utilized, when dimensioning the effective volume, the cross-section of the measuring chambers is to be related to the maximum measuring range of the means of measuring.

According to a further feature of the invention, the dosing unit is in the means of association is approachable directly up to the closure into the filling position, in order to obtain a most precise position of the dosing unit for dimensioning of the substance, supporting highest accuracy of charge.

The container provides an important contribution to the secure handling of powder; in addition, it contributes essentially to the dosing accuracy and reliable operational function.

In the stationery footed device of DE-83 18 414, discussed on page 4, a storage container is already known with a so-called pouring brake with an inflow and an outflow, which has a ratio of the cross-section surface of inflow to outflow of 178:1. The diameter of the inflow amounts to 40 mm, that of the outflow 3 mm. However, it appeared that this so-called "trickle throttle" leads to unreliable portioning. Depending on the consistency and property of the substance, it may easily lead to clogging of the outflow, particularly at high clotting tendency. Also, the known storage container is rather limited to its stationery position.

Accordingly, the object is to provide a mobile container for taking up of granular material, propellants, explosives, gunpowder or other pourable substances, particularly for the described device for dosing pourable substances, which effectively avoids faults at dosage.

According to the present invention, this object is achieved by a container with a bleeding side to which a closure is associated, whereby the container comprises a head-part whose internal area constitutes a tapered off section averted from the closure whose angle of inclination (alpha) amounts to about 25° to 75°, preferably to about 35° to 60° whereby the tapered off section joins towards the bleeding side a section with constant cross-section followed by an expanding section to which the closure is associated and the ratio of the surfaces of entrance cross-section to outlet cross-section of the tapered off section is not larger than 50 over 1 in order to generate an inwards directed field of lateral force dependent on the extend of filling of the container, which generates an equalizing throttle effect onto the filling pressure which is acting in the region of the closure, if the container is set with the closure downwards.

It turned out surprisingly that the internal area can be utilized for the active generation of a throttle effect by means of a field of lateral force, which is dynamically built up by the substance itself. Simultaneously, the field of lateral force actively contributes to the cracking up of clotted substance, because of shearing forces resulting from dome shaped lateral forces effecting onto the clots while substance is regliding in the internal area. Thus the conditions for a precise dosage of the substance into the dosing unit, and the filling of the measuring chamber is reliably warranted.

Furthermore, it is advantageously if the container according to another feature of the invention a funnel-shaped section is arranged on the side opposite of the bleeding side, to which an opening is associated, being closable by means of a lid for the easier clearing of the container. After removing the lid, the container is thus easily fillable and clearable free of residues.

The container is able to be filled particularly safe and easily, if, according to a further feature of the invention, a funnel piece is associable to the opening of the bottom-part, for example by means of a thread, a bayonet or the like. The likewise constituted unit of container and funnel piece is easy and safely manageable with one hand, whereby the other hand is left free for handling a bigger supply vessel.

According to a further feature of the invention, the head-part is connected with the bottom-part by a container body of transparent material, as for example of polycarbonate or safety glass, preferentially by means of an adhesive-joint.

If it is required to produce a higher number of units of the container, it would preferably be developed as an integral one-piece component, whereby a closure is associable to this.

The design and construction of the container according to the invention is of particularly beneficial effect during competitions. On the one hand, the time available for a series of shots is limited. The shooter is unhampered by the simple, secure handling and is able to concentrate himself more on firing. On the other hand, a change of powder, for instance in the case of a change of weapon or the like, is especially simply, rapidly and, above all, safely practicable with the container according to the invention.

The production of a container which consists of several components raises the problem of achieving a durable, sufficiently fast and secure connection of the components, while the assembly should still be easily manageable. Screw joints did not prove effective since they may become lose during handling and the entire content of the container may escape unforeseen. The problem of the durable connection is not only limited to the container but generally concerns parts to be lastingly connected with each by means of an adhesive-joint.

From DE-74 06 802, an adhesive-joint became known for the connection of butted duct-ends. On the ends of the tubes, a coupling ring is placed. The coupling ring in its middle has an turned outward crease, being flanked on both sides by a slightly conical section. The ends of the tubes to be joined have normal 45° chamfers. The inner surfaces of the tubes are glued together with the outer sides of the coupling ring. Other connections between coupling rings became known e.g. from DE-89 10 407 or GB-85 20 361.

These known adhesive-joints require considerable manufacturing work and need a large spatial extension. Moreover, the cross-section of the tube is reduced inside and enlarged outside. Especially during flow-critical applications, this is of particularly adverse effect as it is known that the throughput is related in the fourth power with the radius. Also, the proposed, supplementary welding with a filler material is difficult to be carried out inside the tubes.

From DE-24 19 894, a pipe connection without coupling ring became known in which one tube is shaped with an inside cone and the other tube with an exterior cone, whereby the one tube has a cylindrical recess and the other a cylindrically-shaped protruding section, which supports a faultless reciprocal connection. A similar pipe connection is to be seen from DE-28 08 655.

Such adhesive-joints have the disadvantage that protruding edges will necessarily occur. Furthermore, these adhesive-joints are only to be carried out with difficulty and hinder the dosage of substance.

It is, therefore, desirable to create a universally applicable adhesive-joint for connecting two components, each with a surrounding rim for a container—or tube body, with a head-part on one side and on the other side a bottom-part, particularly for the container of the arrangement for dosing pourable substances, which a void s the described disadvantages of the prior art technology. It must, therefore, guarantee a fast, durable connection also at rough operation, reduce the assembly work, be technically neutrally functional and have an uncritical behavior with respect to the throughput.

For the person skilled in the art, this task is solved in an astoundingly simple way in that along a surrounding rim of the one component, the half of a convex circle segment runs preferably directed inwards, and along the other surrounding rim of the other component the half of a concave circle segment runs, congruent to the convex circle segment, whereby the circle segments are each entering perpendicular to the surrounding rims of the other component the components and the adhesive-joint occurs between the congruent circle segments. An adhesive-joint implemented in such a way comprises a surprisingly high strength and load capacity, particularly at swelling loads as well as three-dimensional stress condition.

If, for example, for assembly reasons, a separate connection element is desired at the adhesive joint, whereby the two components each case comprises surrounding rims, according to the invention each of the two components is comprising along each surrounding rim the half of a concave circle segment, whereby the circle segments are in each entering perpendicularly to the surrounding rims the components and together forming a groove, and that the connecting element is comprising a complete, convex circle segment, whereby the connecting element is arranged in the groove and that the adhesive-joint essentially occurs between the congruent circle segments whereby the groove is circulating inside or outside.

Both embodiments have in common that the adhesive-joint between the congruent circle segments increases the stability under load and durability lastingly, whereby a gluing gap remaining between the circle segments is to be dimensioned in accordance with the requirements of the used adhesive.

According to another feature of the invention, the circle segments are, largely comprising a common geometrical center point location at the intersection point of the surface normal of the circle segment with the surrounding rim. The design and development according to the invention effects to a balanced application of force.

According to the invention, the adhesive-joint is advantageously applicable if at least one of the two components is developed as a tubular body.

According to the invention, the connection element is preferably a circle segment ring comprising a symmetrically convex circle segment turned inwards or outwards and is arrangeable congruent with the respective design of the groove in it, thus enabling an easy assembly.

An adhesive-joint of this kind may also be applied in light-gauge construction and hydraulic engineering, as will be shown later on the example of a strut and a tube.

At usage of the device for dosing pourable material according to the invention it is of special advantage to place the previously described container according to the invention by itself, or at the closure, in a suitable clamping device, for example in order to incorporate it into an existing arrangement for reloading cartridge cases or otherwise in a vertical position.

Commonly, clamping devices for the uptake of an object are known in which the object is clamped by means of two oppositely arranged, arms tensible together. However, adequate fixation is often not achieved this way. This is however, very disadvantageous in the case of objects and particularly in the case of a container equipped with a closure. The need, therefore, exists to fixate objects such as the container as securely as possible.

From U.S. Pat. No. 4,291,855, a pipe clip became known in which two bracket segments are movably fitted, supported by a film-hinge, to a rigid base body. A snap-on connection is associated to the free ends of the clamping segments. In an open position, the free ends of the clamping segments are turned to each other and the ends of the two arms provided with the snap-on connection are spread wide open. If a tube is pressed head-on between the arms, the two arms will perform a wide swivel motion around the film-hinge-bearings until the snap-on connection engages. In case this does not occur, projections are provided to which a tool is attachable in order to secure the snap-on connection.

Further pipe clips with a film-hinge are known, for example from the DE-19 66 378, DE-21 55 866, DE-72 07 527, DE-72 22 855, DE-73 34 806, U.S. Pat. No. 3,954,238, GB-1 338 602. Pipe clips with two arms can be seen, e.g. in the DE-PS 871 021, U.S. Pat. No. 3,807,675, U.S. Pat. No. 3,543,355, IT-560 916.

From U.S. Pat. No. 3,521,332, a double-clip became known that is producible as an injection moulding mass product, with two symmetric arms moveably arranged to each other around a lever pivot designed as a film-hinge. At both ends, both arms are comprising clamping jaws, whereby the clamping jaws on the one end are resting together. The one clamping-claw pair is developed larger than the close-fitting one, whereby the lever pivot is assigned to the larger claw-pair. The object to be clamped is pressed head-on between the claw-pairs and held there.

With this known pipe clip, a cylindrical object is indeed, occasionally with the aid of tools, quickly fastened, however, the film-hinges are particularly subject to strong wear. A defect of only one of the film-hinges would lead to the object respectively the container falling out. Also, the clamping effect weakens rapidly, so that particularly the container easily rotates around its longitudinal axis when activating the means of operating. Also, a release of the snap-on connection is possible only with the aid of a tool. This may easily lead to damaging the closure of the container.

It is, therefore, the object to provide a clamping holder that securely clamps an object such as the container or the closure, in particular preventing the cylindrical object such as the container or the closure of twisting in clamped position and which functions reliably and durably.

This object is starting with a clamping holder for the take up of an object, particularly for uptake of container of the arrangement for dosing pourable substances at least comprising two oppositely placed arms, a tension means and a means of fixation, solved according to the invention in that a) the one arm is connected with the other arm by an integral spring element holding the arms in one piece in a non-tensioned initial position.

b) each arm is comprising a bearing area to which a clamping sector is associated, c) each clamping sector stands in interaction with the corresponding bearing area each via a spring unit and d) the arms are transferable from the non-tensioned position, in that the object is vertically insertable into the arms, into a tensioned position clamping the object, e) whereby the object is securely fixable between the arms by means of a self-generating four-point bearing which is self-centering and strengthening at clamping.

By means of this embodiment, a clamping is formed in accordance with the invention, which snuggling encircles and tightens the cylindrical object peripherally, clamping particularly a cylindrical object securely against twisting and is held safely against tipping over in the clamping holder According to a further feature of the invention, it is particularly beneficial if the tension means comprises at least one geometrically effective means of compensation. Thus the occurrence of lateral forces is avoided, resulting from tightening the tension means.

Preferentially then, the tension means is placed between the spring element and the bearing area in order to generate a uniform force distribution.

The clamping holder is especially well suited for mobile application and for fixation on the holding device according to the invention, when the means of fixation according to a further feature is embodied by a clamping ring, forming an integral part of the clamping holder, which is tightenable by an additional means of tensioning.

At a clamping holder particularly for the uptake of a cylindrical object with a diameter as like the closure or the container according to the invention to each bearing area and to each clamping sector an individual radius is associated, that is less than half of the diameter and the center points of the radii raising a trapezoid being essentially oriented crosswise to the arms.

The manufacture as a cast component is not to be recommended on account of the requirement for elasticity of the spring element and the spring units. Manufacture by means of forging is possible for demanding applications but expensive. The production by means of profile cutting is particularly economical. This semi-finished product can then be processed further by conventional metalworking operations, for instance on the radii and the fixation bores for the tension means and including the convex spherical surfaces. In order to avoid warpage, semi-finished, steadied plate products should be utilized.

In the handling of devices, frequently holding devices are used onto which clamping fixtures or other parts are fastened. Such holding devices are generally to be attached to tables, plates, shelve-boards or the like and are customarily fixed with screw or clamping connections as is known from the above cited DE 16 879. The latter are much appreciated due to their flexible application. However, to this the disadvantage is adherent that they may easily cause damages to the clamping surfaces of the table while attaching. In order to avoid this, users are inserting paddings, in most cases of wood or leather. These intermediate layers are easily lost. Moreover, the tension is rapidly loosening. Thus, the holding device may suddenly unfasten unintentionally and cause damages or accidents as a result. The operation of such holders is often complicated as well, since the clamping means are placed on the lower side, so that said damages to the holding surfaces do not become visible. Shooters in particular have the problem that the thickness of workbenches or of boards vary greatly at the different shooting-ranges. Users in laboratories and other workshops encounter the same problems.

Outgoing from a holding device, which is comprising at least one geometrically effective clamping device, one jaw block and one yoke, whereby the clamping device and the jaw block are associated to the yoke fixated opposite to each other as it is known from DE 16 879 cited earlier.

The object of the invention is to create a holding device that is flexibly applicable, secure, fast and easily manageable and distinguishes itself by high reliability without leaving damages on the fixing surfaces.

This object is solved at a generic holding device according to the invention in that the jaw block comprises a means of pressure compensation being effective in the tensing direction for geometrical compensation of the clamping movement caused by the clamping device in order not to damage the table, whereby by preference the clamping device and the clamping jaw are opposite to each other reciprocally attachable to the yoke. Thus, damages are avoided effectively and simultaneously a secure tension is constantly maintained. Moreover, the holding device can be put to use quickly on site.

It is according to a feature of the invention of further beneficial that the means of pressure compensation is constituted by at least one elastically deformable body placed between the jaw block and a pressure plate associated to the jaw block, preferably of an elastomer or at least a saucer spring. According to the environmental conditions a corresponding material and/or suitable means of resilient may be selected respectively.

An especially handy holding device according to a further feature of the invention will be achieved, if the clamping device is composed of a swivable eccentric lever and a pressure plate which is guided in a clamping jaw, limited in tensing direction, and movable by means of the eccentric lever in tensing direction for the purpose of generating a geometrical clamping movement.

In claim 26, the design of a tenter tool according to the invention is specified in particular for combination of the measuring-bodies, with which the measuring-bodies of the dosing unit are fixable to each other, without damaging them.

In order to quickly be able to provide a desired, precisely dimensioned amount of a pourable substance, the use of a dosing unit of the of the arrangement for dosing purable substances for the adjustment of a nominal quantity SM to the dosing unit is comprising by the invention in a) that a partial quantity TM=INT (nominal quantity/WV) * WV is determined, with WV=effective volume of a measuring chamber of the dosing unit, b) that a residual quantity RM=nominal quantity—partial quantity is determined in dependency on the determined partial quantity TM, c) that the partial quantity TM, if existing, is containable by at lest one measuring cavity of at least one measuring body or a combination thereof and d) that the residual quantity RM is adjustable by the measuring chamber.

In this way, highest accuracy may be achieved at maximum flexibility and lowest possible expenditure on measuring-bodies.

According to a further feature of the invention, the measuring cavity advantageously corresponds to at least one or an integer multiple of the effective volume WV. Therefore, the measuring cavity contains an integer k-fold multiple (with k=1 . . . n) of the effective volume. As an option when several measuring-bodies are utilized, the determination of the measuring cavities preferably occurs in a descending order, in order to identify the optimum applicable measuring cavity.

If a single-piece dosing unit is preferred, thus the measuring chamber at same to the measuring cavity, k starts at 0.

In order to produce a desired amount of a pourable substance precisely and as quickly and safely as possible, in accordance with the invention the utilization of by use of gravitation the arrangement for dosing pourable substances at least comprising a container and a dosing unit, said container comprising a closure held in self-powered closed position, whereby at least one means of locking is associated to the closure, protecting the closure against unintentional opening in said closed position, comprises at least the steps:

1. Joining the dosing unit with the closure of the container, whereby the means of locking is released at least when a filling position is adopted by the dosing unit;
2. Transferring the closure into an open position;
3. Maintaining the closure in the open position for a filling time interval and filling the dosing unit with the substance from the container;
4. Transferring the closure into the closed position;
5. Separating the dosing unit from the closure for the appropriate use of the portioned amount of the substance, whereby the means of locking again protects the closure against unintentional opening while the closed position is reached;

whereby at least from the beginning of step 3 the container and the dosing unit are placed vertically.

For the aim of getting additional security and accuracy of the charge a means of holding is supplied, which, according to the further feature of the invention effects locking in step 2 securing the defined association of dosing unit and container, said locking is primary freed up in step 4 in order to rest the dosing unit in the filling position while filling the dosing unit.

An arrangement equipped with a means of holding only, for dosing pourable substances comprising at least a container with a closure and a dosing unit having a measuring chamber for the take up of said substance, said dosing unit is defined connectable with the container via a means of association for the purpose of dosing, whereby said closure is held self-powered in a closed position and is transferable by a means of actuating into an open position for opening the closure, and that at least one means of holding is provided holding the dosing unit within the means of association in the filling position in order to rest the relationship of the container and the dosing unit in the filling position which is characterized according to the invention in that, the means of holding is associated to the means of actuating and interacts by preference with the dosing unit while opening the closure. Thus the association between the container and the dosing unit is kept precisely in position while the closer is open and the dosing unit gets to be filled, which cases on the one hand a high accuracy of the measured amount and prevention against missalignment of dosing unit while preparing the charge.

This arrangement is preferably handled by a use comprising at least the steps:

1. Joining the dosing unit with the closure of the;
2. Transferring the closure into an open position, whereby an interlocking of dosing unit and closure occurs due to the means of holding for resting the defined allocation of dosing unit and closure with respect to each other in the filling position;
3. Maintaining the closure open in the open position for a filling time interval and filling the dosing unit with the substance from the container;
4. Transferring of closure back into the closed position, whereby the interlocking of dosing unit and closure is released by the means of holding;
5. Separating the dosing unit from the closure for the appropriate use of the portioned amount of the substance;

whereby at least from the beginning of step 3 the container and the dosing unit are placed vertically.

At all uses, the container or the closure is preferably safely tensed against twisting in the clamping holder and therefore fixed to the holding device with the closure downwards, so that the container is arranged in a vertical, quasi stationary, and gravitation-effective functional position.

BRIEF DESCRIPTION OF THE DRAWINGS

The invention is subsequently described by several examples of embodiments being more or less schematically shown in the figures, whereon it shows:

FIG. PA 1 A known device for the dosage of pourable material in a half-sectional front view, FIG. PA 2 the known device according to FIG. PA 1 in side-view, FIG. 1 an arrangement according to the invention for the dosage of pourable material, FIG. 2A a first embodiment of a measure carrier of the arrangement according to FIG. 1 with an analog means of measuring in front view, FIG. 2B the measure carrier according to FIG. 2A in partially sectional top view, FIG. 2C a second embodiment of a measure carrier of the arrangement according to FIG. 1 with an analog means of measuring in front view, FIG. 2D a third embodiment of a measure carrier of the arrangement according to FIG. 1 with a means of measuring indicating in digital and analog mode in partial front view, FIG. 3 a group of measuring-bodies with measuring-bodies together with a funnel piece of the arrangement according to FIG. 1, FIG. 4 a socket group of the arrangement according to FIG. 1, together with a tenter tool, FIG. 5A a block diagram of the proceeding to set up a nominal quantity SM by means of a measure carrier, measuring body and socket group to a dosing unit, FIG. 5B a block diagram to determine the combination of the measuring-bodies and sockets of the socket group, FIGS. 6 to 8 the dosing unit with different sockets and with preset nominal quantity SM, FIG. 9A a first design of a container according to the invention of the arrangement according to FIG. 1 with fitted closure, in partially sectional view, FIG. 9B a first embodiment of an adhesive-joint on the container of the device, FIG. 9C a second embodiment of an adhesive-joint on the container of the device, FIG. 9D a view from below onto the container according to FIG. 9A, FIG. 9E a frontal view onto the container, FIG. 9F a view from above onto the container, FIG. 9G a view from the side onto the container, FIG. 10A a section of the container with the closure in sectional representation, FIG. 10B detail of the closure with a means of locking of FIG. 10A in enlarged view, FIG. 11A a view onto the closure in a closed position with a means of association, a means of holding and a means of locking, FIG. 11B a sectional view through the means of association, FIG. 11C a sectional view through the means of holding, FIG. 12 the dosing unit and the container just before their association to each other in a sectional view, FIG. 13 the dosing unit transferred with respect to the container into a filling position with the closure in closed position, FIG. 14 the dosing unit in the filling position with the closure in open position, FIG. 15 a sectional view onto the closure in the open position with means of holding being effective according to FIG. 14, FIG. 16 a sectional view of FIG. 15 through the closure being in open position with associated, filled dosing unit, FIG. 17 a side-view of the dosing unit and of the container shown partially just before association to each other, FIG. 18 an example A of a dimensioned amount of substance, FIG. 19 an example B of a dimensioned amount of substance, FIG. 20 a block diagram for a dosing process, FIG. 21 the container in accordance with FIG. 9A with a funnel piece for filling the container, FIG. 22 the container in accordance with FIG. 9A and a funnel for clearing the container, FIG. 23 the tenter tool to release the connection between the measuring parts and the funnel, FIG. 24 a sectional side-view of a second design of the closure with the means of holding, FIG. 25 a cross-sectional view of the closure according to FIG. 24, FIG. 26 a sectional front view of the closure according to FIG. 24, FIG. 27 the means of holding as an enlarged detail before activating the closure, FIG. 28 the means of holding as an enlarged detail after activating the closure, FIG. 29 a sectional front view of a third design of a closure with the means of locking, FIG. 30 the means of locking as an enlarged detail according to FIG. 29, FIG. 31 a side-view of the closure according to FIG. 29 in longitudinal section, FIG. 32 a cross-sectional view of the closure according to FIG. 29, FIG. 33 the means of locking before activating the closure being in its secured position as an enlarged detail, FIG. 34 the means of locking after reaching the filling position of the dosing unit, FIG. 35 an enlarged, partial top view onto the closure in open position, FIG. 36 a sectional front view of a fourth embodiment of a closure in open position with a means of holding and a means of locking, FIG. 37 a front view of the closure according to FIG. 36 with the closure in closed position, FIG. 38 a cross-sectional view of the closure according to FIG. 36, FIG. 39 the container of integrally one-piece type FIG. 40A a further embodiment of the container with a closure piece in the closed position and a dosing unit, FIG. 40B the container according to FIG. 40A with a detachable lid, FIG. 41A a block diagram for an arrangement for dosing pourable substances with a means of holding, FIG. 41B a block diagram for an arrangement for dosing pourable substances with a means of locking, FIG. 42 a clamping holder for clamping objects like the container or the closure, FIG. 43 a cross-sectional side view of the clamping holder, FIG. 44 a partial side-view of the clamping holder according to FIG. 42 with the closure attached to the container, FIG. 45 a representation of the radii of the clamping holder according to FIG. 42 and associated angles, FIG. 46 a cross-section of a spring element of the clamping holder, FIG. 47 enlarged view of the clamping holder in non-tensioned initial position, FIG. 48 the clamping holder in tensioned position in an enlarged view, FIG. 49A an arm in non-tensioned initial position in cross-section, FIG. 49B an arm and the object in non-tensioned initial location in cross-section, FIG. 49C the arm and the object according to FIG. 49B in tensioned position, FIG. 50 a section of the clamping holder in non-tensioned initial position, FIG. 51 a view of structure of the clamping holder in non-tensioned initial position on the example of an unsymmetrical object, FIG. 52 sectional detail of the clamping holder in tensioned position, FIG. 53 a structural representation of the clamping holder in tensioned position on the example of the unsymmetrical object showing the distribution of forces, FIG. 54 a holding device for the clamping holder with a container attached to it and dosing unit brought into the filling position, FIG. 55 a yoke of the holding device according to FIG. 54 in side view partially broken up, FIG. 56A a cross-section of the yoke of a first embodiment, FIG. 56B a cross-section of the yoke of a second embodiment, FIG. 57 a clamping device of the holding device according to FIG. 54 shown in a non-tensioned initial position in sectional side-view, FIG. 58 the clamping device in a fixing position in an partially broken up side view, FIG. 59 the clamping device in the fixing position in partially broken up top view, FIG. 60 a jaw block of the holding device according to FIG. 54 in a sectional side-view in a neutral initial position with a means of pressure compensation, FIG. 61 a top view on the jaw block with the means of pressure compensation according to FIG. 60, FIG. 62A the means of pressure compensation in neutral initial position in an enlarged, detailed side-view, FIG. 62B the means of pressure compensation in a tensioned position, FIG. 63 a longitudinal section of a second embodiment of the adhesive-joint according to the invention on the example of a strut with head-parts for lightweight construction or the like, FIG. 64 a cross-section of the head-part according to FIG. 63, FIG. 65 a cross-section of the adhesive-joint of the strut according to FIG. 63, FIG. 66 the adhesive-joint according to FIG. 63 in an enlarged section, FIG. 67 a third embodiment of an adhesive joint according to the invention on the example of a tube consisting of tube bodies linked by means of a connection element, FIG. 68 a cross-section of the adhesive-joint according to FIG. 67, FIG. 69 the adhesive-joint according to FIG. 67 in enlarged section, FIG. 70A a sectional top view on a first embodiment and FIG. 70B a sectional top view on a second embodiment of the connection element.

DETAILED DESCRIPTION OF THE INVENTION

Similar parts will furthermore be referenced by identical signs as far as this is appropriate. As for the dimensioning of small quantities of pourable substances in solid form the unit grain (1 grain=0.0647989 GRAM) has been generally adopted, the invention is furthermore preferably expounded by utilizing the unit grain, whereby the corresponding quantity in grams is specified in (brackets). In the following, a volume-related piled weight VG of 15278 grain/1 litre (990 GRAM/1 litre) for such a substance 102 is assumed.

Figure 1:
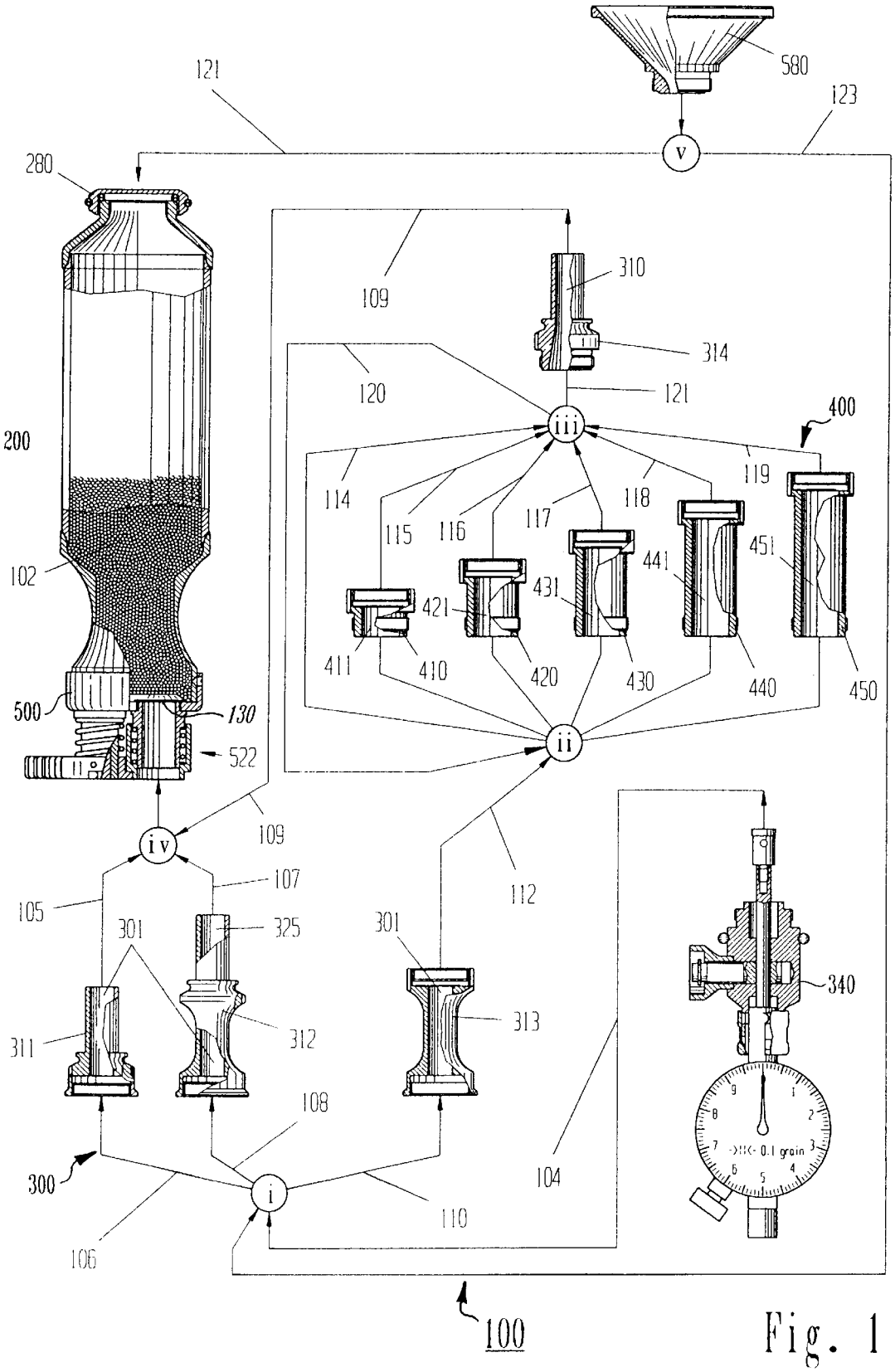

In FIG. 1 an arrangement 100 is shown for dosing pourable material 102. The arrangement 100 comprises a container 200 which is holding the substance 102 and a dosing unit 300 modularly assembled. It includes a measure carrier 340 for which measuring parts 311, 312 each defines a measuring chamber 301 or by interposition of a base part 313, also defines a measuring chamber 301, and a group of measuring-bodies in the form of sockets 400 are directly associable via different logic nodes i to iv. On this occasion it is to be decided via a first connecting path 104 at a first logic node i in accordance with a desired nominal quantity SM of pourable material 102 whether the measuring part 311 or the large measuring part 312 is required. The association to the measure carrier 340 then ensues via a connecting path 106 or 108.

In case the measuring parts 311 and 312 are not adequately large for the uptake of the desired nominal quantity SM, the base part 313 is associable via a connecting path 110. Via a combination path 112 at a second logic node ii in accordance with the nominal quantity SM, a bung piece 314 is associable to the base part 313 directly via a connecting path 114 to the logic node iii.

If the amount of substance achieveable this way is not sufficient, different sockets 410, 420, 430, 440, 450 of the socket group 400 can be either individually, via connecting paths 115, 116, 117, 118, 119, combined or among each other via a connecting path 120 between the logic nodes ii and iii in order to pre-adjust the desired amount of substance 102. The combination that is determined this way constitutes the dosing unit 300.

The container 200 shown in FIG. 1 comprises a closure 500 with a association device 522. To the association device 522, the dosing unit 300 is associable via a logic node vi either via the association path 105 and the measuring part 311, or via the association path 107 and the large measuring part 312, or via the association path 109 and the bung piece 314 connected with the base part 313 associable to the container 200 of the arrangement 100 for dosing a desired amount 103 of substance 102.

The container 200 comprises a removable lid 280 at its end opposite to the closure 500. A funnel piece 580 is, on the one hand, connectable through a logic node v via a connecting path 121 with the container 200 if the lid 280 is removed. On the other hand, the funnel piece 580 is also connectable via a connecting path 123 via the logic node i with one of the measuring parts 311, 312 or the base part 313 to form a funnel 599 (see FIG. 22). Also available here is the possible combination of the socket group 400 described before in order to match a length of the thus resulting funnel 599 to the given conditions. The procedure will yet be described later.

Figure 2A:
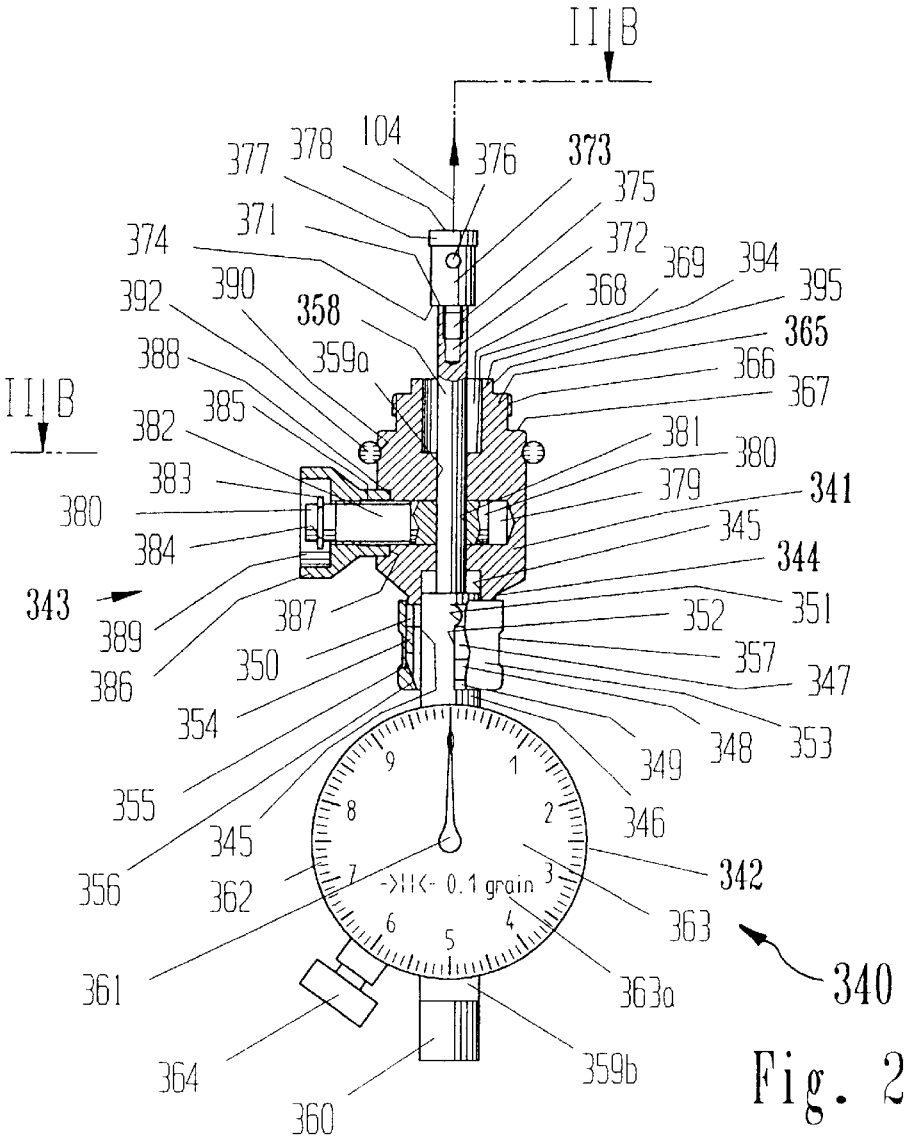

In FIG. 2A the measure carrier 340 is shown. It comprises a base body 341 to which a means of measuring 342 is associated, fixable with a locking device 343. The base body 341 comprises an uptake section 344 with an uptake bore 345, in which the means of measuring 342 with a shank 346 is resting. The uptake section 344 further comprises a male thread 347 and a first and a second cone section 348 and 349. The male thread 347 is provided with a clearing turn 350 interspersed by four bores 351 which are in a right angle to each other. The bores 351 form the ends of longitudinal slits 352, which intersperse the uptake section 344. A lock nut 353 with a female thread 354 engaging with the male thread 347 is assigned to the uptake section 344. The lock nut 353 comprises, besides the thread undercut 355, a cone 356 being congruent to the cone sections 348 and 349. On the lock nut 353, key surfaces 357 are provided for radial pulling. If the lock nut 353 is tightened with a wrench catching into the key surfaces 357, the shank 346 of the means of measuring 342 is reliably clamped without axially displacing the shank 346. Thus, a misalignment of the means of measuring 342 is excluded. Any other circularly clamping device can be applied for this purpose, as long as a centric uptake and a secure fixation of base holder 341 and means of measuring 342 are guaranteed.

In the shank 346, a longitudinally movable measuring rod 358 is held, which is used for the transmission of the displacement shift of the measuring rod 358 to the means of measuring 342. The measuring rod 358 is further adjustably held in a guide 359*a* assigned to the base body 341 as well as in a guide 359*b* assigned to the means of measuring 342. A stopper 360 is arranged on the guide 359*b*, limiting the way of the measuring rod 358 in one direction. A displacement of the measuring rod 358 is transmitted by a clockwork, not represented here because it is not part of the invention, in known manner to a pointer 361, whose position is then readable on a scale 362 of a numeral dial 363. The scale provides information about the measuring range of one revolution of the pointer and a unit imprint 363*a* about the smallest possible accuracy of reading. The scale 362 is circumferentially adjustable and lockable with a clamping device 364.

On the side opposite to the uptake section 344 a connecting section 365 is provided comprising a male thread 366 and a collar plane 367, whereby the male thread is undercut. A depression 368 with a level depression ground 369 is centrically featured. The measuring rod 358 leads through the base body 341 and comprises at its distal end a plane surface 371 and a female thread 372. To the distal end, a slider 373 is assigned comprising a stop face 374 and a thread pin 375 which is screwed to the female thread 372, so that the stop face 374 rests on the plane surface 371 of the measuring rod 358. The slider 373 also features a fixing bore 376 for easier separation of slider and measuring rod and on its end opposite to the thread pin 375 a plate 377 with a level plate surface 378. The stop face 374 is radially larger than the measuring rod 358 and represents an, contrary to the stopper, effective boundary to the axial moveability of the measuring rod 358.

Between uptake section 344 and connecting section 365, the base body 341 defines a cross-oriented blind hole 379 in which a tentering pin 380 is moveably arranged. The tentering pin 380 is interspersed by the measuring rod 358 via a cross-bore 381 and has a male thread 382 and a groove 384 supplied with a securing ring 383. The male thread 382 is in interaction with a tension screw 386 via a female thread 385. The tension screw 386 has a pressure surface 387 which rests against a corresponding contact surface 388 on the base body 341. The activation of the tension screw 386 causes the locking of the measuring rod 358 in the guide bore 359*a*. Furthermore, the tension screw 386 features a flat depression 389, which jointly with the securing ring 383 prevents an unnoticed drop of the tension screw 386.

Figure 2B:
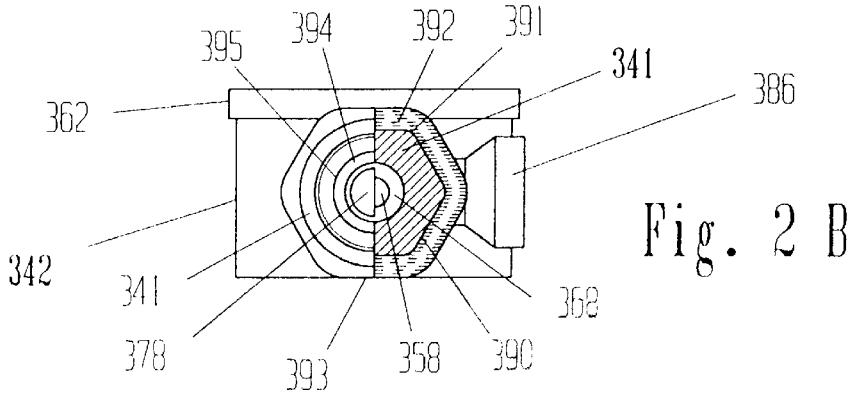

Furthermore, as can especially be seen from FIG. 2B the base body 341 is close to the collar plane 367 encircled by a polygon-radial groove 390 having rounded corners 391. In the polygon-radial groove 390 rests a shock-damping means of absorption 392, preferably in the form of a polymeric O-ring. The task of the means of absorption 392 consists in protecting the collar plane 367 from damages and other impulsive strain while using the measure carrier 340, especially if the base body 341 is put down separately. Herewith the means of absorption 392 can also be replaced by directly vulcanized material. The goal should be to constitute at least one oblong rest 393 oriented parallel to the blind hole 379 and that the base body 341 can be safely put down. The base body 341 comprises in the connecting section 365 before the male thread 366 a centering collar 394 with a centering surface 395.

Figure 2C:
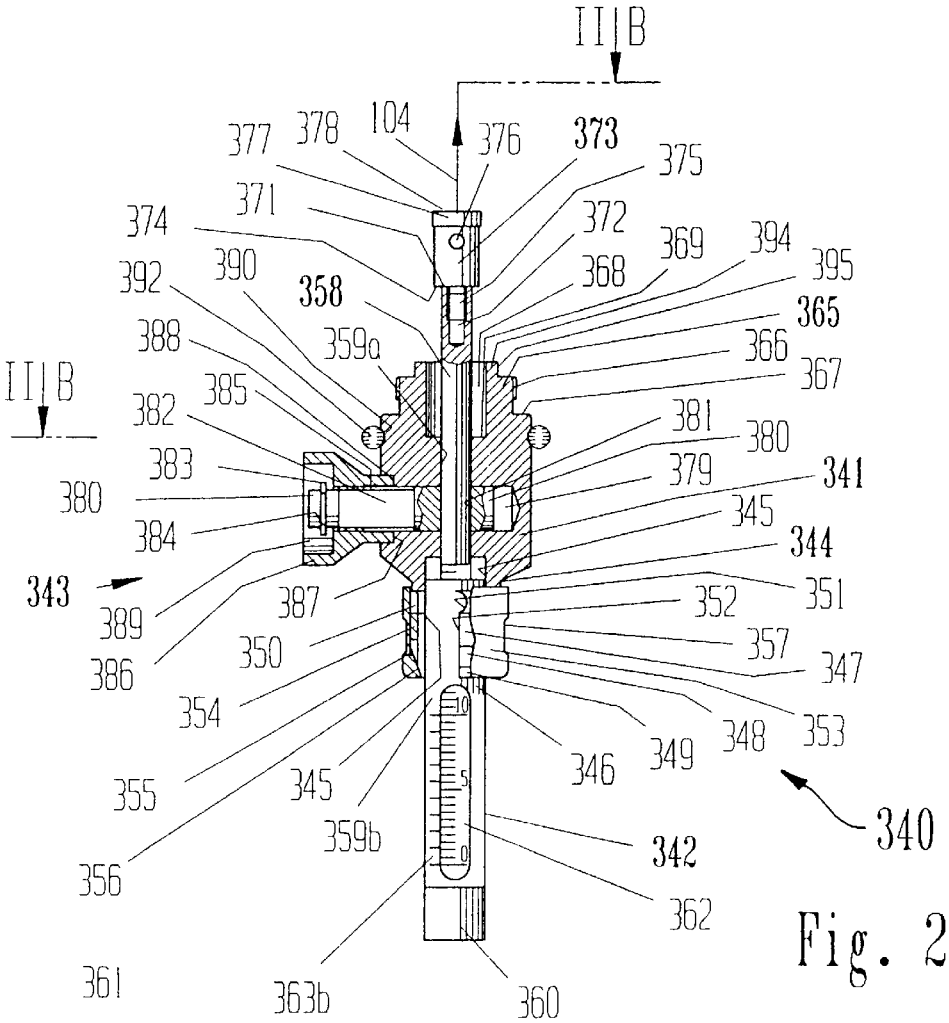

In FIG. 2C a measure carrier 340 is shown with the means of measuring 342 having a scale 362 with a range of 0 to 10 grain (0 to 0.648 GRAM). A vernier 363*b* is assigned to the scale 362, so that the nominal quantity SM of 0.1 grain (0.00648 GRAM) is precisely pre-settable. The axial adjustment is effected by releasing the locking device 343 corresponding to the set-up of the shank 346 and by fixation of the locking device 343.

Figure 2D:
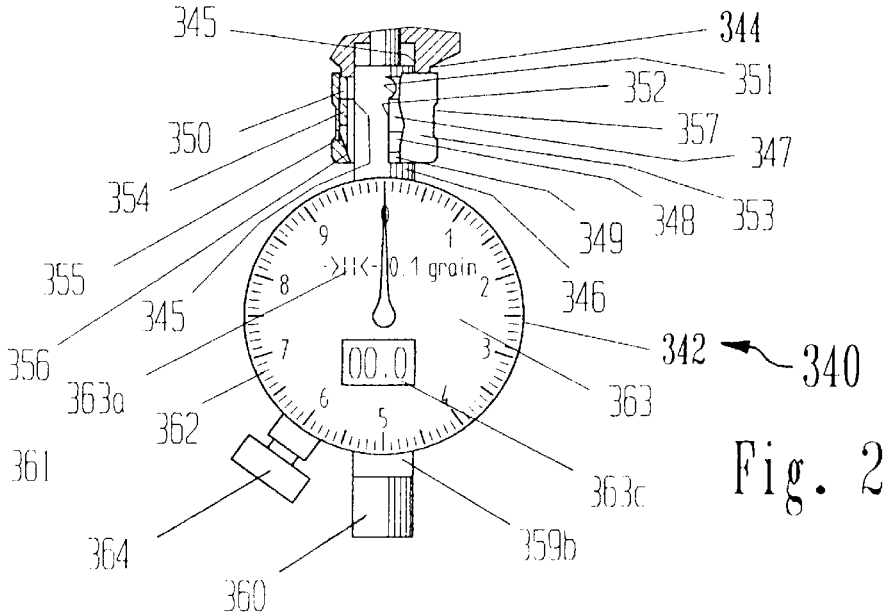

FIG. 2D shows the uptake section 344 of the measure carrier 340, whereby the means of measuring 342 having a digital display 363c combined with the analog indicating pointer 361 is placed in the uptake bore 345.

Figure 3:
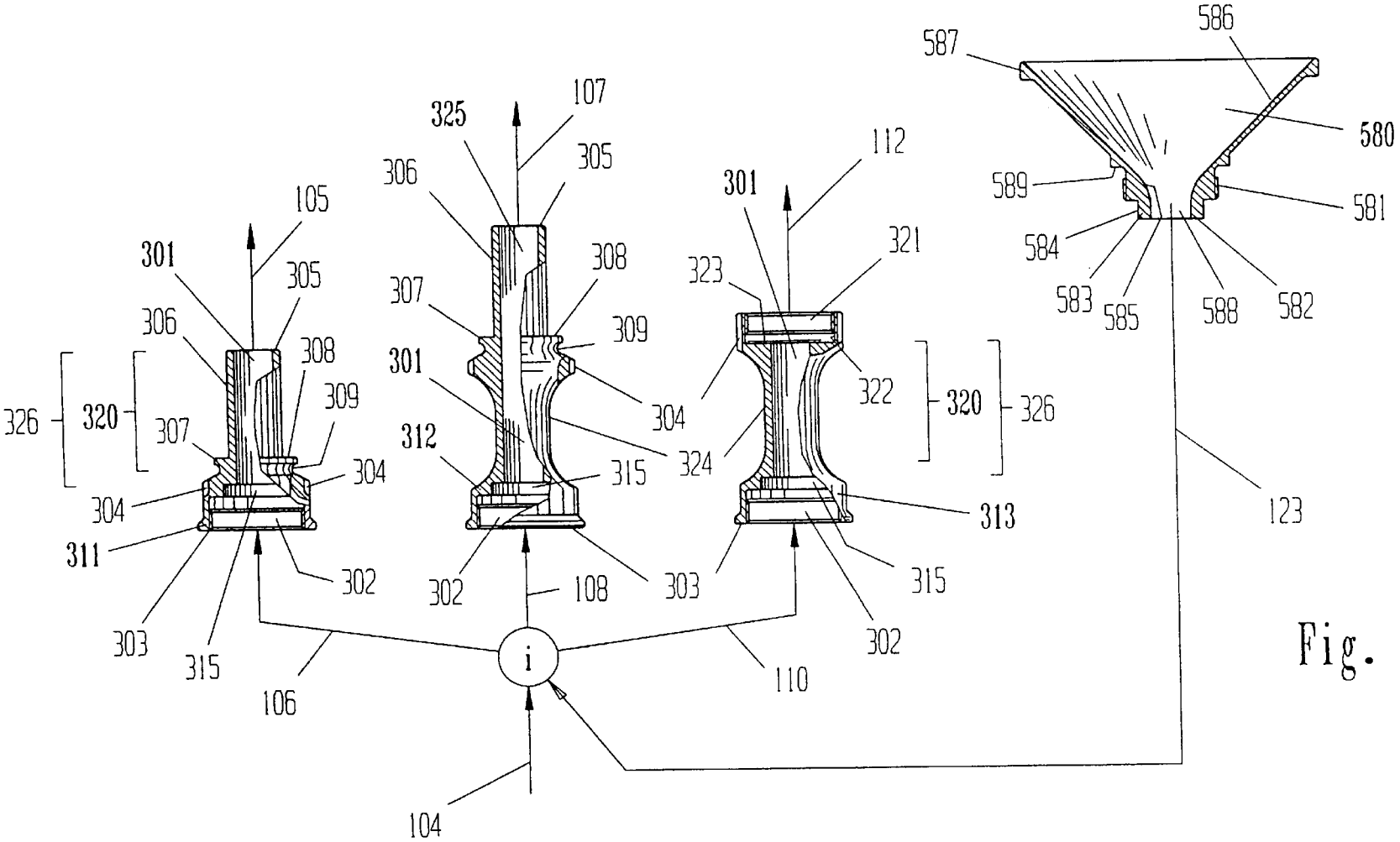

The measure carrier 340 is connectable via the connecting path 104, as described above, with one of the measuring parts 311 or 312 or the base part 313, as shown in FIG. 3. For this purpose, each of the measuring parts 311, 312 as well as the base part 313 is comprising a female thread 302 with which it is connectable with the male thread 366 of the base body 341. Furthermore, every measuring part 311, 312 as well as the base part 313 has a plane surface 303, which gets into interaction during connection with the collar plane 367 of the connecting section 365 of the base body 341 and is securing an axially defined association. As other possible connection means in addition to the shown screw joint, also sticking- or bayonet connections may come into consideration, as long as a co-axially and axially fixing association of the measuring parts as well as of the base part with respect to the base body is guaranteed.

As additionally is to be seen from FIG. 3, each of the measuring parts 311 and 312 as well as the base part 313 comprises a fit bore 315 into which the centering collar 394 of the base body 541 is inserted with its centering surface 395 while being connected for radially centering. Each of measuring parts 311, 312 as well as the base part 313 each has a measuring chamber 301 in cylindrical form. The plate 377 of the measure carrier 340 extends into the measuring chamber 301 if the corresponding measuring body is connected with the base body 341. The measuring chamber 301 and the plate 377 can also have an arched or angular cross-sectional form. However, in this case consideration has to be taken for the radial alignment.

Every measuring body is furthermore equipped with two cylindrical grooves 304 oppositely placed to each other, into which engages a tenter tool 330 described later. The measuring part 311 and the large measuring part 312 show at the side opposite to the female thread 302 an end surface 305 from which an association collar 306 is starting to which a stop collar 307 with a stop face 308 is assigned. Directly behind the stop face 308, a radially surrounding annular groove 309 with a bow-shaped cross-section is arranged in the stop collar 307. The large measuring part 312 essentially only differs from measuring part 311 in that above the measuring chamber 301 a measuring cavity 325 is associated to it.

The base part 313 constitutes the initial foundation for a combination of sockets 410, 420, 430, 440 and 450. On the side opposite to the female thread 302, a pick up female thread 321 is provided, which is different in size from the female thread 302 in order to avoid errors. A thread groove 322 and a plane stop face 323 are associated to the pick up female thread 321. The base part 313, connected to the measure carrier 340, is connectable via the connecting path 112 with one or several sockets of the socket group 400.

The large measuring part 312 is, between the female thread 302 and the stop collar 307, and the base part 313 between the female thread 302 and the pick up female thread 321, supplied with a throat 324 for weight reduction.

The measuring chamber 301 in the design example is dimensioned in such way that a quantity of 10.0 grain (0.648 GRAM) corresponds to the stroke of the measuring rod 358, which corresponds to a full pointer revolution at the means of measuring 342 on the scale 362. If, furthermore, it is spoken of an effective volume 320, such volume is meant, which is suitable for the uptake of the maximum amount of substance 102 containable in the measuring chamber 301, here 10.0 grain (0.648 GRAM).

Thus, the dimensioning of the measuring chamber 301 with regard to the effective volume 320 depends in each case on the volume-related piled weight VG. With a simple conversion of the piled weight to the appropriate volume with respect to the desired nominal quantity SM, here 10.0 grain (0.648 GRAM) and the desired axial stroke of the measuring rod 358, respectively the plate 377, in the measuring chamber 301, the dimensions is calculable as follows:

Length of the measuring chamber=Sqrt (1E6/15278*Pi/A*4) with A=Cross-sectional area [$mm^2$] and Pi=3.1415 (1)

The ratio of the cross-sectional area in $mm^2$ to the length in mm of the cylindrical measuring chamber 301 should be in accordance to the grain size within a range of about 1 over 2 to 5 over 2. With black powder, a ratio of about 1.6 proved to be suitable.

The technical length 326 of the measuring chamber 301 is to be chosen slightly longer, since otherwise the plate 377 escapes from the measuring chamber 301 and the substance can enter into the depression 368 leading to disturbances.

In a connected state, the plate 377 extends into the measuring chamber 301. If the measuring part 311 is connected with the measure carrier 340, the zero position of the pointer 361, therefore 0 volume, represents that position in which the plate surface 378 of plate 377 builds a flush joint with the end surface 305 of the measuring part 311. The pointer 361, therefore, can be easily adjusted to zero on the scale 362 or the vernier 363*b*. If the measuring rod 358 is pulled from its zero position completely downwards toward the stopper 360, thus the axial movement of the measuring rod 358 is limited by the stop face 374 of the slider 373 which enters into an interaction with the flat depression ground 369 of the base body 341. The volume of the measuring cavity 325 of the large measuring part 312 is exactly as big as the effective volume 320 of the measuring chamber 301 and thus contains 10.0 grain (0.648 GRAM).

In FIG. 3 furthermore a funnel piece 580 is represented, which is associable to each of the measuring-bodies 311 or 312 or to the base part 313 via the connecting path 123 and the logic node I. Hereto, the funnel piece 580 comprises a male thread 581 connectable with the female thread 302 of the measuring-bodies. The funnel piece 580 is provided at the forehead with a frontal surface 582, from which a centering collar 583 with a centering surface 584 is extending. The centering collar 583 is followed by an male thread 581 being undercut. The frontal surface 582 is interspersed by a funnel bow 585, which passes into a funnel cone 586 and is surrounded by a strengthening collar 587. The funnel bow 585 at the frontal surface 582 forms an opening 588 whose cross-sectional area corresponds to that of the measuring chamber 301. A contact collar 589 is associated to the male thread 581.

In the following, the socket group 400 being associable to the base part 313 via the connecting path 112 will be explained in reference to FIG. 4. Each of the sockets 410, 420, 430, 440 and 450 comprises a frontal surface 401 and, arranged perpendicular to it, a male thread 402, whereby a non-supporting section 403 is shaped between the frontal surface 401 and the male thread 402. On the side opposite to the frontal surface 401, an extension 404 is formed, which on the outside comprises two grooves 304 arranged opposite to each other, which the tenter tool 330 engages into. Within the extension 404 a female thread 405 with a relieve groove 408 is arranged, which has an identical pitch, screw thread diameter and angle of thread with respect to the male thread 402. Furthermore, an induction driving face 406 is associated to the female thread 405. Each of the sockets comprises a measuring cavity 411, 421, 431, 441, 451 in the form of a cylindrical bore, provided for the uptake of the substance 102. Each measuring cavity has a capacity of one or of an integer multiple of the effective volume 320, in this example 10.0, 20.0, 30.0, 40.0 and 50.0 grain, therefore WV*k with k=1 to n. Each socket 410, 420, 430, 440, 450 is connectable by its female thread 405 with every other by the male thread 402. Here, the induction driving face 406 gets into contact with the frontal surface 401, by which a spatially defined association of concerned sockets in relation to each other is created.

Each of the sockets 410, 420, 430, 440, 450 is connectable by its male thread 402, but also by the pick up female thread 321 of the base part 313, whereby the frontal surface 401 of the base part 313 is in adjacent contact with a plane surface 323 assigned to the pick up female thread 321 and effects in a spatial association. The secure adjunction of the sockets to one another or to the base part with the frontal surfaces 401 and the induction driving face 406 is guaranteed by the non-supporting section 403 adjacent to the male thread 402 of each socket.

Figure 4:
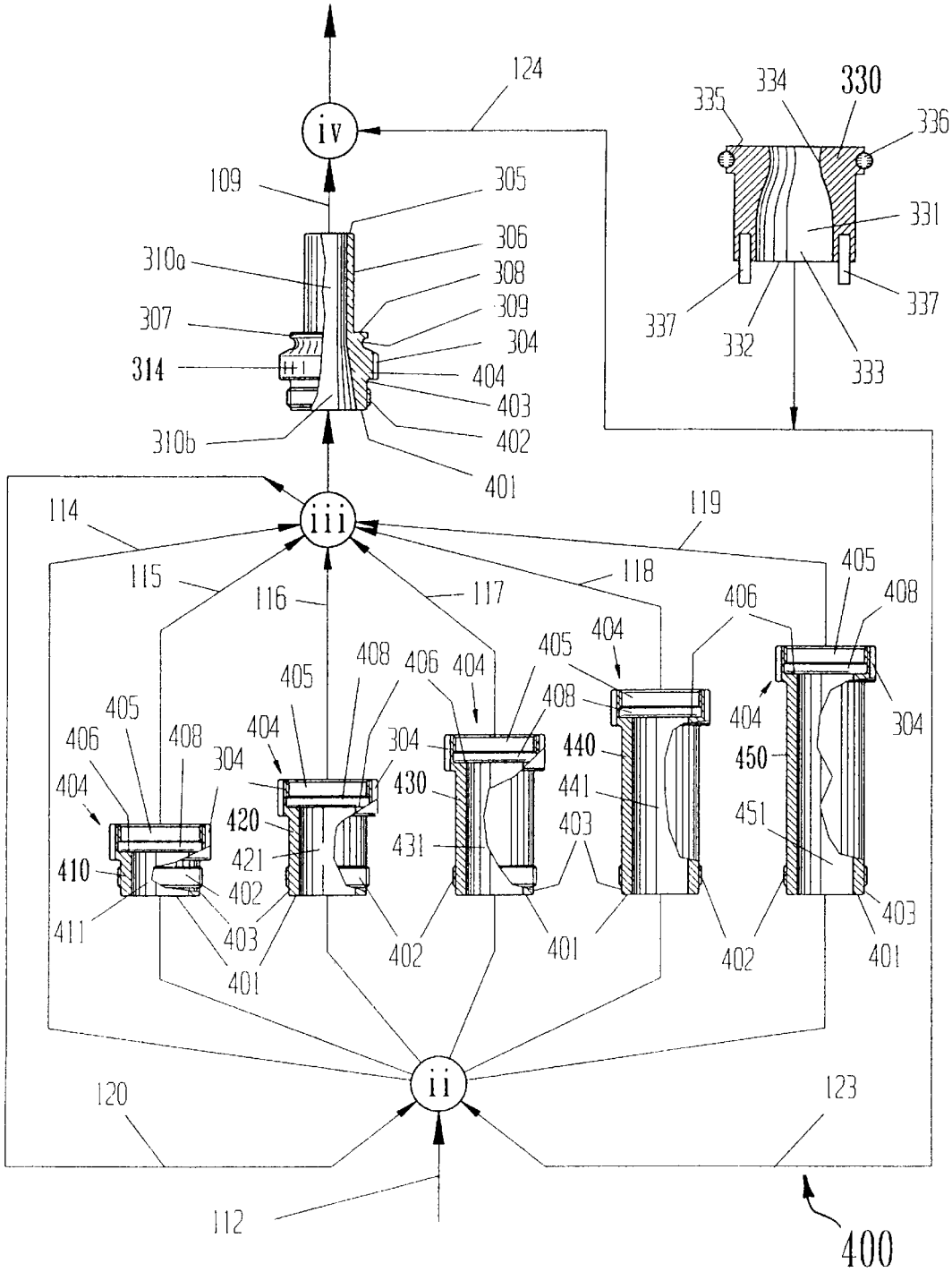

FIG. 4 shows the bung piece 314 which also comprises a frontal surface 401 and perpendicular to that a male thread, followed by an extension 404 to which the stop collar 307 with stop face 308 is molded. Like the measuring part 311 and the large measuring part 312, also the stop collar 307 is encircled by the surrounding annular groove 309. On the side opposite to the male thread 402 the bung piece 314 features the end surface 305 and in the direction to the stop collar 307 the association collar 306. Furthermore, the bung piece 314 is equipped with two cylindrical grooves 304 placed opposite to each other into which the tenter tool 330 engages. The bung piece 314 finally comprises a measuring cavity 310 consisting of a cylindrical section 310*a* and a conical section 310*b*. The volume of the cylindrical section 310*a* and that of the conical section 310*b* are comprising each a single effective volume 320, thus 10.0 grain (0.648 GRAM) each. Accordingly, the measuring cavity 310 of the bung piece contains 20.0 grain (1.296 GRAM) of the substance.

On all sockets, the thread 402 is arranged perpendicular to the frontal surface 401 and the female thread 405 perpendicular to the induction driving face 406 for the precise association of the sockets one another.

In FIG. 4 furthermore the tenter tool 330 is shown, which serves clamping and releasing the measuring-bodies 311, 312 and 313 to or from the base body 341, as well as the bung piece 314 to or from the base part 313 and for clamping and releasing the sockets between the base part 313 and the bung piece 314. For this purpose, the tenter tool 330 features a bore 331 which, beginning with a plane surface 332 first comprises a centering section 333, its contour blending into a tapered arch contour 334. In an external annular groove 335 or shaped as a polygon radial groove 390 with rounded corners 391 as describe before rests a polymeric ring 336 to warrant the clinging effect while clamping also with soiled hands. Tappets 337 are provided on the plane surface 332 which enter into operating connection with the grooves 304 of the measuring part 311, of the large measuring part 312, the base part 313, the bung piece 314 or of the sockets 410, 420, 430, 440, 450, when the tenter tool is positioned.

As shown in FIG. 2, the means of measuring 342 enables a accuracy of reading (unit imprint 363*a*, vernier 363*b*, digital display 363*c* of 0.1 grain (0.00648 GRAM) and indicates, for one revolution of the pointer 361, respectively one stroke of the measuring rod 358 10.0 grain (0.648 GRAM) on the scale 362 and/or the vernier 363*b*. As described, the effective volume 320 of the measuring chamber corresponds to 10.0 grain. Accordingly, the measuring chambers 301 of the measuring parts 311, 312 and the base part 313 each contain an amount of substance 102 of 10.0 grain (0.648 GRAM), whereby the large measuring part 312 has a measuring cavity 325 containing 10.0 grain (0.648 GRAM).

The measuring cavity 411 of the socket 410 contains 10.0 grain (0.648 GRAM), the measuring cavity 421 of the socket 420 20.0 grain (1.296 GRAM), the measuring cavity 431 of the socket 430 30.0 grain (1.944 GRAM), the measuring cavity 441 of the socket 440 40.0 grain (2.592 GRAM), the measuring cavity 451 of the socket 450 50.0 grain (3.240 GRAM) and the measuring cavity 310 of the bung piece 314 20.0 grain (1.296 GRAM).

In FIG. 5, a block diagram is shown for the adjustment of a nominal quantity SM to be preset on the arrangement 100. Based on the volume-related weight VG corresponding to the effective volume WV of the substance 102, the nominal quantity SM is divided into a partial quantity TM and a residual quantity RM according to the following rule:

$$TM=INT(SM/WV)*WV \tag{2}$$

and $$RM=SM-TM \tag{3}$$

Then, dependent on the result of TM and RM, happens the association of at least one of the measuring-bodies or of a combination of measuring-bodies to the base body 341 according to their measuring cavity or cavities via the logic nodes i to iv.

TABLE 1

| Measuring body | Quantity | Measuring cavity | Effective. vol |
|---|---|---|---|
| Measuring part 311 | 0–10 | Measuring chamber 301 | 1-fold |
| Measuring part 312 | 10–20 | Measuring chamber 301 + Measuring cavity 325 | 2-fold |
| Base part 313 | 0–10 | Measuring chamber 301 | 1-fold |
| Bung piece | 20 | Measuring cavity 310 | 2-fold |
| Socket 410 | 10 | Measuring cavity 411 | 1-fold |
| Socket 420 | 20 | Measuring cavity 421 | 2-fold |
| Socket 430 | 30 | Measuring cavity 431 | 3-fold |
| Socket 440 | 40 | Measuring cavity 441 | 4-fold |
| Socket 450 | 50 | Measuring cavity 451 | 5-fold |

The available measuring cavities are shown in table 1. The desired nominal quantity related selection of the measuring parts is described in table 2. If only 4 sockets, thus 410, 420, 430, 440 are to be used, the desired nominal quantity-related association is readable from table 4.

TABLE 2

| Quantity [grain] | Measuring cavity | Measuring part 311 0–1-fold | Large measuring part 312 0 to 1 + 1-fold |
|---|---|---|---|
| 0.0–10.0 | | x | |
| 10.0–20.0 | | | x |

TABLE 3

| | | Base part | Socket | | | | | Bung piece |
|---|---|---|---|---|---|---|---|---|
| Quantity [grain] | Meas. cavity | 313 0–1* | 410 1* | 420 2* | 430 3* | 440 4* | 450 5* | 314 2* |
| 20–30 | | x | | | | | | x |
| 30–40 | | x | x | | | | | x |
| 40–50 | | x | | x | | | | x |
| 50–80 | | x | | | x | | | x |
| 60–70 | | x | | | | x | | x |
| 70–80 | | x | | | | | x | x |
| 80–90 | | x | x | | | | x | x |
| 90–100 | | x | | x | | | x | x |
| 100–110 | | x | | | x | | x | x |

TABLE 3-continued

| | | Base part | Socket | | | | | Bung piece |
|---|---|---|---|---|---|---|---|---|
| Quantity [grain] | Meas. cavity | 313 0–1* | 410 1* | 420 2* | 430 3* | 440 4* | 450 5* | 314 2* |
| 110–120 | | x | | | | x | x | x |
| 120–130 | | x | x | | | x | x | x |
| 130–140 | | x | | x | | x | x | x |
| 140–150 | | x | | | x | x | x | x |
| 150–160 | | x | x | | x | x | x | x |
| 160–170 | | x | | x | x | x | x | x |
| 170–180 | | x | x | x | x | x | x | x |

*k-fold of the effective volume WV

TABLE 4

| | | Base part | Socket | | | | Bung piece |
|---|---|---|---|---|---|---|---|
| Quantity [grain] | Meas. cavity | 313 0–1* | 410 1* | 420 2* | 430 3* | 440 4* | 314 2* |
| 20–30 | | x | | | | | x |
| 30–40 | | x | x | | | | x |
| 40–50 | | x | | x | | | x |
| 50–60 | | x | | | x | | x |
| 60–70 | | x | | | | x | x |
| 70–80 | | x | x | | | x | x |
| 80–90 | | x | | x | | x | x |
| 90–100 | | x | | | x | x | x |
| 100–110 | | x | x | | x | x | x |
| 110–120 | | x | | x | x | x | x |
| 120–130 | | x | x | x | x | x | x |

*k-fold of the effective volume WV

These are, like the measuring part 312, designable as a one-piece module or as sockets or as a measure of capacity, whereby the measuring cavity 325 then is smaller by one effective volume 320, namely that of the measuring chamber 301 of the measuring part 312. In order to cover measuring ranges other than in steps of an integer multiple, the cavity may also comprise a different capacity. However, the decimal increment is to be handled particularly easily and safely. If a range of 5 to 15 grain, 15 to 25 grain etc. is required, a measuring cavity 325 is to be associated to the measuring chamber 301 which on the measuring part 311 and on the base part 313. amounts to 5.0 grain and on the large measuring part 312 to 15.0 grain. Following are some examples for the explanation of the use of the described dosing unit 300:

EXAMPLE 1

If as a nominal quantity SM 7.0 grain is assumed, the previous equation (2) provides for TM=0 and for RM=7.0 from (3). If the value of the partial quantity is TM=0, only the association of the measuring part 311 via the connecting path 106 to the measure carrier 340 is required. The residual quantity RM is to be adjusted via the measuring chamber 301 by releasing the locking device 343 and shifting the measuring rod 358 with the stopper 360, until the pointer 361 or the vernier 363*b* indicates 7.0 grain on the scale 362. The measuring rod 358 is then fixed again with the locking device 343 by twisting the tension screw 386.

EXAMPLE 2

If SM 17.0 grain is desired as a nominal quantity, thus according to (2) follows for TM=10 grain and according to (3) for RM=7.0 grain. This is still within the range of the large measuring part 312 being associable to the measure carrier 340 via the connecting path 108, since the entire volume of the large measuring part 312 consists of the measuring chamber 301 containing maximum of 10.0 grain and of the measuring cavity 325 representing one effective volume WV of 10.0 grain and the large measuring part 312 thus contains up a maximum of 20 grain.

EXAMPLE 3

Assuming as nominal quantity SM 27.0 grain, (2) leads to TM=20 grain and (3) to RM=7 grain. The nominal quantity SM is now larger than the volume capacity of the measuring parts 311 or 312. In this case, there is via the connecting path 110 to the measure carrier 340 the base part 313 associable, to which the bung piece 314 is associable via the connecting path 112 to the logic node and directly via the connecting path 114 to the logic node iii via the connecting path 121, and the residual quantity RM in the amount of 7.0 grain is again adjustable via the measuring chamber 301.

EXAMPLE 4

Figure 5A:
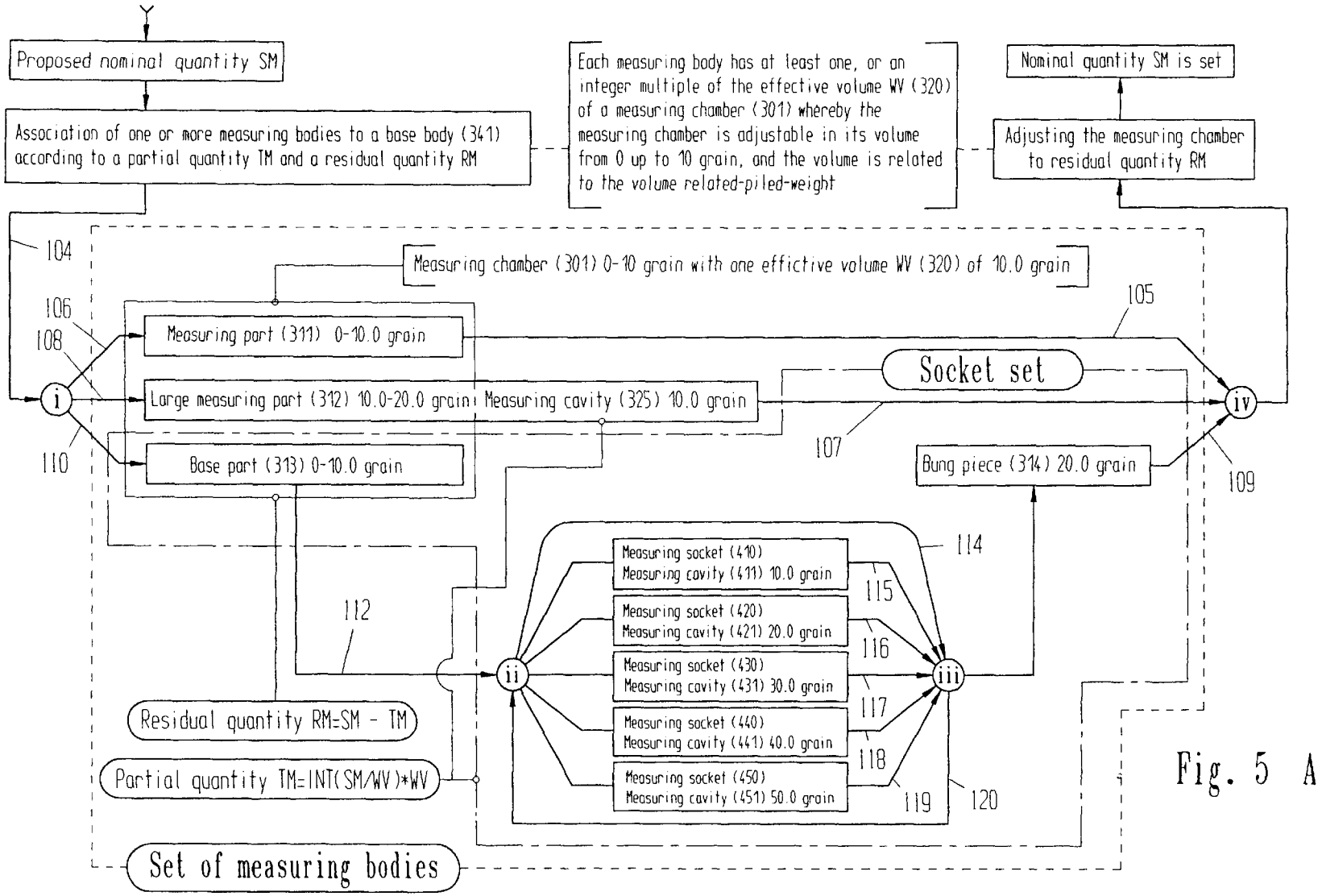
Figure 5B:
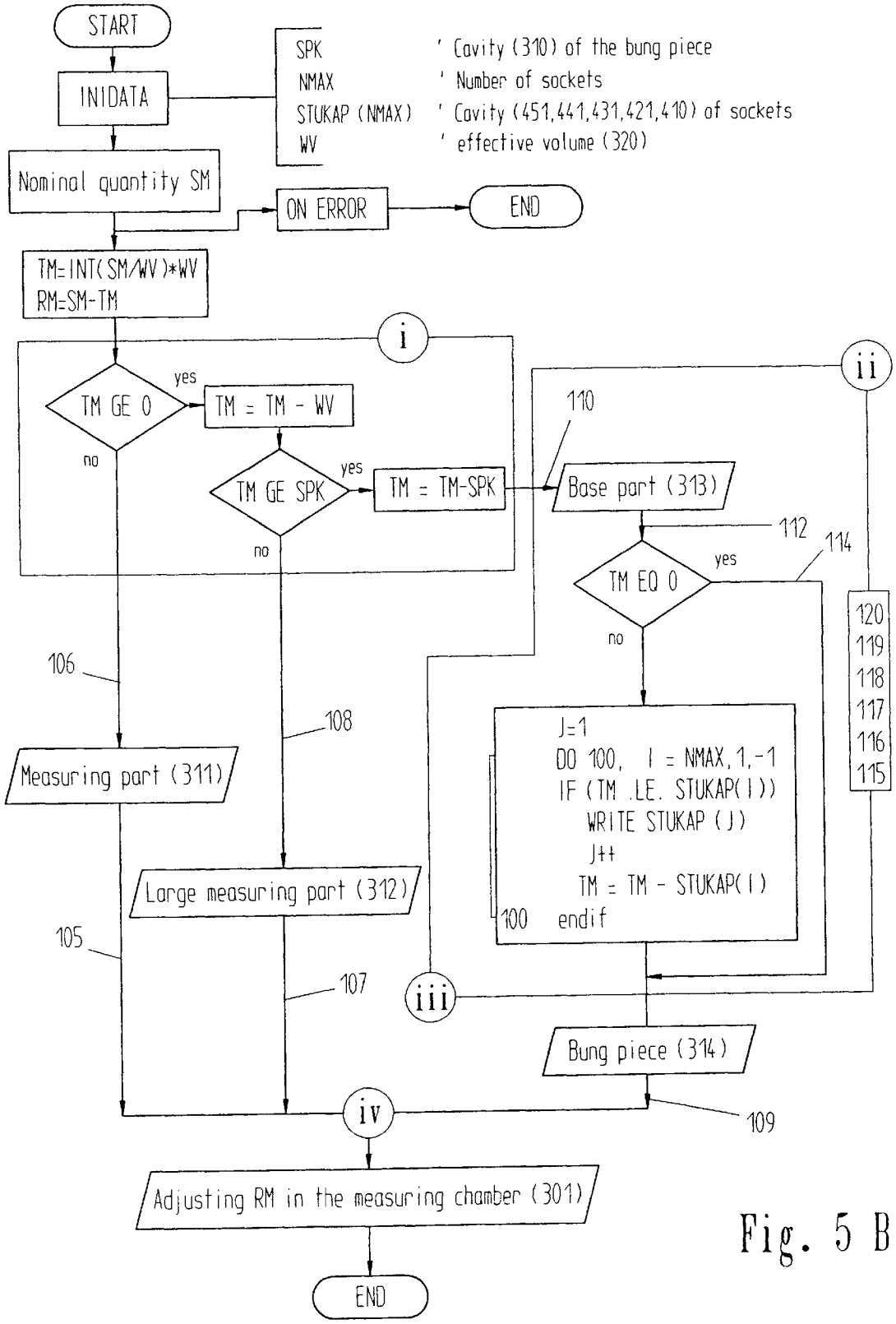

Assuming a nominal quantity of SM 96.5 grain, from (2) follows for TM=90 grain and from (3) for RM=6.5 grain. FIG. 5A and FIG. 5B show a block diagram for determination of the combination of measuring-bodies, depending on the partial quantity TM and on the residual quantity RM. In the case the maximum volume capacity is exceeded or if SM<0.0, a fault report occurs. After initialization of the input data, namely of the bung socket's cavity 310 (SPK), the number of sockets (NMAX), a vector STUKAP (NMAX) with the capacities of the sockets in descending order and the specification of the effective volume WV, the partial quantity TM and the residual quantity RM are determined according to equations (2) and (3). If the partial quantity TM is larger or equal 0, an effective volume 320 (WV) is subtracted from the partial quantity TM. In case the partial quantity TM is larger or equal to the measuring cavity 310 of the bung piece 314 (SPK), this (SPK) is subtracted from the partial quantity TM and the base part 313 is to be associated to the measure carrier 340 via the connecting paths 104 and 106. If the partial quantity were TM=0, the bung piece 314 would be connected with the base part 313 via the connecting path 114. If this condition is not fulfilled, the order is determined in a preferentially descending loop by the number (NMAX) of available sockets to which they are to be combined via the connecting paths 120 to 115. In this example, these are sockets 450, 430. Subsequently, the bung piece 314 is detached from the base part 313 with the tenter tool 330 at logic node ii and the socket 450 is connected with the base part 313, to which the socket 450 and to this the socket 420 via the connecting path 120, and to this the bung piece 314 is associated. Finally, the residual quantity RM and volume of 6.5 grain is to be adjusted on the measuring chamber 301.

Figure 6:
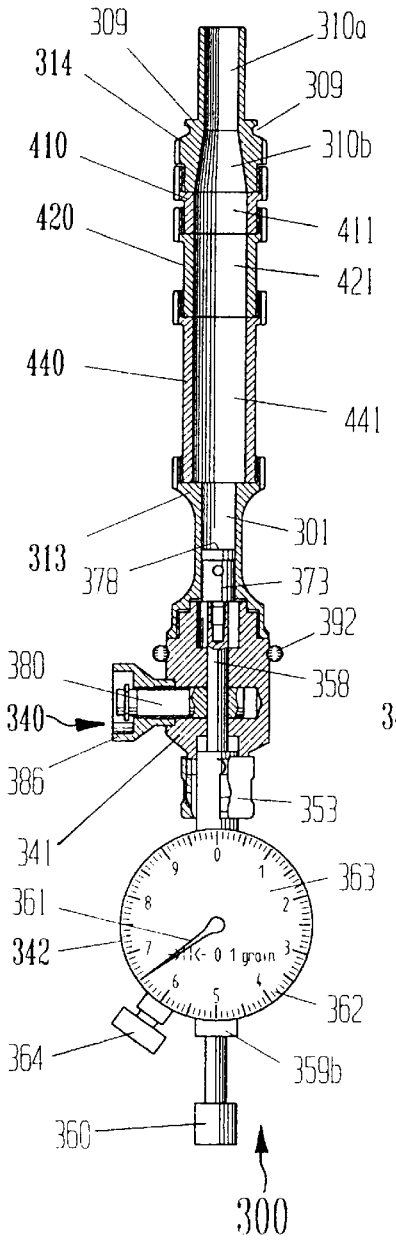
Figure 8:
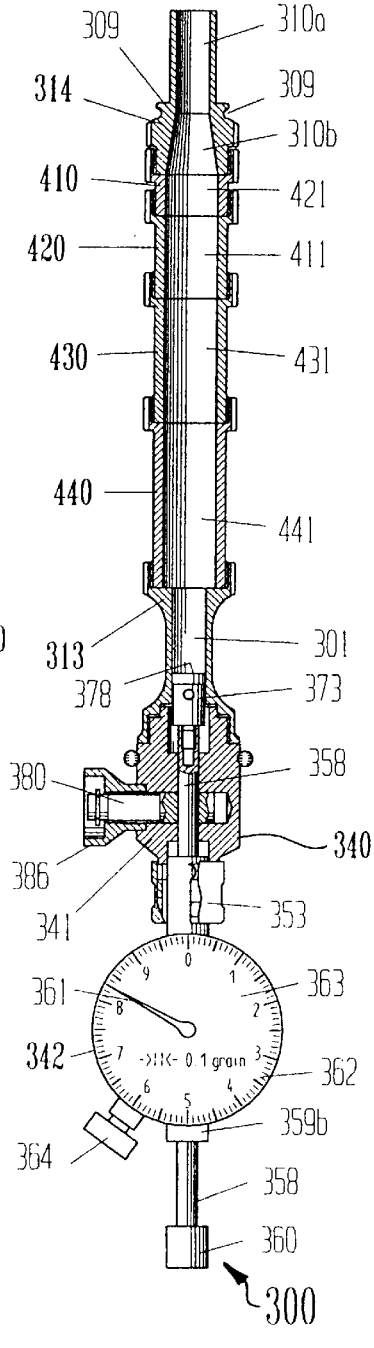

The FIGS. 6 and 8 show further examples of the dosing unit 300 equipped with sockets.

In FIG. 6 is a measure carrier 340 shown, to which a base part 313 is associated. To the base part 313 again the socket 440 is associated, to this the socket 420 and to this again the socket 410, and to the latter the bung piece 314 each via the threads 321, 402 and 405.

The measuring cavities consequently add up, associated by the socket group 400 and the bung piece 314, to one partial quantity TM as follows:

| | | | |
|---|---|---|---|
| | | | the sockets 410 and 420 |
| + socket 410 | 10 grain | <-- | would be replaceable by socket 430 |
| + socket 420 | 20 grain | <-- | (measuring cavity 30 grain) also |
| + socket 440 | 40 grain | | |
| Σ socket | 70 grain | | |
| + bung piece 314 | 20 grain | | |
| partial quantity TM | 90 grain | | (5.832 Gram) |

As becomes clear from FIG. 6, the means of measuring 342 is assembled by means of the lock nut 353 in the base body 341 of the measure carrier 340 and the scale 362, as described on the measuring chamber 301, adjusted with the clamping device 364 in a zero position. Furthermore, the measuring rod 358 is pulled down on its stopper 360 in the guide 359b. The slider 373 attached to the measuring rod 358 being longitudinally adjustable in the measuring chamber 301 correspondingly reaches far into the measuring chamber 301. By means of the pointer 361, the residual quantity RM is adjusted in the measuring chamber 301 by the slider 373 with the plate surface 378 to 6.5 grain. Accordingly, the volume of the measuring chamber 301 is such that it takes a residual quantity RM of the substance 102 corresponding to 6.5 grain.

Therefore, the dosing unit 300 is measured to a portioned amount 103 of the substance 102 of 96.5 grain (6.253 GRAM) total as a nominal quantity SM.

Figure 7:
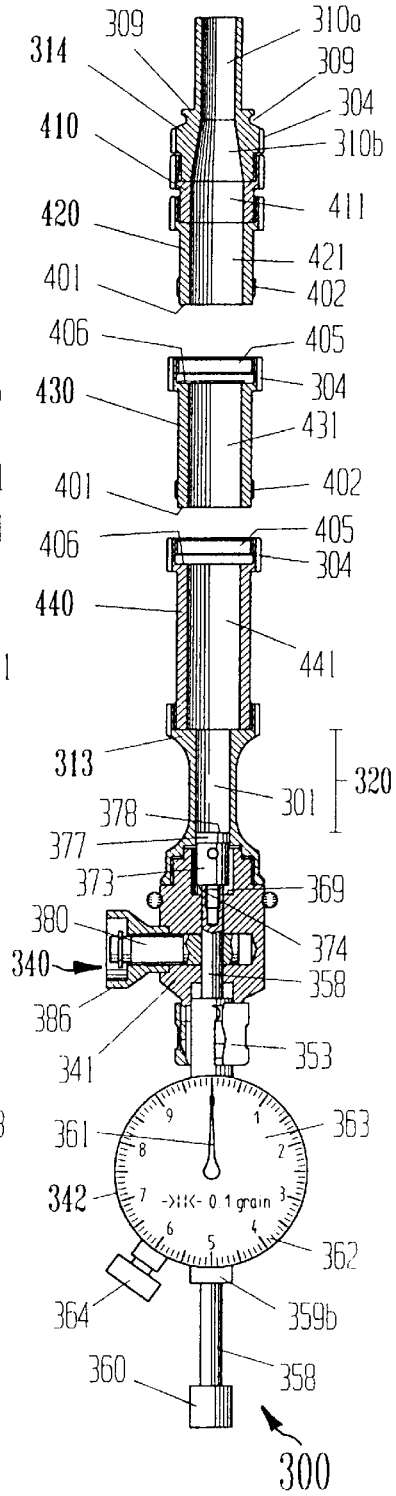

In FIGS. 7 and 8, the procedure of how the dosing unit 300, and the measuring chamber 301 are to be adjusted to another nominal quantity SM of the pourable substance 102 is shown schematically. Based on the adjustment to 96.5 grain currently described, it is assumed in this example that the desired, new nominal quantity SM should amount to 128.3 grain (8.3137 GRAM). Furthermore, FIG. 7 shows the maximum adjustment of the measuring chamber 301 to the effective volume 320 (WV=10 grain).

In FIG. 7, it is clearly visible that the slider 373 with its plate 377 closes off the measuring chamber 301 at the bottom. If the slider 373 is pulled further with the measuring rod 358, the slider 373 runs aground with its stop face 374 on the depression ground 369 of the measure carrier 340, whereby the measuring chamber 301 remains sealed on account of pourable material towards the depression 368 by the plate 377.

The definition of the partial quantity TM to be adjusted via the socket group 400 is determined in that the numerical value of the nominal quantity SM in accordance with the measuring range of the means of measuring 342 is set at 0, both on the unit digit and the decimal digit, according to (2). Therefore, the appropriate value results to 120 grain. Accordingly, merely the supplementation of the quantity of 70 grain already adjusted with the sockets by additional 30 grain up to 100 grain with the socket 430 is required. In order to adjust the partial quantity TM as precisely as possible, the socket 430 is to be placed between the sockets 420 and 440 by the threads 402 and 405, so that the frontal surfaces 401 spatially fixate the sockets with the induction driving face 406 to each other. The tenter tool 330 described before is of helpful service in this if it is geared with its tappets 337 into the grooves 304 of the socket group 400 or of the measuring parts 311 and 312.

The stepped arrangement of the sockets equalizes manufacturing tolerances as the increasing lengths of the sockets is nevertheless to be met relative precisely and thus the total tolerance of the quantity 103 to be dimensioned can be maintained precisely. Insofar as normal demands on accuracy are applied in accordance with the unit imprint 363*a*, a mixed arrangement is justifiable.

As shown in FIG. 8 the measuring chamber 301 is adjusted to the residual quantity RM of 8.3 grain and the dosing unit 300 thus prepared for the further use with the container 200 for dimensioning a nominal quantity SM of 128.3 grain and can be gently deposited by the means of absorption 392 onto a table or the like.

Figure 9A:
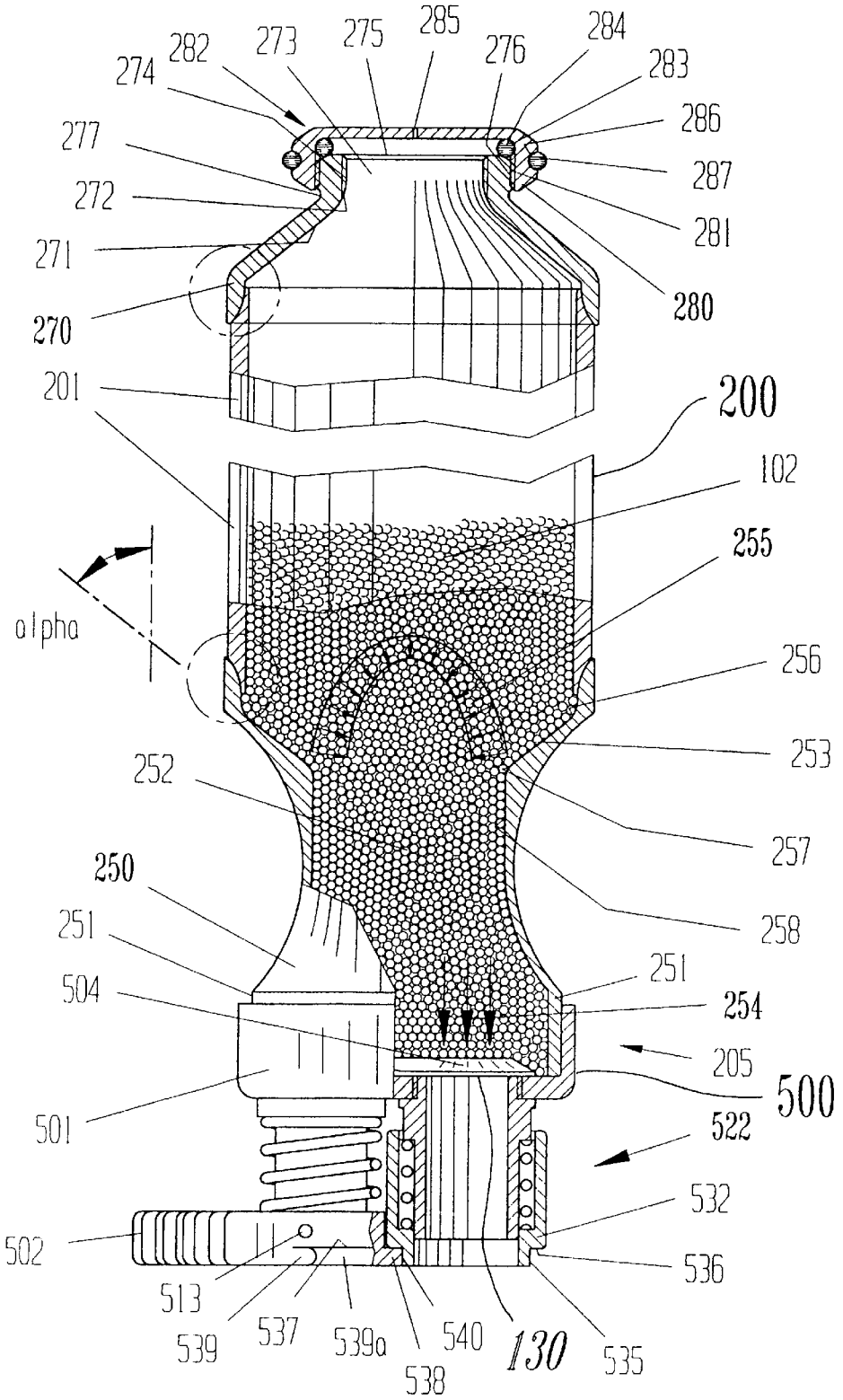

FIG. 9 A shows the container 200 with a closure 500 in a closed position 130. At a transparent container body 201, a head-part 250 is fixed comprising a hollow internal area 252, which closes off the container 200 towards the outlet side 205. The head-part 250 comprises an uptake 251 to which a closure 500 is attached. The closure 500 is actuable with a means of actuating 502 by which a closure piece 504 is swivable. The closure piece 504 is shown in a closed position 130 in which it is preventing the substance 102 from exiting from the internal area 252.

At the end of the container body 201 opposite to the head-part 250, it is connected with a bottom-part 270, which inside has a funnel-shaped form. As viewed from container body 201 a funnel-shaped section 271 passes into a convex cone bow 272 which blends into an opening 273. The opening 273 is interspersed by a female thread 274 into which the funnel piece 580 is screwable. A plane surface 275 is associated to the female thread 274, onto which the contact collar 589 of the funnel piece 580 fits in the fixed state. To the plane surface 275 a male thread 276 is assigned to which a lid 280 is in engagement with its female thread 281. At the end of the male thread 276 opposite to the plane surface 275, the bottom-part 270 comprises a throat 277. At the interior end 282 of the female thread 281 of the lid 280, a groove 283 with a radial cross-section is arranged, in which an elastic sealing medium 284 in the form of an O-ring is embedded. On the other side, the sealing medium 284 fits sealantly to the plane surface 275. A small ventilation bore 285 is placed centrically, which is smaller than the smallest occurring grain size of the substance 102. Outside the lid 280 is comprising a surrounding groove 286 with a radial cross-section, in which at least one tappet in the form of an O-ring 287 rests at light initial tension as screwing aid. In particular at muzzleloaders, missiles are to be lubricated during the loading process by the shooter. Accordingly, grease traces easily remain on the hands, which complicates the handling. This screwing aid can also be designed as a band, vulcanized or bonded onto.

Figure 9B:
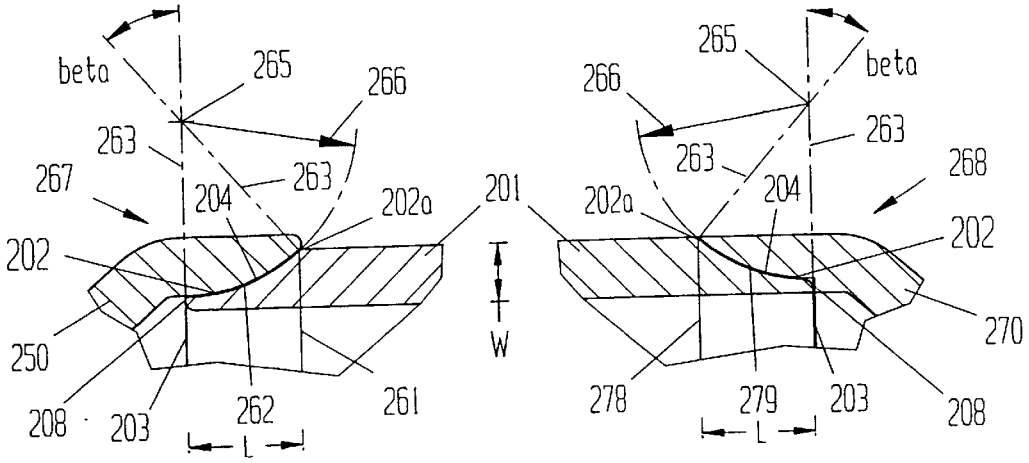

In FIG. 9B, the fastening of the container body 201 with the head-part 250 and the bottom-part 270 in the form of an adhesive-joint 202 is shown. The container body 201 consists of polycarbonate (PC), shockproof safety glass or similar, each with a normal anti-static coating. The head-part 250 and the bottom-part 270 preferably consist of metal or an impact-resistant plastic, whereby the design of the sides each turned towards the container body 201 is identical. The parts are connected with each other by means of a structure-adhesive. Thus, it is furthermore generally spoken of an adhesive-joint 202 of a component 250, 270 with another component 201.

The one component 250, 270 is comprising along a surrounding rim 261 and 278 one half of an inwards directed convex circle segment 262 and 279 of a secant half length L with a radius 266. The other component 201 is comprising along a surrounding rim 203 (front end) each a half of a concave circle segment 204 of also a secant half length L, whereby the both circle segments 204, 262 and 279 have a form congruent to each other. The circle segments 204, 262 and 279 are comprising surface normals 263 which each intersect at an intersection point and form the geometrical center point location 265 of the circle segments 204, 262 as well as 279. The circle segments 204, 262 as well as 279 are entering the surrounding rim 203 of the other component 201 perpendicular to it running along one sector half angle beta.

At the rim 203 remains a web 208, which in dependency of the radius 265 and a coefficient of correction Kx follows the equation $$\text{Web}=(\text{Sqrt}\ (\text{Radius}^2-L^2)+W)*Kx \quad (4)$$

whereby the coefficient of correction Kx is in range of 0.5 to 0.01 and depends on the strength of the container body 201 of both parts 260, 270 and of the used structure-adhesive. Adhesive-joints are subject to many parameters. Therefore, a universally valid dimensioning cannot be specified. For experiments at a wall-thickness W of about 2 mm, the following initial values are suitable; sector-half angle beta about 43°, radius 265 about 6 mm, secant-half length L about 4 mm and Kx about 0.04. The adhesive-joint 202 is made between the congruent circle segments 204 and 262 with the structure-adhesive. A gluing gap 202*a* is to be provided in accordance with the guidelines of the applied structure-adhesive.

Figure 9C:
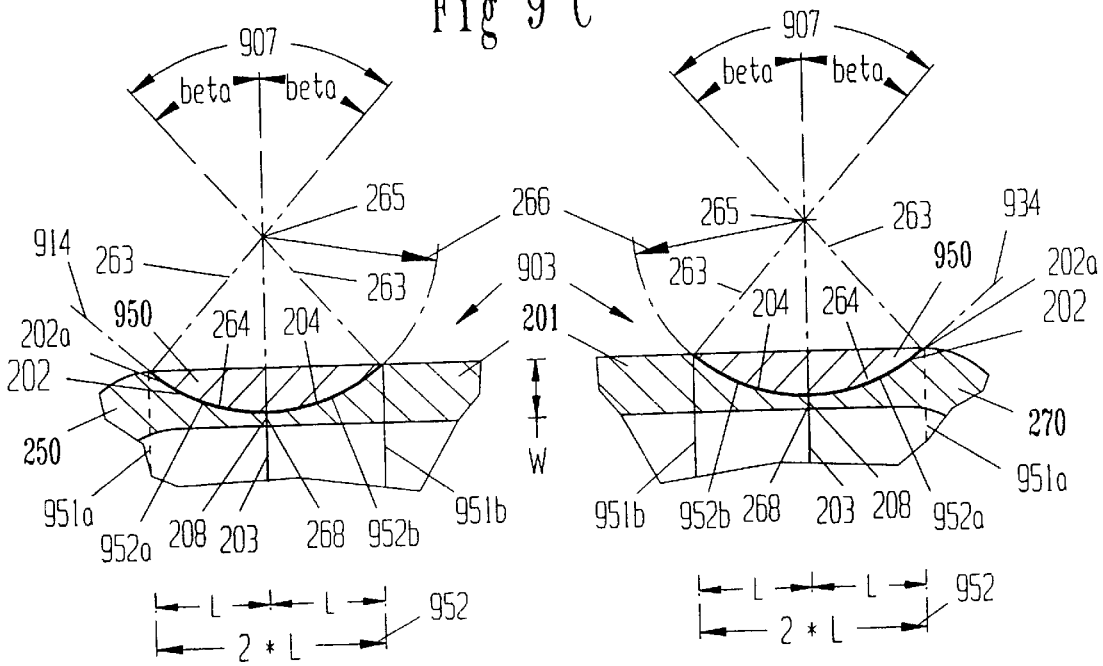

In the left half of FIG. 9B the head-part is shown with a clincher 267 and in the right half with a plane passage 268 from the container body 201 onto the bottom-part 270. The clincher 267 offers intensified protection of the adhesive-joint. FIG. 9C shows a design of the adhesive-joint 202 with a connection element in the form of a circle segment ring 950.

The components 250, 201 as well as 270 are comprising each along a surrounding rim 203 (front end) halves of the concave circle segment 204, 264 turned towards each other with each having one secant-half length L, which together form a radial surrounding groove 903 with the cross-section of a symmetric-convex circle segment 904.

The circle segments 204, 264 are each comprising surface normals 263 which jointly intersects at an intersection point 265 and form the geometrical center point location of the circle segments. The surface normals 263 each stand vertically at the circle tangents 914 of the circle segments.

The concave circle segments 204, 264 entering each perpendicular at the surrounding rim 203 and follow each an angle section beta with a radius 266 up to an edge 951 a, 951 b respectively. That's how a secant-half length L results, extending each from the surrounding rim 203 up to the edge 951*a* and from the rim 208 up to the edge 951*b*. Both concave circle segments 204, 264 form the radially surrounding groove 903. The circle segment ring 950 is arranged in the groove 903, which extends itself over a central angle 907 of 2 * beta from the edge 951*a* up to the edge 951*b* and comprises a convex circle segment 952 congruent to the circle segments 204, 264. The circle segment 950 is developed in an endless ring-shape and glued together in the groove 903 with the concave circle segments 204, 264 of the components 250, 270 with a structure-adhesive.

Both embodiments have in common, that the adhesive-joint constituted in circle-segment-shape surprisingly increases the stability under load of the adhesive-joint durably by a relatively constant flux of force from the one to the other component. Furthermore, it is protected against blows. At electrostatically critical uses, nodular graphite or other electrically conducting materials are to be added to the structure-adhesive without considerable suffering of the strength of the adhesive-joint. As is still to be shown, the head-part 250, the container body 201 and the bottom-part 270 may also be developed as a one-piece body.

The FIGS. 9D to 9G show the container 200 with set-up lid 280 and the closure 500 in different views.

Figure 10A:
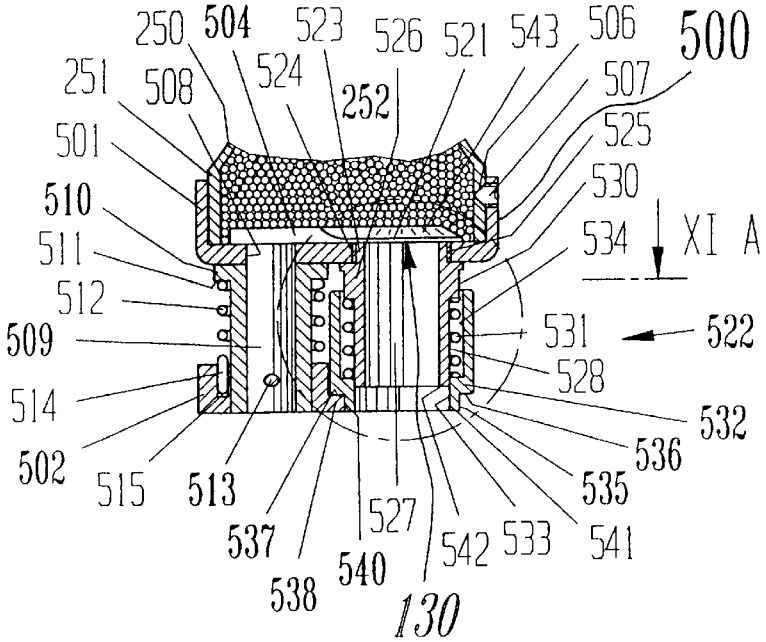
Figure 11A:
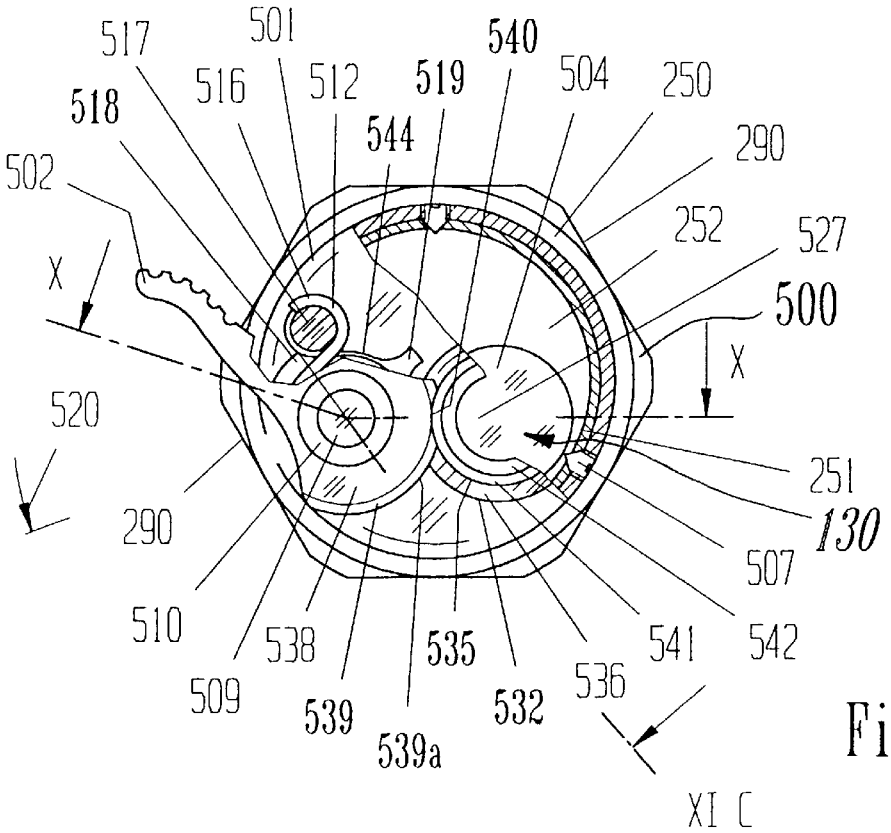

In FIG. 10A the closure 500 is shown in cross-section, whereby the line of cut XI A from FIG. 10A indicates the partially broken up view of FIG. 11A. In FIG. 10A mooring surfaces 290 associated to the head-part 250 are visible. They preclude an unintentional rolling away of the container 200 laid down onto a table surface or the like for reasons of accident prevention.

The closure 500 is developed as a closure cap 501, which surrounds the uptake 251 of the head-part 250 of the container 200 and is fixable by means of a fixing means in the form of a stud screw 507 engaging into a depression 506.

The closure cap 501 is interspersed by a closure piece pin 509 swivably borne in a bearing bore 508 being part of a closure piece 504 or firmly fixed with it. The closure piece pin 509 penetrates a radial stop 510 outside of the internal area 252. The radial stop comprises a spring-seat 511 on which a spring unit is fitted in the form of a torsion spring 512 which is limited on the other side by the means of actuating 502. The means of actuating 502 stands in form-fittingly connection with the closure piece pin 509 and the radial stop 510 via a means of joining in the form of a connecting pin 513. The torsion spring 512 comprises a tappet pin 514 which rests in a tappet bore 515 of the means of actuating 502. At the closure piece 504 surrounds a sweeping lip 521 which serves to seal the internal area 252. The sweeping lip 521 passes into a sweeping chamfer 543 in the direction of the side facing the inside area 252. The closure 500 is with the closure cap 501 also connectable to a conventional powder flask.

As is shown especially in FIGS. 10A, 10B, 11A and 12, the torsion spring 512 comprises at the side facing the spring-seat 511 a spring eye 516 partially surrounding a spring pin 517, which is connected firmly with the closure cap 501 and thus holding the torsion spring 512 at an initial tension. The radial stop 510 comprises a stop 518 and an end stop 519. The stop 518 rests against the spring pin 517, whereby the closure piece 504 is resting in a position hindering the substance 102 from exiting, which is furthermore referred to as closed position 130.

Figure 10B:
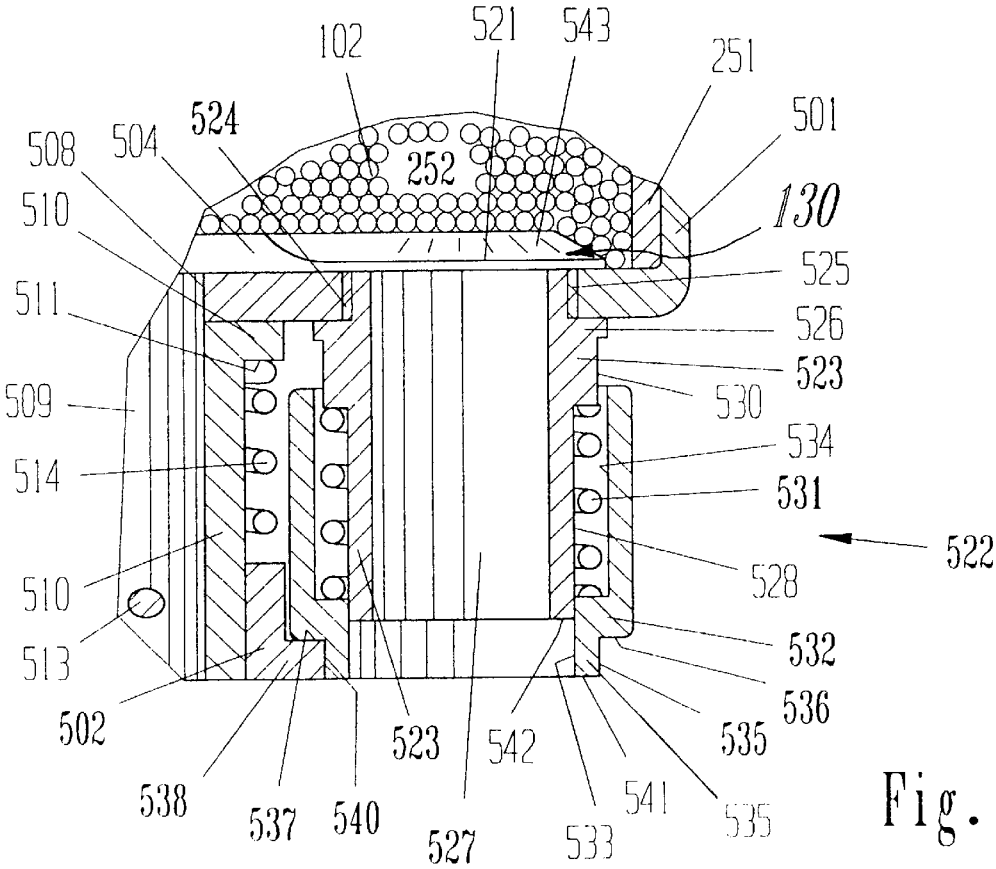

The closure cap 501, as shown enlarged in FIG. 10B is equipped with a means of association 522 being axially and radially effective. The means of association constitutes a centering body 523 with a connecting means in the form of a male thread 524 which engages into a female thread 525 penetrating the closure cap 501. The centering body 523 comprises a collar 526 serving the support to the closure cap 501 and defines an axial association to the closure piece 504. The centering body 523 is interspersed by a continuous opening 527. The centering body 523 frontally comprises at the side opposite to the male thread 524 a longitudinal stop 542 and outside a recessing guide surface 528, as is clearly to be seen from FIG. 10B. The centering body 523 is encircled by a pressure spring 531, which is in interaction with a means of locking 532.

Figure 11B:
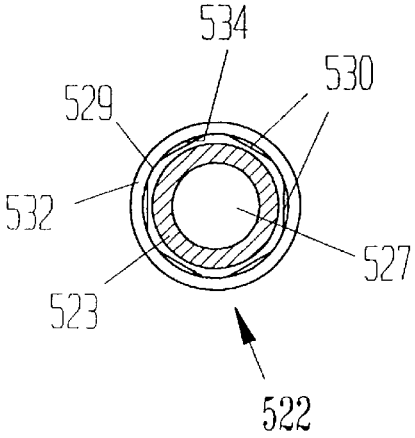

The collar 526, as is particularly shown in FIG. 11B, is equipped with a radial guide surface 529, whereby this guide surface 529 is broken up by several key surfaces 530 placed symmetrically to each other. These support the engagement of a normal assembling tool in t he form of a flat wrench.

As shown in FIGS. 10A, 10B, 11A, 15 and 16, the locking mechanism 532 comprises a first inner bearing surface 533 which is in interaction with the recessing guide surface 528 of the centering body 523 and furthermore a second inner bearing surface 534, which is in interaction with the further guide surface 529 (FIG. 11B) of the centering body 523, so that the locking mechanism 532 is axially jam-free guided movably against the pressure of the pressure spring 531. The locking mechanism 532 comprises a notch collar 535 and perpendicular to it a notch surface 536. The notch collar 535 is outwards bordered by a pressure surface 541, whereby the radial expansion of the pressure surface 541 is not greater than that of the second inner bearing surface 534, by which a jam-free guidance of the locking mechanism 532 is effected.

In the closed position 130, the locking mechanism 532 is under initial tension via the pressure spring 531 and resting with the notch surface 536 at a stop face 537 of a locking notch 538 which partially surrounds the actuating means 502 radially. At the actuating means 502 a radial recess 540 is arranged in such way that the notch collar 535 of the locking mechanism 532 in closed position 130 latchingly enters into it, as it is especially to be seen from FIGS. 10B and 11A. That way the closure is locked via the actuating means 502 and not releasable without the dosing unit, as yet will be described later.

Figure 11C:
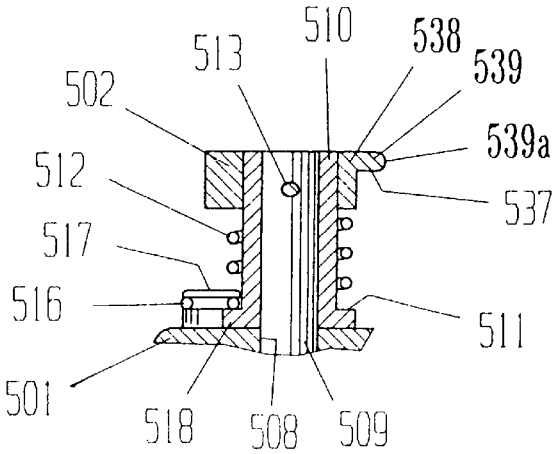

As shown in FIG. 11C, the locking mechanism notch 538 is directly neighbored by a holding mechanism 539 in the form of a convex locking element 539*a*, whereby the holding mechanism 539 is radially arranged at the actuating means and surrounding it radially, at minimum over a swiveling range 544 extending from the stop 518 to the end stop 519.

As shown in FIG. 11C, the locking means's notch 538 is directly neighbored by a means of holding 539 in the form of a convex locking element 539a, whereby the means of holding 539 is radially arranged at the means of actuating and surrounding it radially, at minimum over a swiveling range 544 extending from the stop 518 to the end stop 519.

As is to be seen from FIGS. 9A, 12, 13 and 14, the head-part 250 comprises on the side facing towards to the container body 201 a tapered off section 253 with an essentially truncated, cone-shaped form, whose angle of inclination (alpha) is about between 25° and 75°. The concerned angle (alpha) essentially depends on the properties of the substance and is easily determinable by experiments. When using globular substances 102, a range of about 35° to 60° is particularly suitable. It will come unexpected to the person skilled in the art that this kind of embodiment is generating a relatively consistent filling pressure 254 independent of the level of container 200. In the tapered off section 253, a inwards directed, dome-shaped field of lateral force 255 constitutes, which performs an equalizing throttle effect on the filling pressure 254 acting in the region of the closure piece 504, when the container 200 is set downwards with the closure 500. Simultaneously, the field of lateral force causes that clots are broken up on account of the shearingly effecting lateral forces.

If the container 200 is completely filled with substance 102, the throttle effect is high. Relative to a removal of substance 102, the throttle effect decreases whereby, however, the filling pressure 254 active onto the closure piece 504 remains to a large extent constant. The ratio of the cross-sectional area of the entrance cross-section 256 to outlet cross-section 257 of the tapered off section 253 is less than about 50 over 1, since otherwise the field of lateral force 255 would increasingly hinder the continuing flow of the substance in the container 200. Also, the ability to break up clots is usually decreasing considerably with an increasing ratio. Since the specific behavior depends on the particular properties of the substance 102, the given ratio is to be considered only as an approximate value. With black powder, the ratio of the cross-sectional area of the entrance cross-section 256 to the outlet cross-section 257 is, depending on the grain size, between about 1.4 and 40.

The outlet cross-section 257 of the section 253 is followed by a portion with constant cross-section 258 which, in the direction of the closure piece 504, finally passes into an expanding section 259. The dimensioning of the expansion of the internal area 252 depends on the maximum quantity 103 to be taken from the dosing unit 200 and on the flow properties of the substance. As an initial value for experiments, the one and a half, up to a double of quantity 103 to be taken is suitable.

Figure 12:
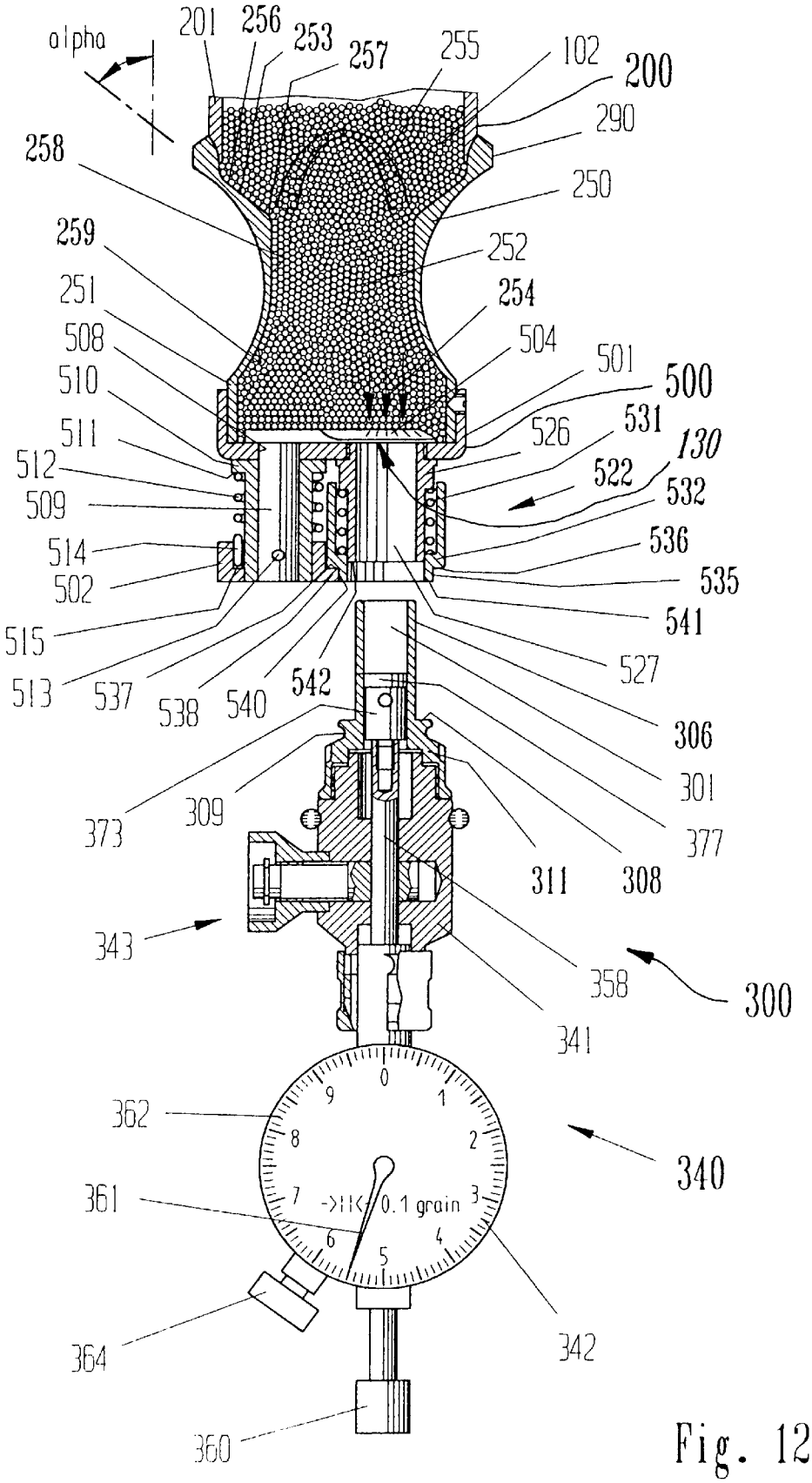

In FIG. 12 the association of the dosing unit 300 to the partially depicted container 200 at the logic node iv is shown. The container 200 is arranged downwards with its closure 500 being in closed position 130. The means of locking 532 is latched in the recess 540 by the notch collar 535, the means of actuating 502 and the opening 527 are still closed by the closure piece 504. The shown dosing unit 300 consists of the measure carrier 340 to which the measuring part 311 is associated. The measuring chamber 301 is adjusted by means of the slider 373 with the measuring rod 358 and the pointer 361 to a nominal quantity SM of 5.5 grain (0.3564 GRAM) on the scale 362. The measuring rod 358 is fixed by means of a locking device 343 in the base body 341. The dosing unit 300 is brought with the association collar 306 near to the opening 527 of the means of association 522.

Figure 13:
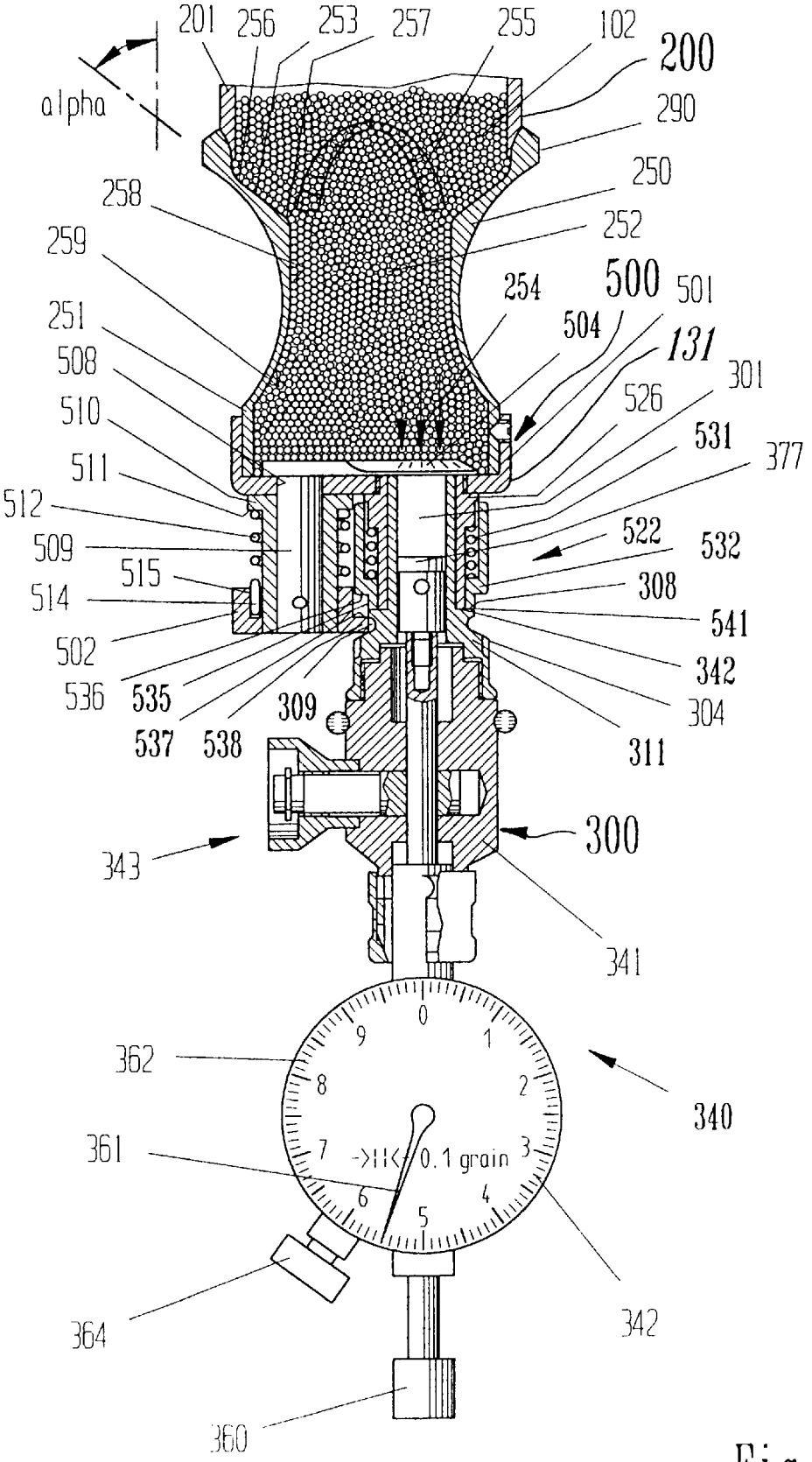

The FIG. 13 shows the container 200 with the closure 500 and the dosing unit 300 being completely inserted into the opening 527 with the association collar 306. At insertion, the stop face 308 first enters into interaction with the pressure surface 541, whereby the means of locking 532 is shifted axially against the pressure of the pressure spring 531 until the stop face 308 gets into contact with the longitudinal stop 542 and a filling position 131 is reached. The closure piece 504 is hereby not yet open.

Only after reaching the filling position 131, the notch collar 535 is completely moved from the radial recess 540 and the means of actuating 502 is operable. While moving the means of actuating 502, the radial stop 510 as well as the closure pin piece 509 and with it the closure piece 504 is swept by the connecting pin 513, and the opening 527 is opened. If the means of actuating 502 is moved into the opening direction 520 the means of holding 539 becomes immediately effective in such way that the convex locking element 539*a* swings into the surrounding annular groove 309 of the measuring part 311 and positively engages into it. The means of actuating 502 is swept ahead up to the end stop 518. The movement which is limited at the end stop 519 constitutes the position furthermore referred to as open position 132 at which the closure piece 504 unblocks the opening 527 and thus give free approach to the measuring chamber 301.

Figure 15:
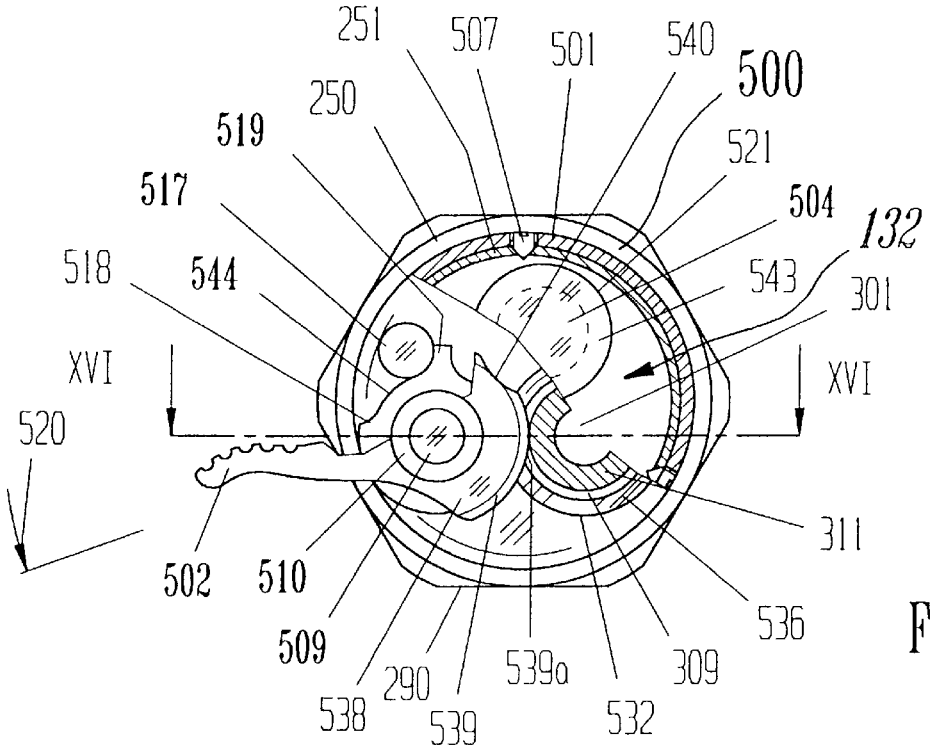
Figure 16:
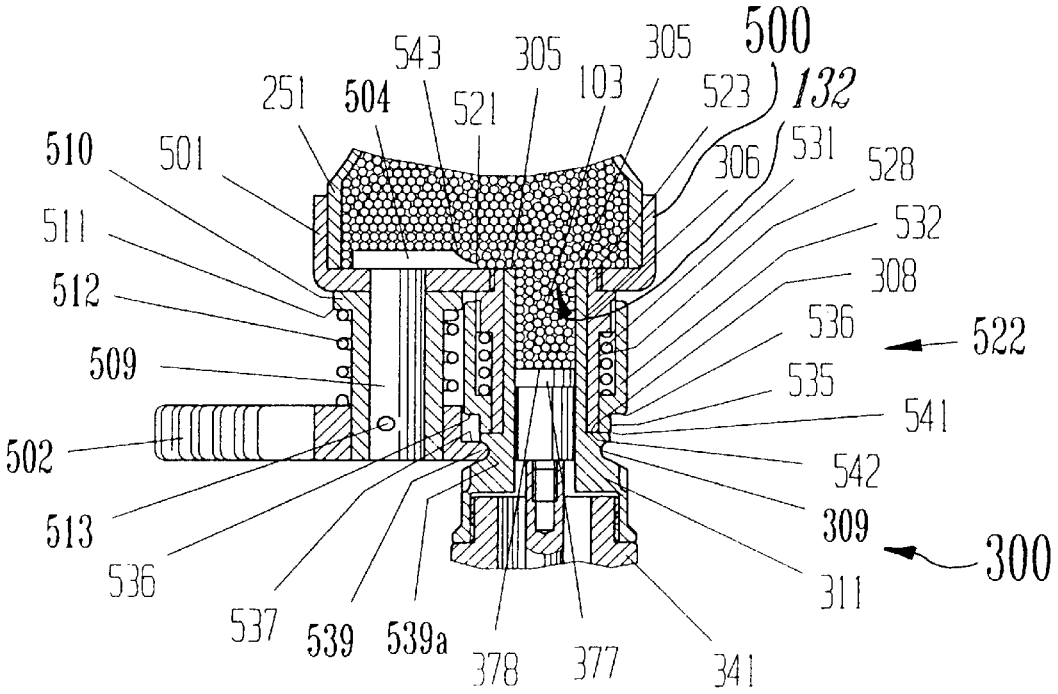

In FIG. 15 the closure 500 is shown in partially broken up view and in FIG. 16 in cross-section with the inserted dosing unit 300 in the open position 132 as just described. The means of actuating 502 is pressed into the open position 132, whereby the closure piece pin 509, the radial stop 510 and the closure piece 504 are swept until the end stop 519 hits on the spring pin 517. In this proceeding, as described, on the one hand the means of holding 539 depending on the modular set-up of the dosing unit 300 enters into the annular groove 309 of the measuring part 311, of the large measuring part 312 or of the bung piece 314. On the other hand, the opening 527 of the means of association 522 is then opened by the swept closure piece 504. Accordingly and with the container 200 placed vertically, the substance 102 enters into the measuring chamber 301 and forms the quantity 103 to be portioned, whereby the end surface 305 borders flush with the closure piece 504. It is clearly recognizable that the stop face 308 moves the means of locking 532 in the direction of the closure piece 504 while inserting the dosing unit 300 into the means of association 522 of the closure 500, whereby the notch collar 535 of the means of locking 532 is pushed out of the radial recess 540 and the notch surface 536 lifts off the stop face 537. Also the development of the sweeping lip 521 is clearly perceptible which is running into the sweeping chamfer 543 at the section being over-bridged by the opening 527 at the side turned towards the internal area 252. The end surface 305 is bordering flush at the level of the closure piece 504 so that the sweeping lip 521 is edging the measuring chamber 301 when the closure piece 504 swivels back from the open position 132 into the closed position 130. The dosing unit 300 remains connected with the closure 500 at this time until the means of actuating 502 is released completely and is returned again into the closed position 130 by the torsion spring 512 against the stop.

Figure 14:
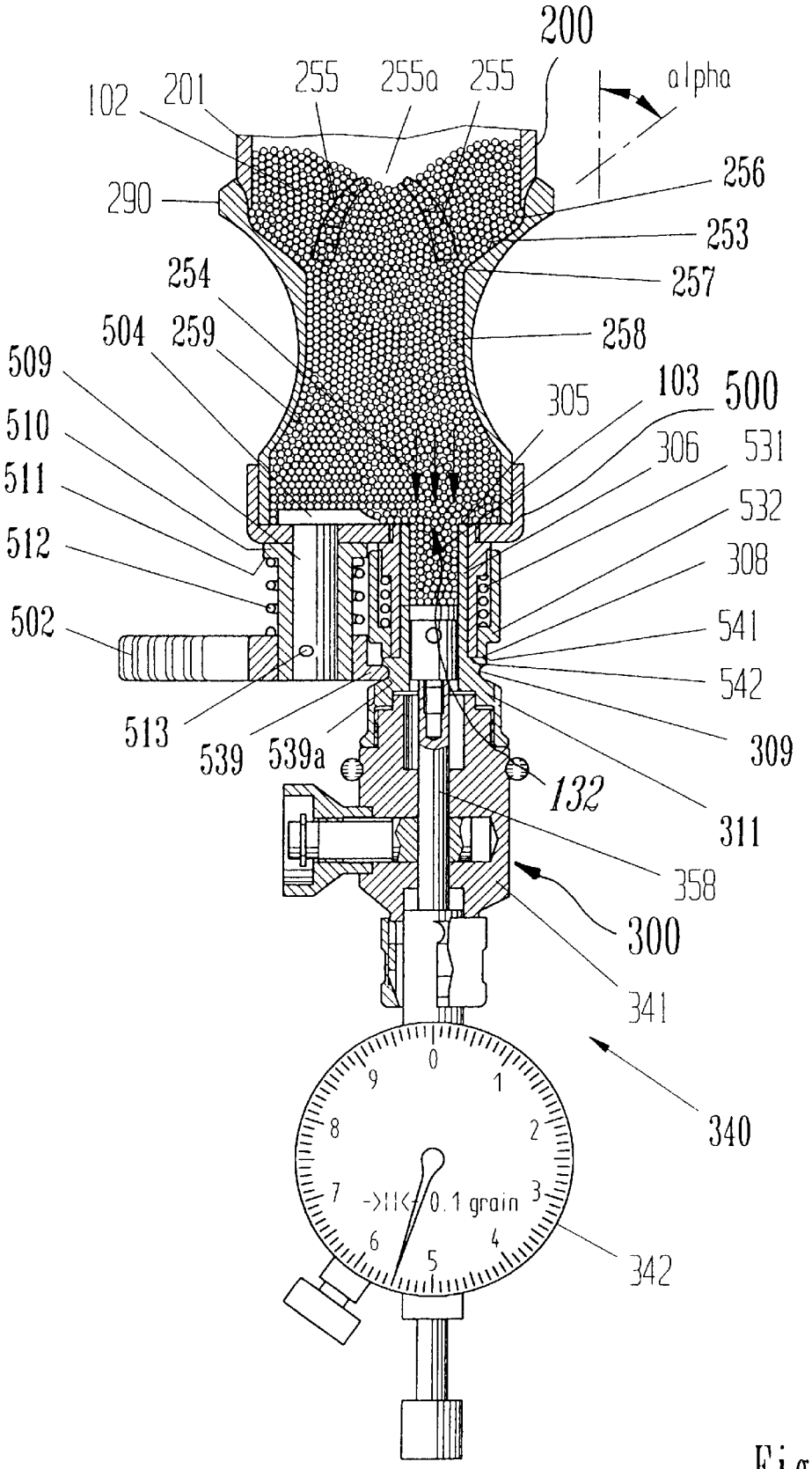

As is to be seen from FIG. 14, the substance 102 in the container 200 is running low. On the one hand, this results in the field of lateral force 255 collapsing on account of the substance 102 flowing off; on the other hand, this condition is well observable through the transparent container body 201 so it can be refilled in time.

Figure 17:
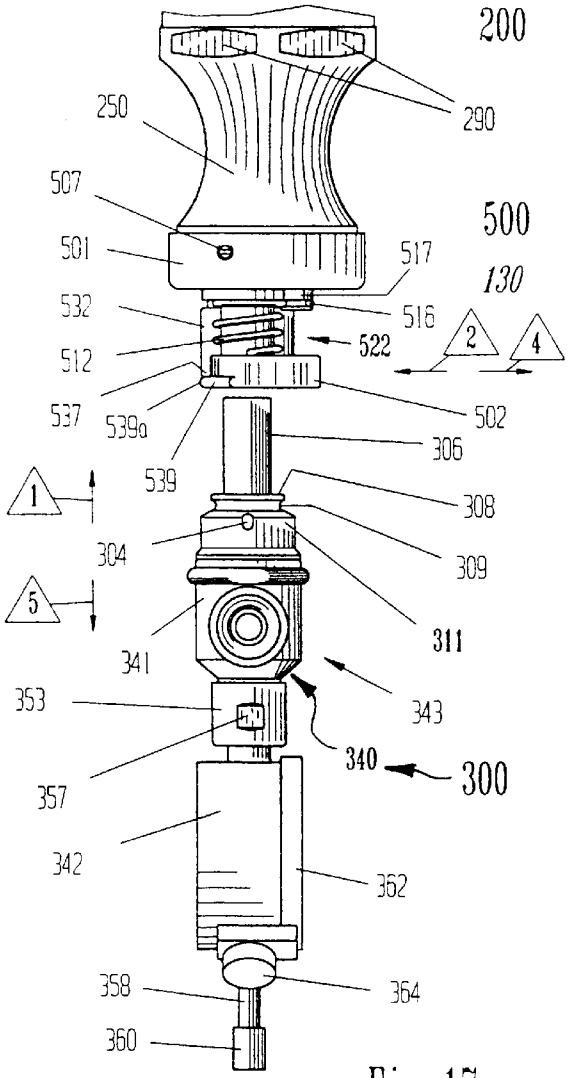

FIG. 17 shows the dosing unit 300 equipped with a measuring part 311 in a side-view, whereby the sequence of the use is marked with arrows, indicated in Arabian numerals in a triangle.

In a first step, the dosing unit 300 is introduced from below in the direction of arrow 1 into the means of association 522 of the closure 500, up to the longitudinal stop 542 whereby the means of locking 532 is activated against the pressure spring 531 by the stop face 308, and the notch surface 536 of the notch collar 535 slides from the radial recess 540, by which in the means of actuating 502 and thus the closure piece 502 is unblocked, and the dosing unit adopts the filling position 131.

In a second step, means of actuating 502 is set going in the direction of arrow 2, whereby on the one hand the means of holding 539 in the form of locking element 539*a* engages into the annular groove 309, and on the other hand the closure 500 is transferred to the open position 132 via the closure piece 504. With the engagement of the means of holding 539 into the annular groove 309, the dosing unit 200 forms fittingly connected to the closure 500, and thus resting the link.

In a third step, the means of actuating 502 remains pressed through the time period of the filling process and the closure 500 kept in open position 132, whereby the substance 102 under the influence of gravitation resulting from the vertically placed container, flows into the dosing unit.

In a fourth step, the means of actuating 502 is again released, whereby the closure piece 504 under influence of the torsion spring 512 returns from the open position 132 in the direction of arrow 4 to closed position 130, and, upon reaching it, the means of holding 539 in form of the locking element 539*a* disengages from the annular groove 309 and thus unresting the link.

In a fifth step, the dosing unit 300 is removed vertically in the direction of arrow 5 from the means of association 522 downwards, whereby the means of locking 532, being under forced tension of the spring, follows the retreating stop face 308, and the notch surface 536 of the notch collar 535 slides back into the radial recess 540, whereby the means of actuating 502 and thus the closure piece 504 is latched in the closed position 130. The closure 500 is no longer able to be opened unintentionally.

Figure 19:
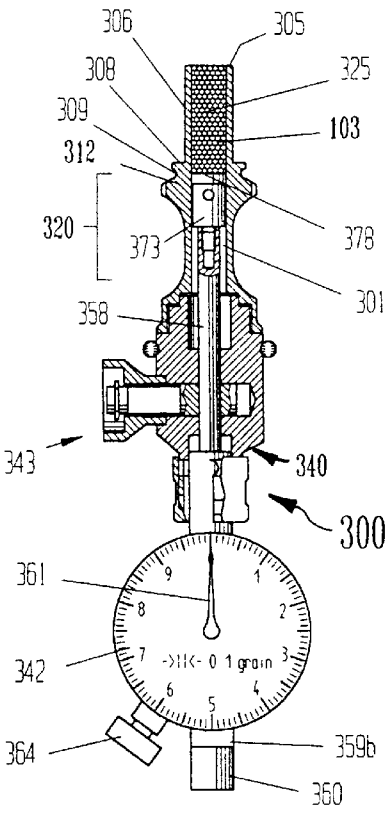
Figure 18:
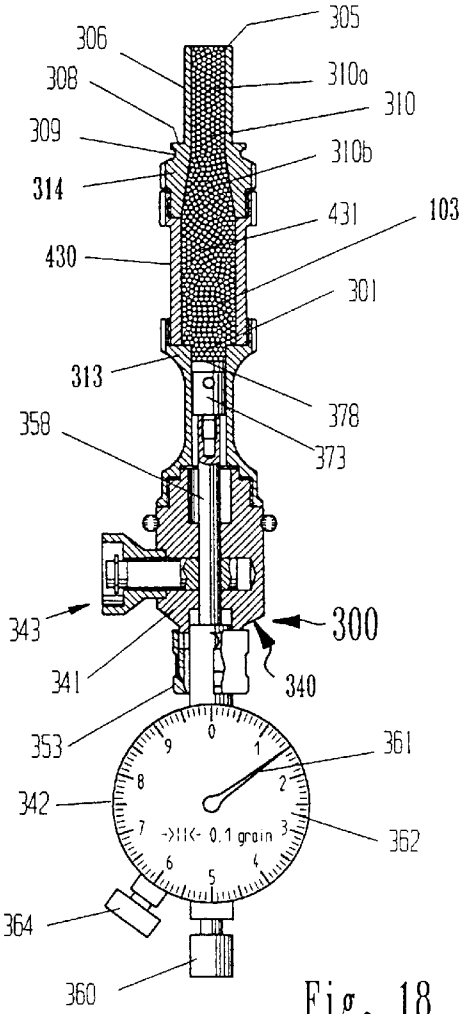

FIGS. 18 and 19 each show each a dosing units 300 after filling with an amount 103 of the substance 102.

EXAMPLE A

From FIG. 18 it is evident that to the measure carrier 340 the socket 430 is associated with the measuring cavity 431 containing 30.0 grain, and to this the bung piece 314 with the cavity 310 consisting of the two partial cavities, cylindrical section 310*a* and conical section 315*b* and containing 20.0 grain. Thus, the combination holds a partial quantity TM=50.0 grain (3.240 GRAM). The means of measuring 342 by means of pointer 361 indicates 1.5 grain (0.097 GRAM) on the scale 362 as residual quantity RM for the measuring chamber 301. Accordingly, it results in an adjusted portioned quantity 103 of a total of 51.5 grain (3.337 GRAM).

EXAMPLE B

In FIG. 19 the large measuring part 312 with the measuring cavity 325 taking 10.0 grain is associated to measure carrier 340. The means of measuring 342 by means of pointer 361 indicates 0.0 grain (0 GRAM) on the scale 362. The measuring chamber 301 therefore, is completely locked by the slider 373. The dosing unit is thus prepared for the uptake of a portionable quantity 103 of 10.0 grain (0.648 GRAM). By altering the measuring rod 358 and thus the slider 373 a range of 0 to 10 grain is adjustable with the plate surface 378 in the measuring chamber, at a relative accuracy of 0.1 grain. A summarizing block diagram of the dosing operation described with respect to FIG. 17 is rendered in FIG. 20.

Figure 21:
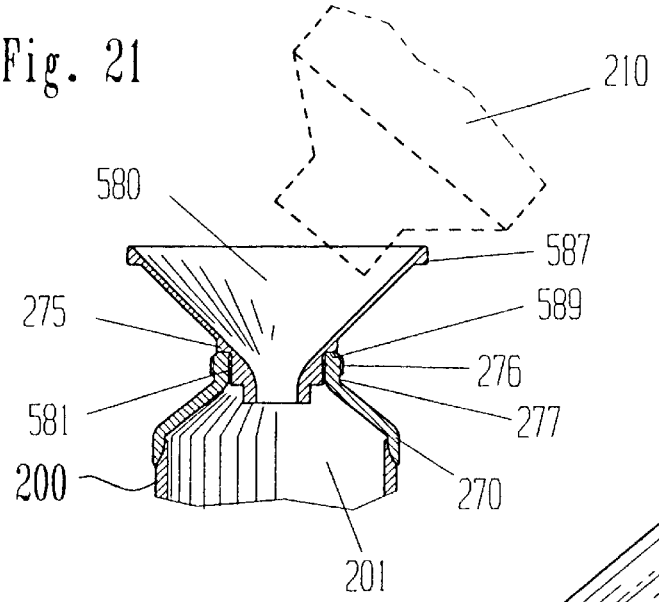

FIG. 21 shows the filling operation of the container 200 by means of a funnel piece 580 from a storage container 210, drawn in dashed lines. After removing the lid 280 from the bottom-part the funnel piece 580 is screwed with the male thread 581 into the female thread 274 of bottom-part 270. Hereby the contact collar 589 enters into firm interaction with the plane surface 275. The container 200 is encompassable with the one hand and the storage container 210 manageable with the other hand. The filling level may easily be observed through the transparent container body 201. With careful handling, no pourable material 102 can be unintentionally wasted while filling container 200.

Figure 22:
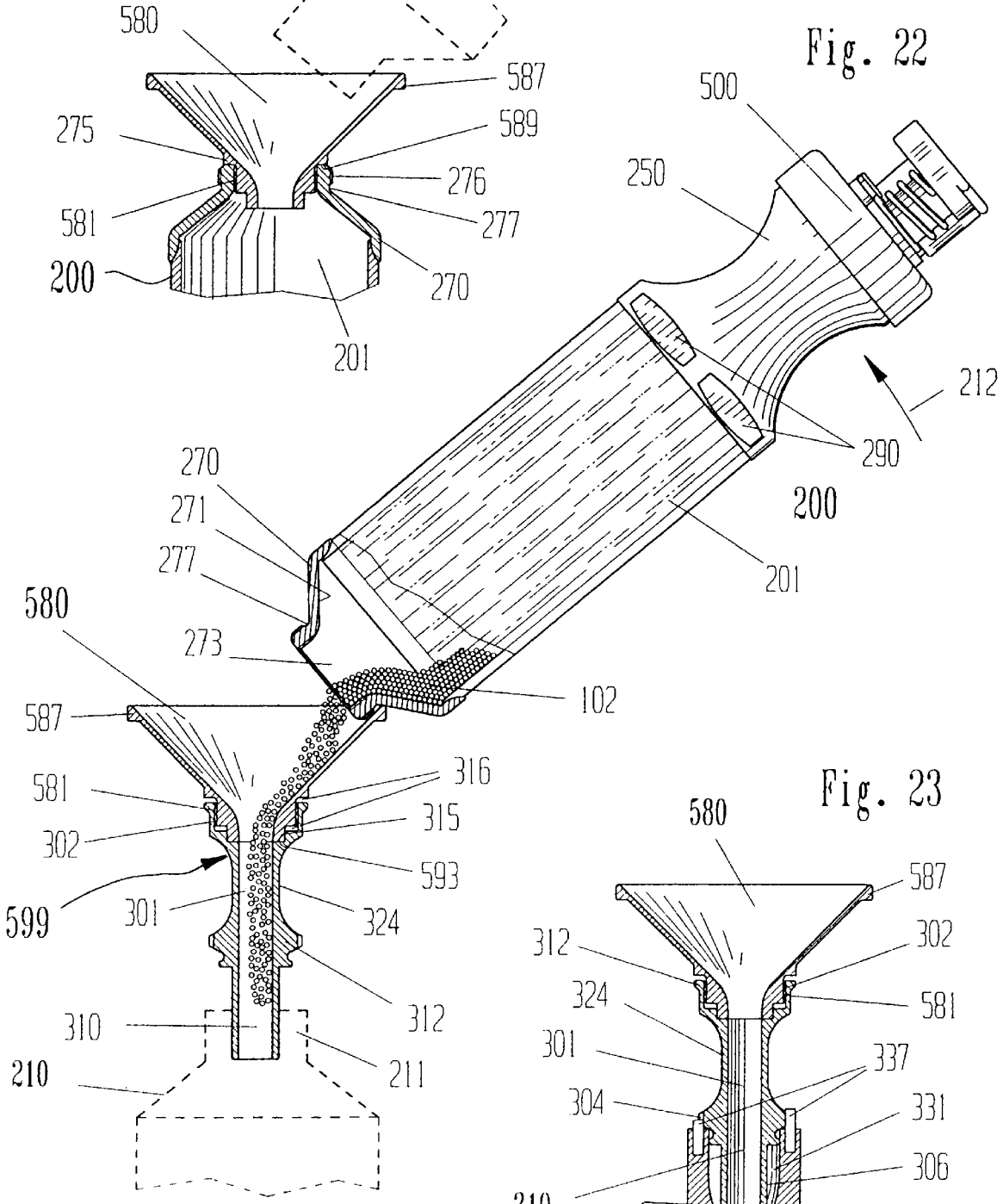

In FIG. 22, the clearing of the container 200 is shown. The funnel piece 580 is connected with its male thread 581 with the thread 302 of the large measuring part 312 to a funnel 599, which may be easily held by the throat 324 or be hooked into an opening 211 of the storage container 210 drawn in dashes. In this process, the centering collar 583 engages into the fit bore 315 and enters into both parts centering and fixing interaction. The lid 280 is removed from the bottom-part 270 of the container 200. The container is takable with one hand and the funnel 599 insertable with the other hand into the opening 211 of the storage container 210 standing upright on a support. The container 200 is set up by its throat 277 on the strengthening collar 587 and swung in the direction of arrow 212, whereby the remaining substance 102 flows back via th e funnel-shaped section 271 of the bottom-part 270 through the opening 273 into the funnel piece 580 and ahead via the measuring chamber 301 and cavity 325 into the storage container 210.

Figure 23:
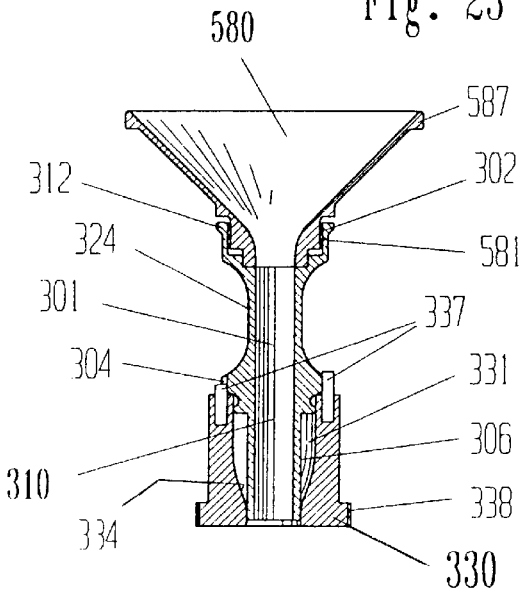

In FIG. 23 the use of the tenter tool 330 in connection with the large measuring part 312 connected to the funnel piece 580 is shown. The tenter tool 330 engages into the grooves 304 with its tappets 337. Furthermore, the tenter tool is axially aligned with the tapered arch contour 334 entering into interaction with the association collar 306, whereby the association collar 306 is protected from damage on account of its arch-shaped contour 334. As becomes further evident from FIG. 23, this development of a tenter tool 330 features a vulcanized polymeric strip 338 for secure transmission of force to solve the connection of measuring part 312 with the funnel piece 580. The funnel piece 580 with its strengthening collar 597 is taken with one hand and the tenter tool 330 on the polymeric strip 338 with the other hand, thus releasing or fastening turningly the connection.

Figure 24:
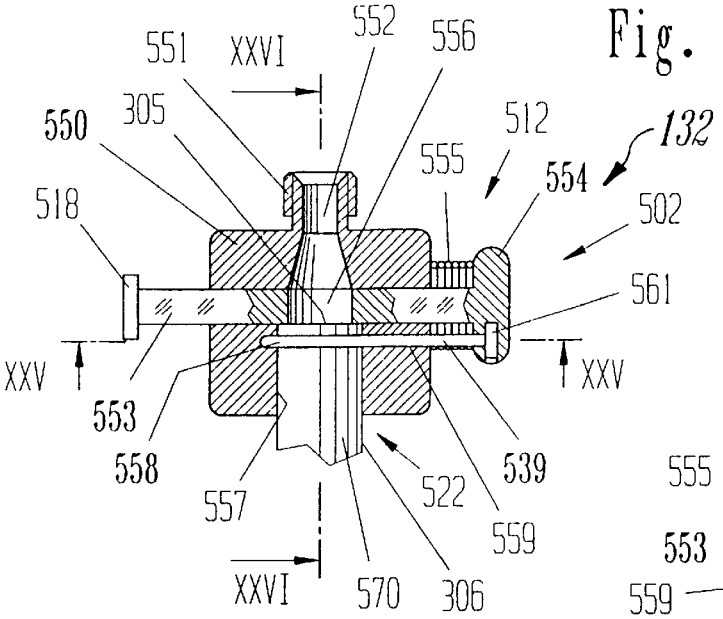

The FIGS. 24 to 38 show different embodiments of a closure body 550 which is equipped with a connection thread 551. The closure body is connectable via the connection thread 551 with a known container in the form of a powder flask, a powder horn or the like. A channel 552 is associated to the connection thread 551 which is closed off by a closure slide 553 being movably guided across to the channel 552 in the closure body 550. On the one side, the closure slide features a stop 518 and on the other side a means of actuating 502 in the form of a push button 554. Between the means of actuating 502 and the closure body 550, a spring unit 512 in the form of a pressure spring 555 is arranged. In a depressed state, a passage aperture 556 placed in the closure slide 553 is associated to the channel 552 as it is shown in FIG. 24. On the side opposite to the connection thread 551 the closure body 550 features a means of association 522 in the form of a centering bore 557 in alignment to the channel 552 for the uptake of a measure of capacity 570 with an adjustable measuring chamber 301. The substance 102 attains to the measuring chamber 301 via the channel 552 and the passage aperture 556.

At the example shown in FIGS. 24 to 28 a means of holding 539 in the form of a finger 558 is provided which on the one hand is interacting with the means of actuating 502 and on the other hand movable together with and to the closure slide 553 in a guide bore 559 within the closure body 550. The guide bore 559 feeds laterally into the centering bore 557, whereby this, viewed in cross section, only projects by about half into the centering bore 557. The other half constitutes a supporting shoulder 560 inside the guide bore 559 in which the finger 558 engages when the push button 554 is pressed. For compensation of tolerances, the finger 558 comprises a compensation bearing 561 arranged in the push button 554 in order to prevent jamming phenomena.

Figure 25:
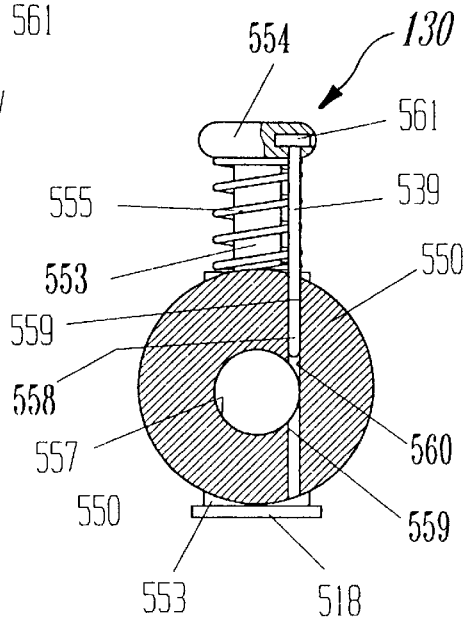

FIG. 25 shows the closure body 550 in cross section with the stop 518 resting on the closure body 550 and, therefore, the closure slide 553 resting in the closed position 130. The guide bore 559 being arranged parallel to the closure slide 553 and the supporting shoulder 560 is clearly recognizable.

Figure 26:
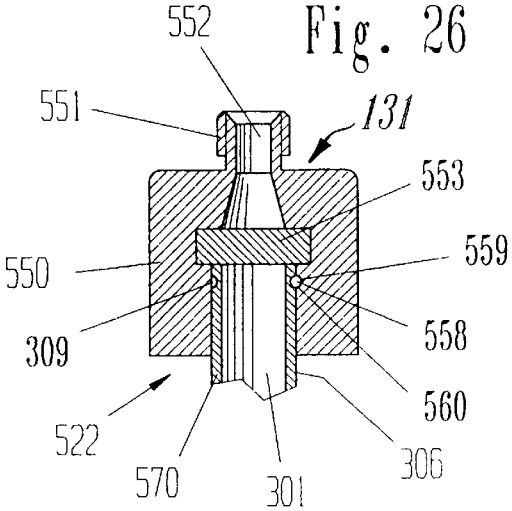

From FIG. 26 it is to be seen that the centering collar 306 on the measure of capacity 570 which is comprising the surrounding annular groove 309 and with its end surface 305 in the centering bore 557 of the means of association 522 is approachable directly to the closure slide 553 into the filling position 131 whereby the closure slide is still closed. When activating the push button 554, the one half of the finger 558 slides in the guide bore 559 into the supporting shoulder 560 and the other half into the annular groove 309. The finger 558 supports itself on the supporting shoulder 560 and thus prevents a removal of the measure of capacity 570 as long as the substance 102 flows via the channel 552 and the passage-aperture 556 into the measuring chamber 301, thus when the closure slide 553 is located in the open position 132.

Figure 27:
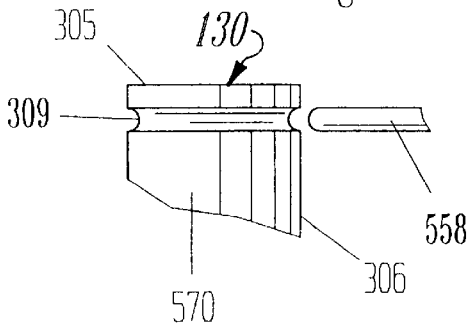
Figure 28:
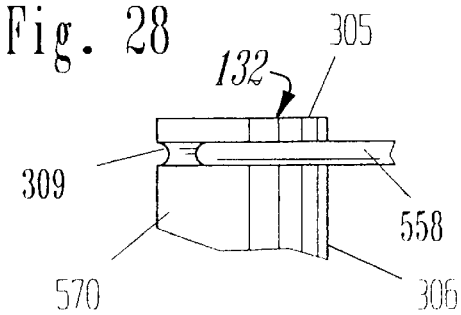

For an illustration of the function of the finger 558, the FIG. 27 is showing it immediately before entry into the annular groove 309 and FIG. 28 the finger 558 entered into the annular groove 309.

Figure 29:
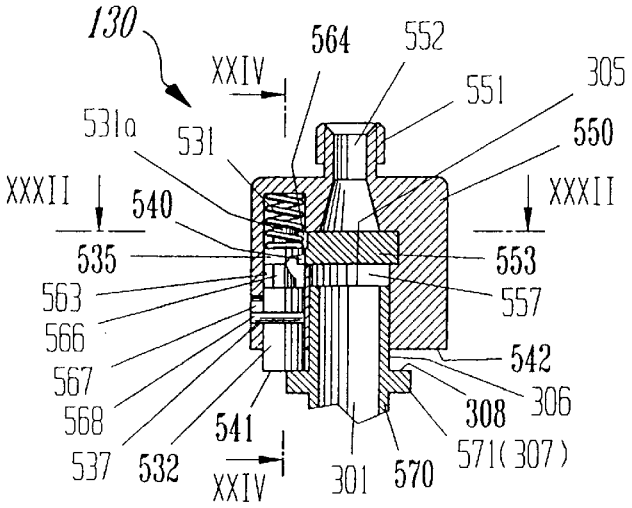
Figure 30:
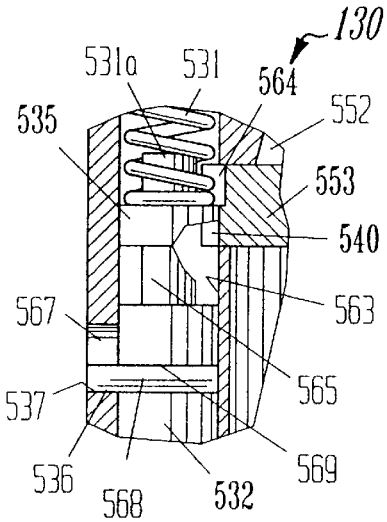
Figure 33:
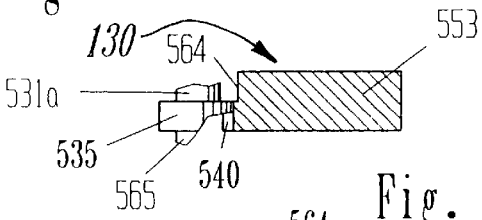

In FIGS. 29 to 35 a further example with the means of locking 532 is shown, whereby FIGS. 29, 30 and 33 concern to the closed position 130. The means of locking is latched with the notch collar 535 in the radial recess 540 of the closure slide 553, whereby the pressure surface 541 is protruding out of the closure body 550. Furthermore, the closure slide 553 comprises a notch groove 564 and the means of locking 532 adjacent to the notch collar 535 a locking means' throat 565. The means of locking 532 is axially movable guided in a guide bore 563 and is pressurized by the pressure spring 531, as is to be seen especially from FIG. 30. The pressure spring 531 is centered by the pressure spring guide in the form of a pin 531*a* in order not to damage the guide bore 563 and, above all, not to obstruct the function of the closure slide, for instance by getting hooked.

In the closure body 550 is provided a locking stud guide 567 in which a locking stud 568 is guided. The locking stud 568 is held in a cross-bore 569 and comprises a stop face 537 on the side gliding in the locking stud guide 567. The locking stud guide 567 in the form of a small longitudinal groove comprises a notch surface 536 at the lower end. The locking stud 568 holds the means of locking 532 so that the notch collar 535 rests latched in the closed position 130 in the recess 540, as is particularly visible from FIG. 30, shown in cross-section. The guide bore 563 of the means of locking 532 is oriented parallel to the centering bore 557.

The measure of capacity 570 comprises a stop collar 307 in the form of a circular collar 571 to which the stop face 308 is associated. If the measure of capacity 570 with the association collar 306 is inserted into the centering bore 557, first the stop face 308 comes into close contact with the pressure surface 541, whereby the notch collar 535 remains locked in the recess 540. For better comprehension, the means of locking 532 is shown in FIG. 30 broken up in the section of the closure slide 553.

Figure 31:
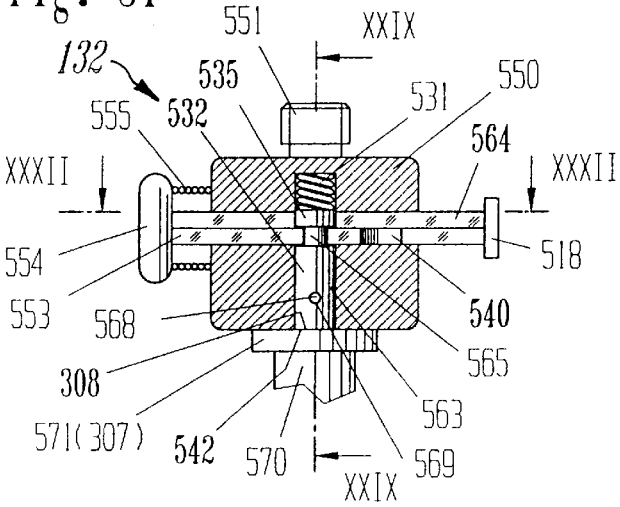
Figure 32:
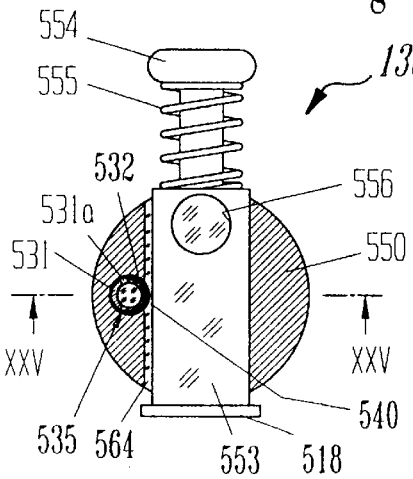
Figure 34:
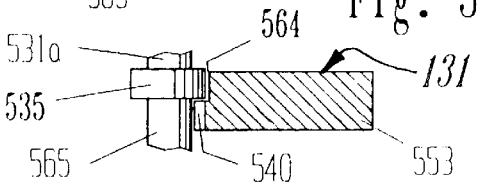
Figure 35:
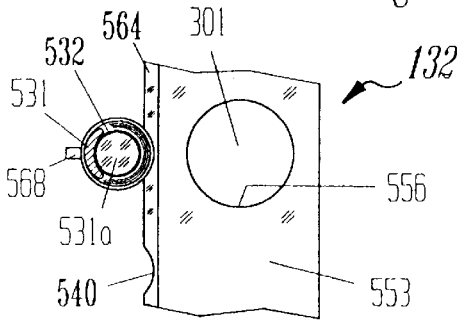

When the measure of capacity 570 is now transferred ahead into the filling position 131 until the stop face 308 is in touch with to the lower side forming the longitudinal stop 542 as is shown in FIGS. 31 and 34, then the notch collar 535 is pushed from the recess 540 and thus the locking gets unblocked. In this process, the notch collar 535 on the one hand engages into the notch groove 564 and on the other hand the locking means' throat 565 engages into the recess 540, thus achieving the filling position 131 in which the end surface 305 is directly approached to the closure slide 553. The push button 554 is then actuable and the closure slide 553 transferable into the open position 132. The measuring chamber 301 of the measure of capacity 570 is then fillable via the channel 552 and the passage-aperture 556.

If the closure slide 553 is released, it is transferred to the closed position 130 by the pressure of the pressure spring 555. When the stop 518 is in touch with the closure body 550, the recess 540 again is axial to the guide bore 563. If the measure of capacity 570 is removed, the notch collar 535 of the means of locking 532 is latched again in the recess 540 under influence of the pressure spring 531, and the closure piece is protected against unintentional opening.

The FIGS. 36 to 38 show a last example of the closure comprising as well as the means of locking 532 as the means of holding 539 in the closure body 550 as is described each according to in FIGS. 24 to 35. The closure body 550 is attached to a powder flask or the like not shown here by the connection thread 551. In the closure body 550 arranged vertically, the measure of capacity 570 is introduced from below into the centering bore 557 until the stop face 308 is in touch with the longitudinal stop 542. Hereby the means of locking 532 is entrained by the pressure surface 541 via the stop face 308 and the notch collar 535 moved out of the recess 540 as described in example 2 above. The filling position 131 is achieved and the closure slide 553 unblocked.

The closure slide 553 is then actuated, whereby the finger 558 in the guide bore 559 engages into the annular groove 309 and a communicating connection is built from the channel 552 via the passage-aperture 556 to the measuring chamber 301, and thus achieving the open position 132. As long as this connection exists, the closure body 550 is form-fittingly latched with the measure of capacity 570 via the finger 558 resting both in the supporting shoulder 560 and in the annular groove 309. If the filling operation of the measuring chamber 301 is completed, the push button 554 is released, whereby the finger 558 glides back into the guide bore 559 and disengages the form-fitting connection. Subsequently, the means of holding 539, as described in example 2 above, locks again and secures the closed position 130.

In FIG. 37, the closure body 550 and a measure of capacity 570 is shown comprising the annular groove 309 and a circular collar 571.

Figure 39:
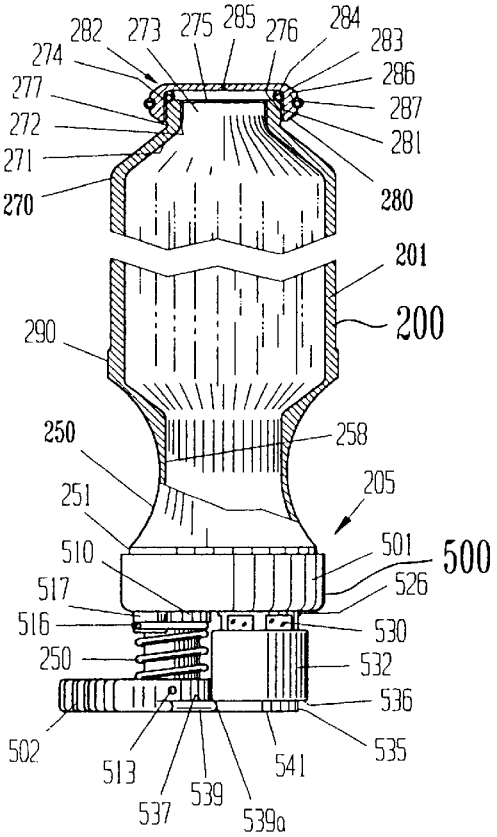

In FIG. 39, an embodiment of the container 200 is shown, in which the head-part 250 is implemented with the container body 201 to the bottom-part 270 as an integral, one-piece component, whereby the funnel-shaped section 271 at the side in the bottom-part 270 opposite to the bleeding side 205 passes into the opening 273 which is closable by means of the lid 280. In the opening 273, the thread 274 is arranged into which the funnel piece 580 is inscrewable after disconnecting the lid from the thread 276 of the bottom-part 270, in order to rapidly and safely fill the container with pourable material, as is described on FIGS. 9A and 22.

Figure 40A:
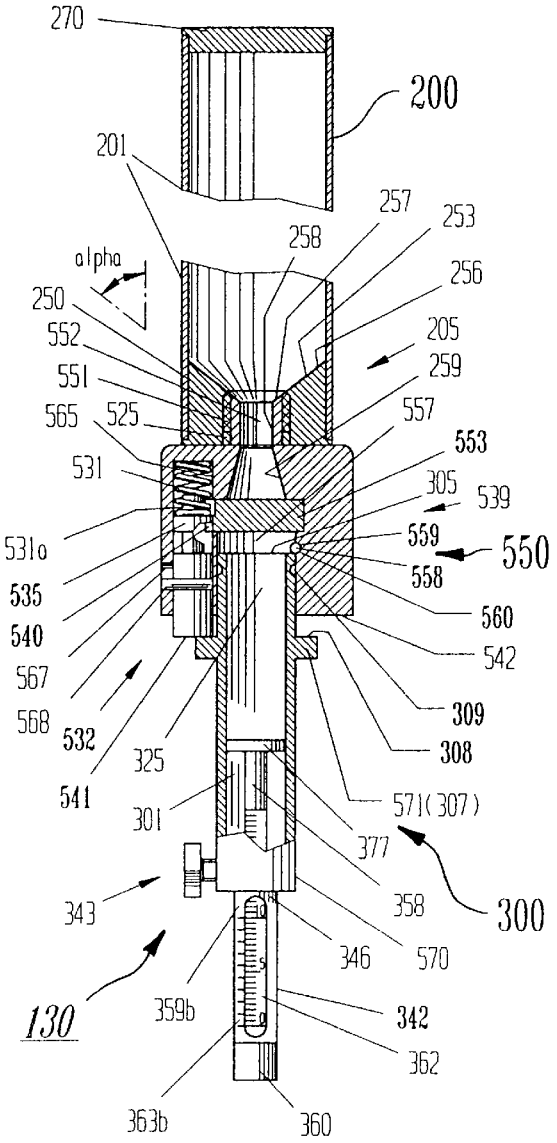

In FIG. 40A, a further embodiment of the container 200 is shown with a cylindrical container body 201 comprising a plane bottom-part 270 and a head-part 250 with a female thread 525. The closure body 550 with the means of holding 539 and the means of locking 532 being in closed position 130 is connected via the connection thread 551 with the container 200, as is shown in FIG. 37. The head-part 250 comprises towards the bleeding side 205 the tapered off section 253 with the entrance cross-section 256 and the outlet cross-section 257, followed by the portion with constant cross-section 258 and to this by the expanding section 259. After releasing the closure body 550 the container 200 is completely clearable. In FIG. 40A, is furthermore a one-piece module of the dosing unit 300 in the form of a measure of capacity 570 shown, whose cavity 325 contains an integer multiple of the quantity adjustable at the vernier 363b of a maximum of 10 grain of the measuring chamber 301, as is described above in on the socket group 400 (page 20).

Figure 40B:
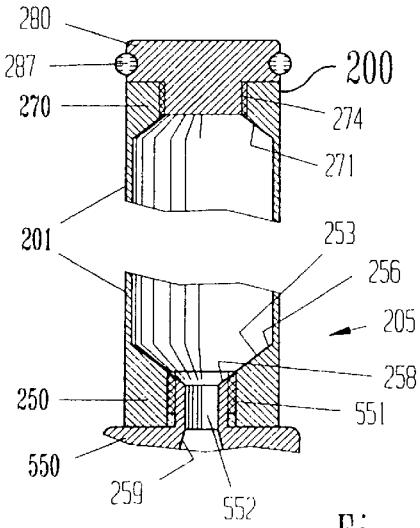

In FIG. 40B, a further embodiment of the container 200 is disclosed in which the head-part 250, the container body 201 as well as the bottom-part 270 are developed as an integral one-piece body. The head-part 250 comprises the funnel-shaped section 271 extending towards the bleeding side 205 as is already described in detail with relation to FIGS. 9A and 40A. The bottom-part 270 also comprises the funnel-shaped section as well as the female thread 274, into which the lid 280 is screwed in. As described above, the funnel piece 580 may be associated to the female thread 274 for easy filling so that the closure body 550 needs not be removed. As to the manufacturing technology, this one-piece integral body is easily producible in large numbers by means of injection molding.

Figure 41A:
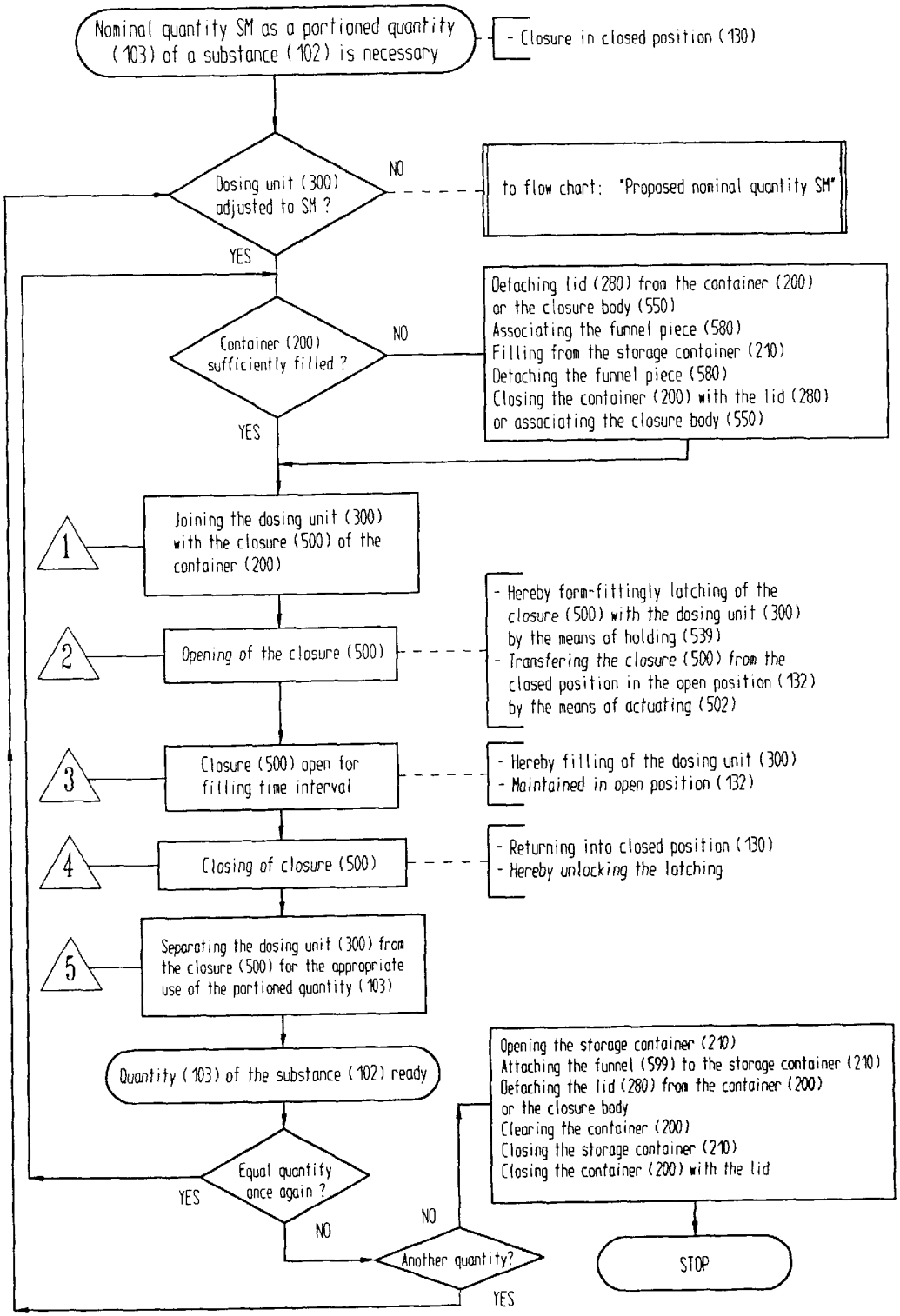
Figure 41B:
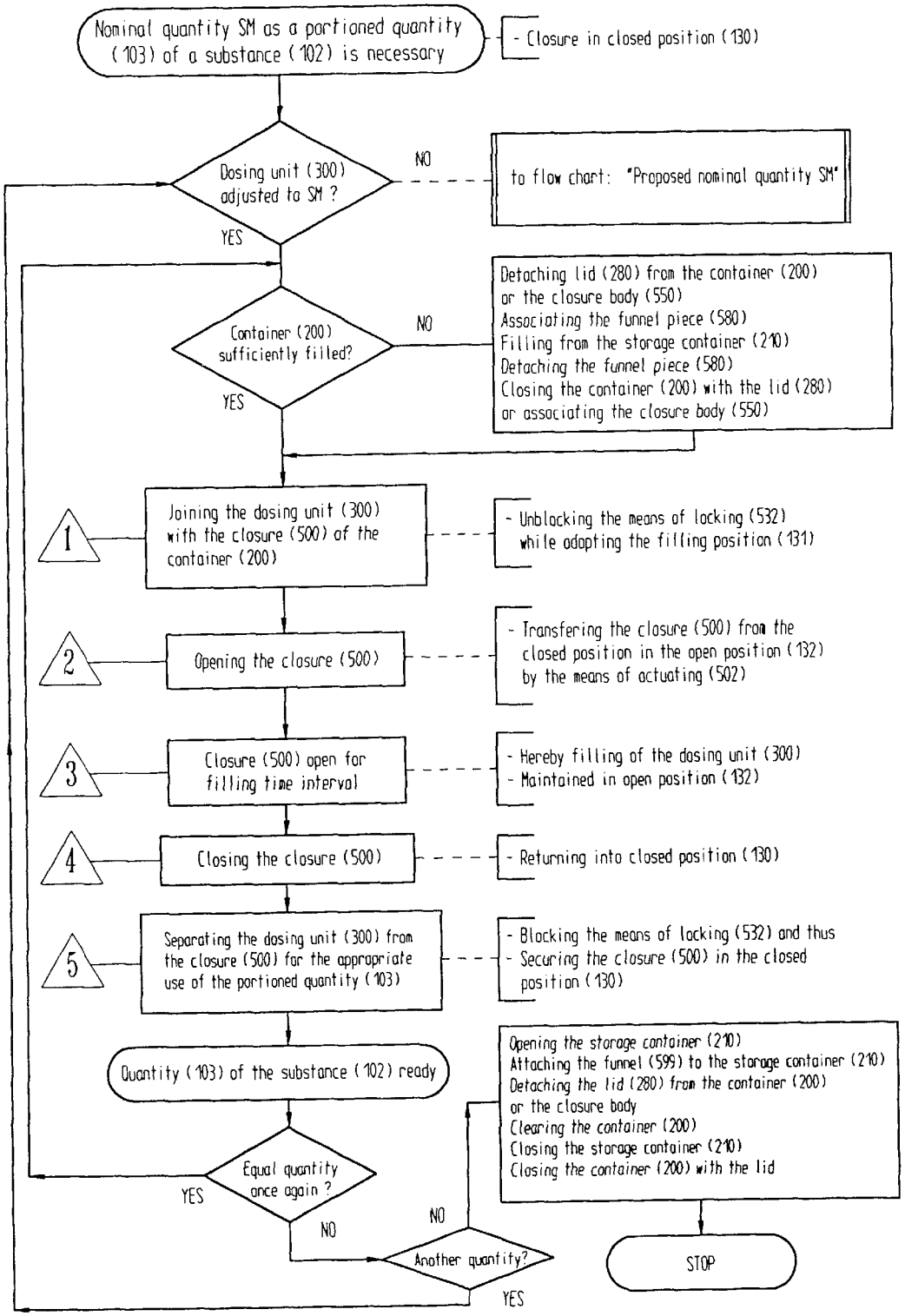
Figure 42:
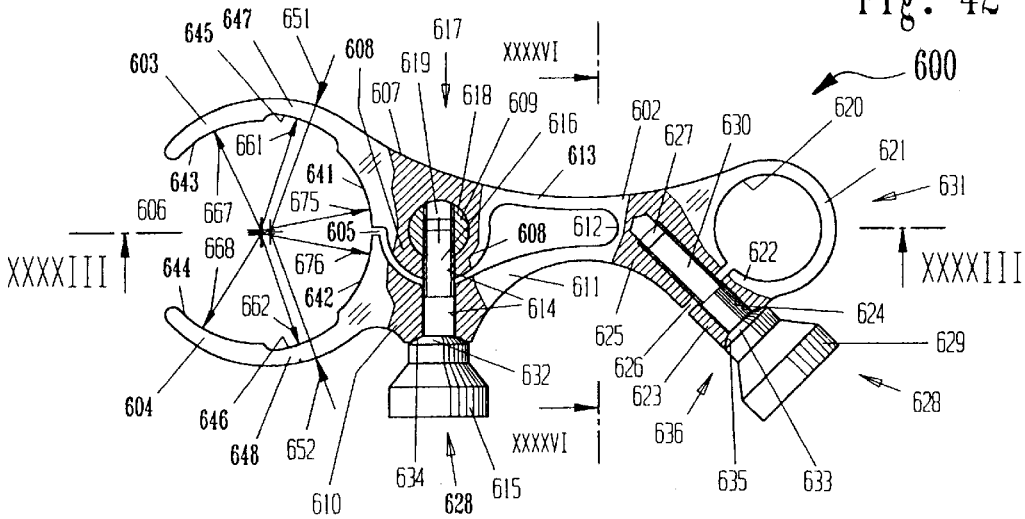

In FIG. 41A, a use of the arrangement 100 is specified, in which the closure 500 and the closure piece 550 respectively are, according to the first example, equipped with a means of holding 539 (FIGS. 24 to 28). In FIG. 41B, a use of the arrangement 100 is specified, whereby the closure 500 and the closure piece 550 respectively are, according to the second example, equipped with a means of locking 532 (FIGS. 29 to 35). The use of the device according to the third example with the means of locking 532 and the means of holding 539 is already described on FIG. 20. At the measure of capacity 570 the measuring cavity 325 contains an integer k-fold multiple of the effective volume WV, whereby k is taking values of 0 to n according to the desired measuring range.

As mentioned several times before, the container 200 or the powder flask is to be preferentially placed vertically in order to utilize the gravity. For this purpose, part of the arrangement 100 is a clamping holder 600 with which the container 200, the closure cap 501 of the closure 500 or the closure body 550, furthermore in summary, referred to as an object 601 is to be clamped. The clamping holder 600 is connectable with a holding device 700 and quickly attachable to a table or similar with a clamping device 730 in order to warrant the vertical position of the container 200.

The clamping holder 600 shown in FIGS. 42 to 53C, for holding the object 601 comprises a holder body 602 with two arms 603, 604 facing each other and being separated from each other by a slit 605, and which are leaving an open space 606 opposite to the slit 605. The one arm 603 comprises on the outside a continuous bow 607 and inside a thickening 608, extending curved-like from the slit 605 in a circle-segment shape towards the other arm 604 and having a cross-bore 609. The other arm 604 on the outside is first blending into a saddle 610, followed by a relatively rigid bridge 611. Inside, the slit 605 follows the thickening 608 and runs curved-like up to an end bow 612, which is joined by an integral spring element 613 connecting both arms 603, 604 with each other in one piece form.

The saddle 610 comprises a through-hole 614 opposite to the cross-bore 609 which also intersperse the thickening 608 up into the cross-bore 609. A means of clamping in the form of a tension screw 615 passes the through hole 614 with a male thread 616. A means of compensation 617 in the form of a clasp nut 618 is swivable borne in the cross-bore 609. The cylindrically developed clasp nut 618 is interspersed by a female thread 619 into which the male thread 616 of the tension screw 615 engages.

The continuous bow 607 merges into a clamping ring 621 clip-like encompassing a fixing bore 620 which at its end 622 features an additional saddle 623 that is interspersed by a further cross-bore 624. The rigid bridge 611 is arch-like running out in the direction of the additional saddle 623 into another thickening 625, which is interspersed by a slit 626 feeding into the fixing bore 620. An internal thread 627 is provided in the thickening 625 into which a means of clamping 628 in the form of a tension screw 629 engages with a male thread 630 and builds a means of fixation 631 to fix the clamping holder 600 to the holder 700 or to another cylindrical part.

Figure 43:
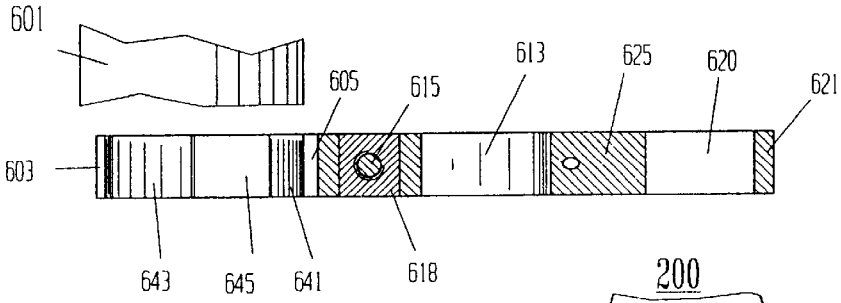
Figure 44:
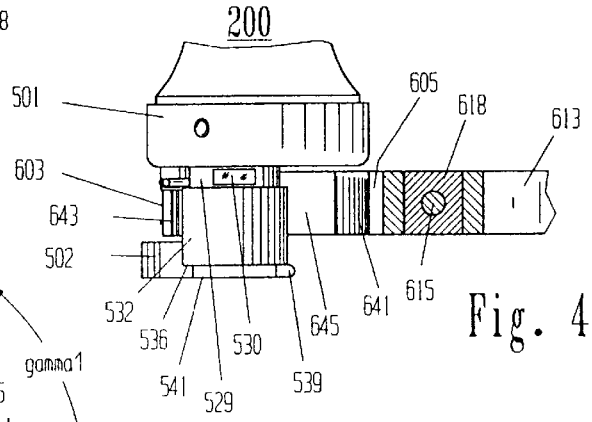
Figure 47:
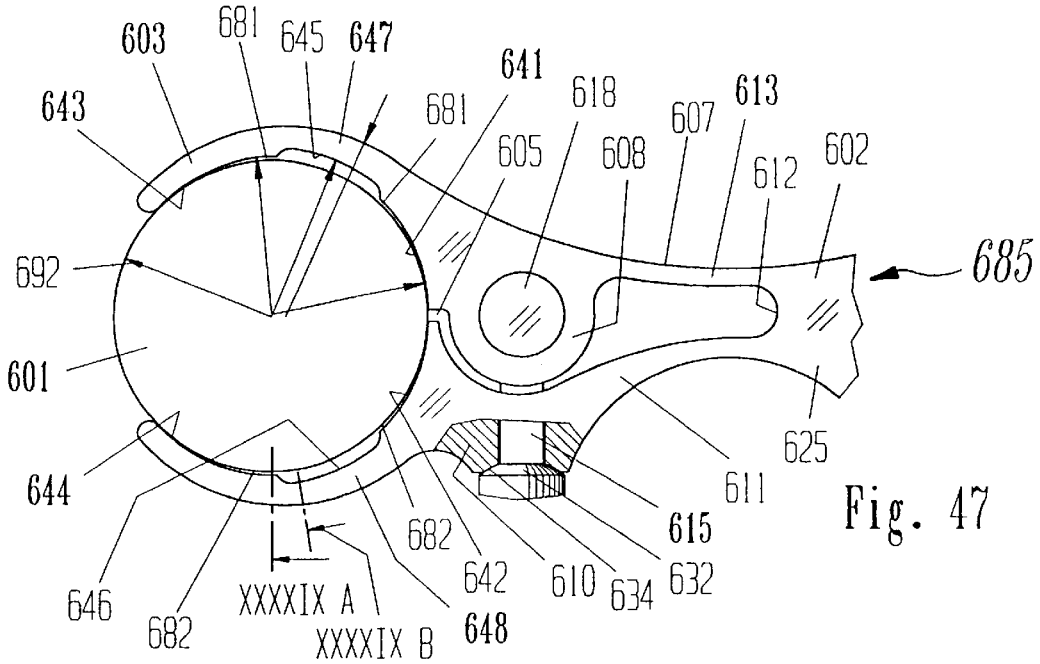

The natural residual stress of the material holds the arms 603, 604 as well as the clamping ring 621 in a non-tensioned initial position 685 as is shown in FIG. 47. In this initial position 685 the object 601 to be clamped is insertable with its outside diameter 692 vertically to the clamping holder 600 between the arms 603, 604, as is shown in FIGS. 43 and 44. In particular the container 200 is conveniently insertable, since the means of actuating 502 is easily led through the open space 606.

The tension screws 615 and 629 have the same form and feature each a raised spherical surface 632, 633 which each comes into interaction with a hollow spherical surface 634 on which a saddle 610, respectively a hollow spherical surface 635 on the other saddle 623, if both arms 603, 604 are tensioned towards each other by screwing in the tension screw 615, or when the tension screw 629 tenses the clamping ring 621. The two spherical surfaces 633 and 635 of the means of fixation 631 form a compensation means 636 operating geometrically, which is equalizing the deformation while tensing. In the case of the clamping ring 621 the spherical surfaces 633 and 635 are sufficient for the geometrical compensation since the relative motions are small. In the case of the two arms 603, 604 the swivable clasp nut 618 and the spherical surfaces 632, 634 act jointly as a geometrical means of compensation 636.

Each of the arms 603, 604 comprise on the inside a relatively rigid contact area 641, 642 to which a clamping sector 643, 644 is associated at the far end of each arm. Between the contact area 641, 642 and the clamping sector 643, 644 each, a non-tightening area 645, 646 is provided, which each forms an integral spring unit 647, 648 by which the contact areas 641, 642 and the clamping sectors 643, 644 are in materially interaction.

Figure 45:
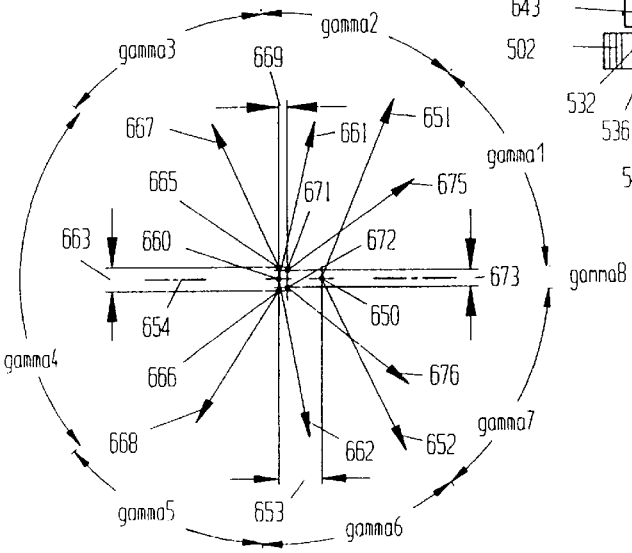
Figure 46:
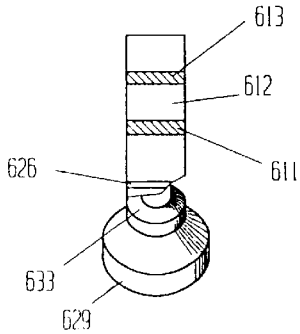

FIG. 45 shows the geometrical association of the sector angles gamma 1 to 8 of the clamping sectors 643, 644; the spring units 647, 648 and the contact areas 641, 642 of the open space 645 and of the slit 605. It is assumed that the object 501, 601 to be clamped comprises a circular cross-section (radius 692). Starting from a common center point 650 the radii 651 and 652 are associated to the arms 603, 604. At a horizontal distance 653 a further center point 660 is provided on a symmetry line 654 to which the radii 661 and 662 are associated. The center point 660 is vertically symmetric and perpendicular to the symmetry line 654 at a vertical distance 663 neighbored by a center point 665 and 666 to which a radius 667 and 668 each is associated. At a horizontal distance 669 the center points 665 and 666 are each in the direction towards the center points 650 symmetrically neighbored by additional center points 671 and 672 which are building a vertical distance 673 to each other set parallel to the vertical distance 663. To the center points 671, 672 a radius 675 and 676 each is associated. The sector angles gamma associated to the radii are listed in table 5:

TABLE 5

| | | Center point | Radius | Angle |
|---|---|---|---|---|
| Contact area | 641 | 671 | 675 | gamma1 |
| Spring unit | 647 | 660 | 661 | gamma2 |
| Clamping sector | 643 | 665 | 667 | gamma3 |
| Open space | 645 | — | — | gamma4 |
| Clamping sector | 644 | 666 | 668 | gamma5 |
| Spring unit | 648 | 660 | 662 | gamma6 |
| Contact area | 642 | 672 | 676 | gamma7 |
| Slit | 605 | — | — | gamma8 |

Table 6 reflects the radii and table 7 the distances each referring to the half of the diameter 692 of the object 501, 601 to be clamped as 100%. The dimensions of the angels are given in table 8.

TABLE 6

| Radius | 651 | 675 | 661 | 667 | 668 | 662 | 676 | 652 |
|---|---|---|---|---|---|---|---|---|
| [%] | 120 | 98.5 | 109 | 98.5 | 98.5 | 109 | 98.5 | 120 |

TABLE 7

| Distance | 653 | 663 | 669 | 673 |
|---|---|---|---|---|
| [%] | 8.9 | 5 | 1.75 | 3.6 |

TABLE 8

| Angle gamma | 1 | 2 | 3 | 4 | 5 | 6 | 7 | 8 |
|---|---|---|---|---|---|---|---|---|
| [°] | 48 | 43 | 47 | 80 | 47 | 43 | 48 | 4 |

Figure 48:
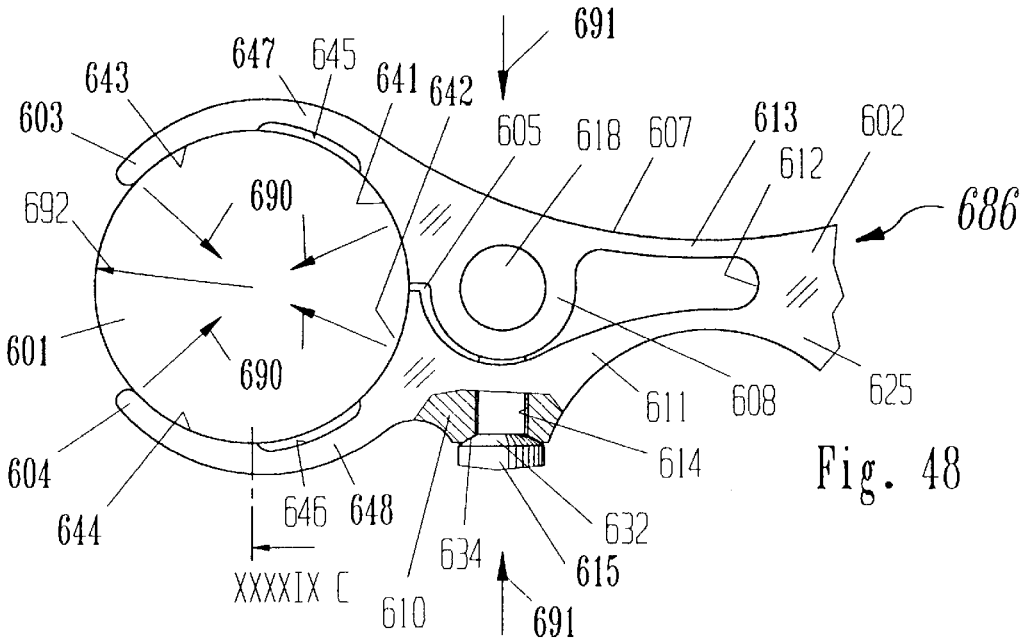
Figure 49A:
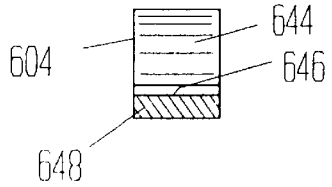
Figure 49B:
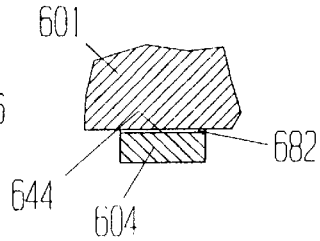
Figure 49C:
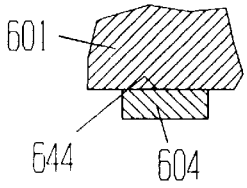

The aim of this association is to securely clamp an object 501, 601 by means of a four-point bearing generated between the arms 690, which is self-centering and increases while clamping, as is shown in the FIGS. 47 and 48. The object 601 is inserted vertically between the arms 603, 604. In FIG. 47 a narrow, comma-shaped gap 681 and 682 is recognizable, which is largest in the region of the two integral spring units 647 and 648. If both arms 603, 604 are moved towards each other by the tension screw 615 other against the tension of the integral spring element 613, both spring units 641 and 642 are becoming active, whereby the clamping sectors 643, 644 under the influence of the tension force 691 encircles snuggly around the object 601 to be clamped, as is shown in FIGS. 49A to 49C, and are transferred into a tensioned position 686 as shown in FIG. 48.

Figure 50:
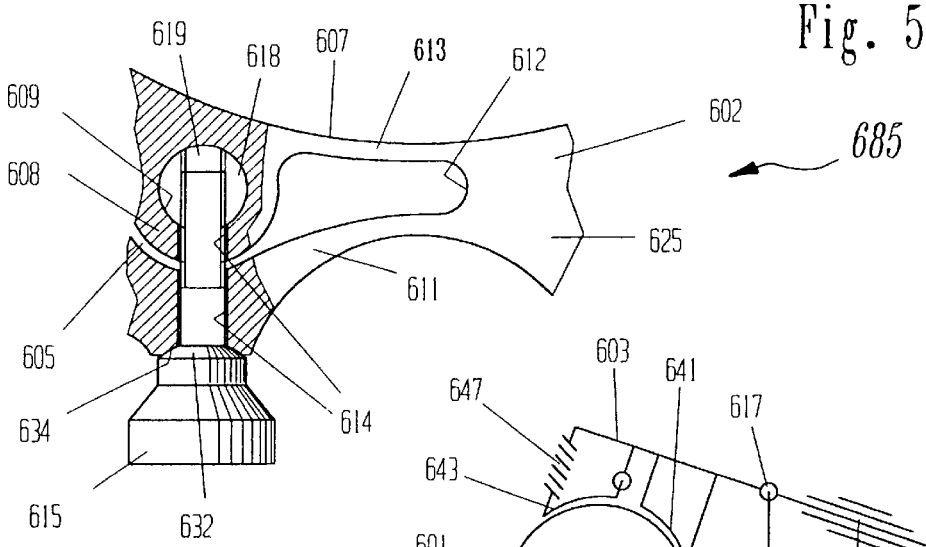
Figure 51:
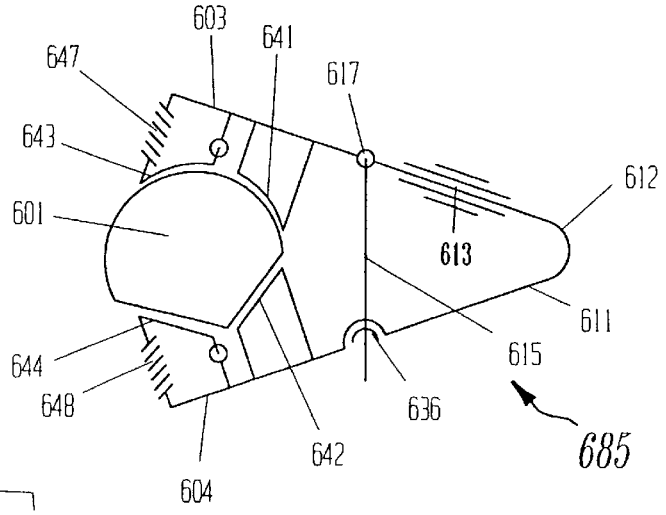
Figure 52:
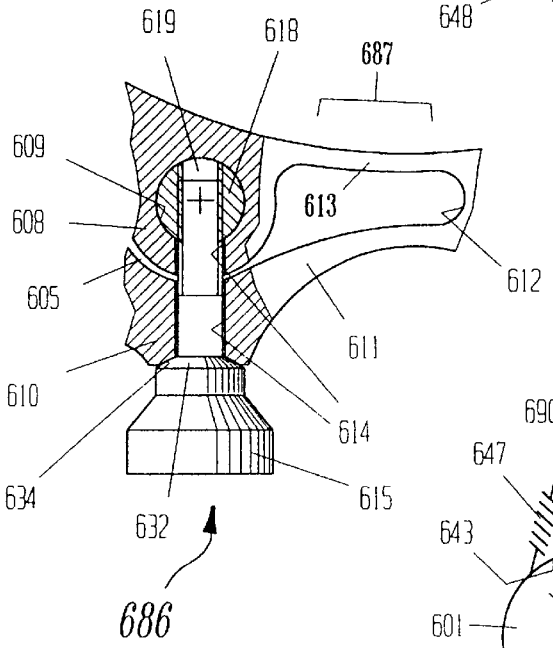
Figure 53:
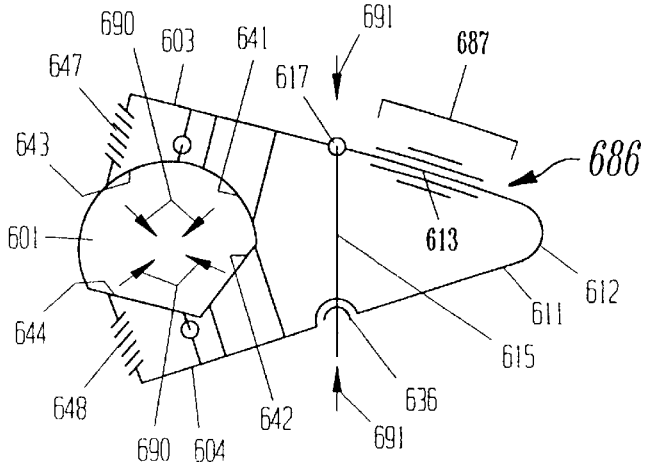

At a correspondingly geometrical embodiment, this process is also applicable to non-symmetrical objects as can be seen from the FIGS. 51 and 53, which are schematically showing the functional principle. In FIG. 50 a detail of the clamping holder in non-tensioned initial position 685 and in FIG. 52 the detail is shown in tensed position 686, whereby the spring element 613 is visible which under load, as with a cantilever arm essentially under a continuous curvature 687, avoids a static pivot.

The four-point bearing 690 must in any case be observed, whereby this over-determination is compensated via a spring unit 647, 648 each at the arms 603, 604. It is also possible that only one of the arms has a spring unit, however, the opposite arm is then to be developed according to the contour to be clamped.

The clamping holder is to a large extent easily producible in one working operation as an intermediate product out of a plane, semi-finished product plate, in particular of light metal, by means of profile cutting, whereby then the contours of the arms 603, 604, the contact areas 641, 642, the spring units 647, 648, the open spaces 645, 646, the clamping sectors 643, 644, the slit 605, the thickening 608, 625, the end bow 612, the spring element 613, the continuous bow 607, the saddles 610, 623, the clamping ring 621 are mostly executed in one working cycle. The slits 605 and 626 as well as the bores 609 and 620 are optionally to be included into the one working operation of the profile cut.

Figure 54:
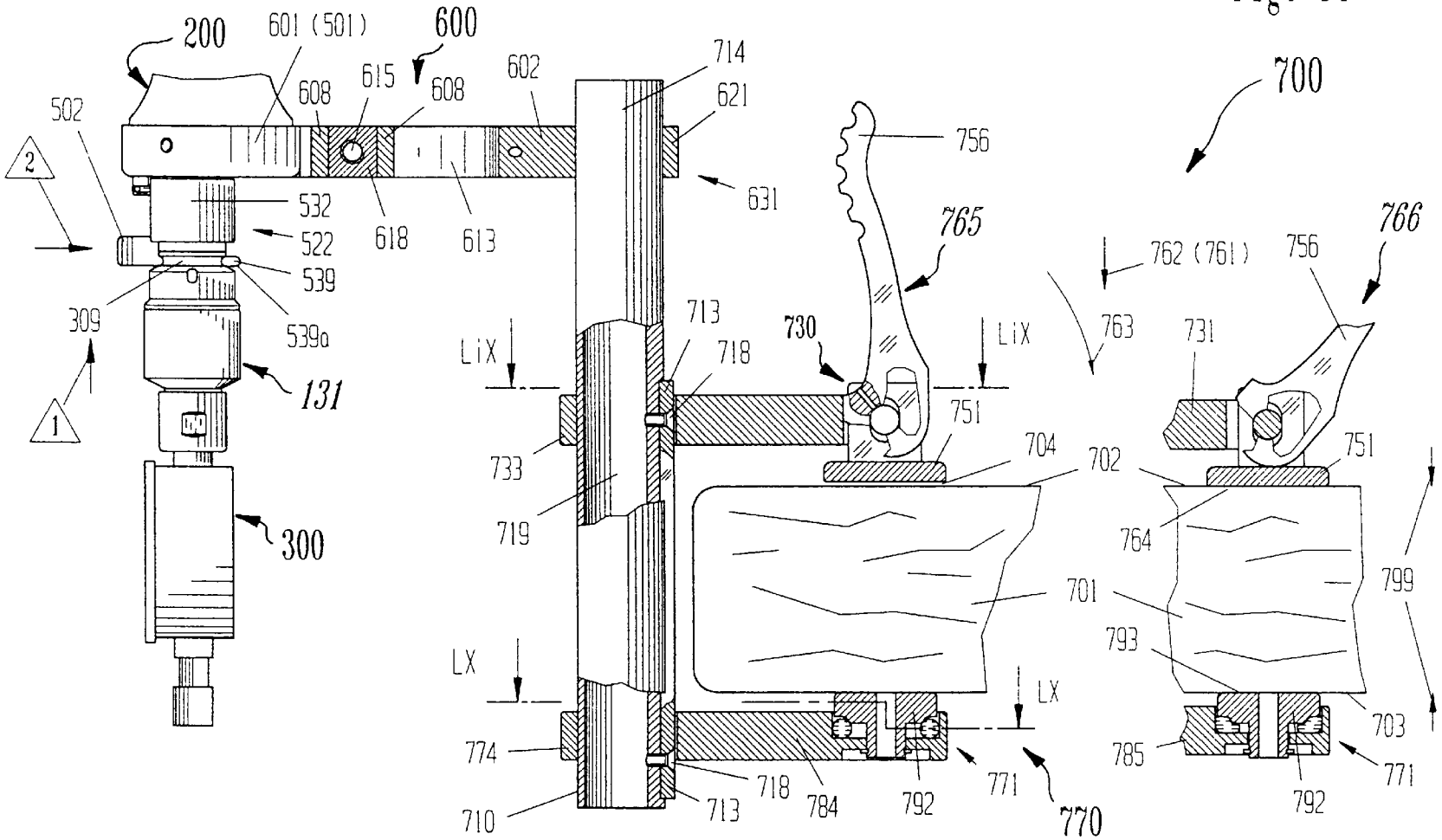

As is shown in FIG. 54, the holding device 700 comprises a yoke 710 to which the clamping holder 600 described above is combinable over the means of fixation 631. At the yoke 710 a geometrical effective clamping device 730 and a jaw block 770 placed oppositely is fixable. The holding device 700 is fixable to a table 701, a plate, a workbench or the like, with an upper surface 702 and a lower surface 703, without damage to the essentially flat surfaces 702, 703 or to leave impressions there. Moreover, the clamping device and the jaw b lock are attachable both with the clamping device upwards as well as downwards, and each opposite the jaw block. Thus, the holding device 700 is always usable to optimum according to the given facts.

Figure 55:
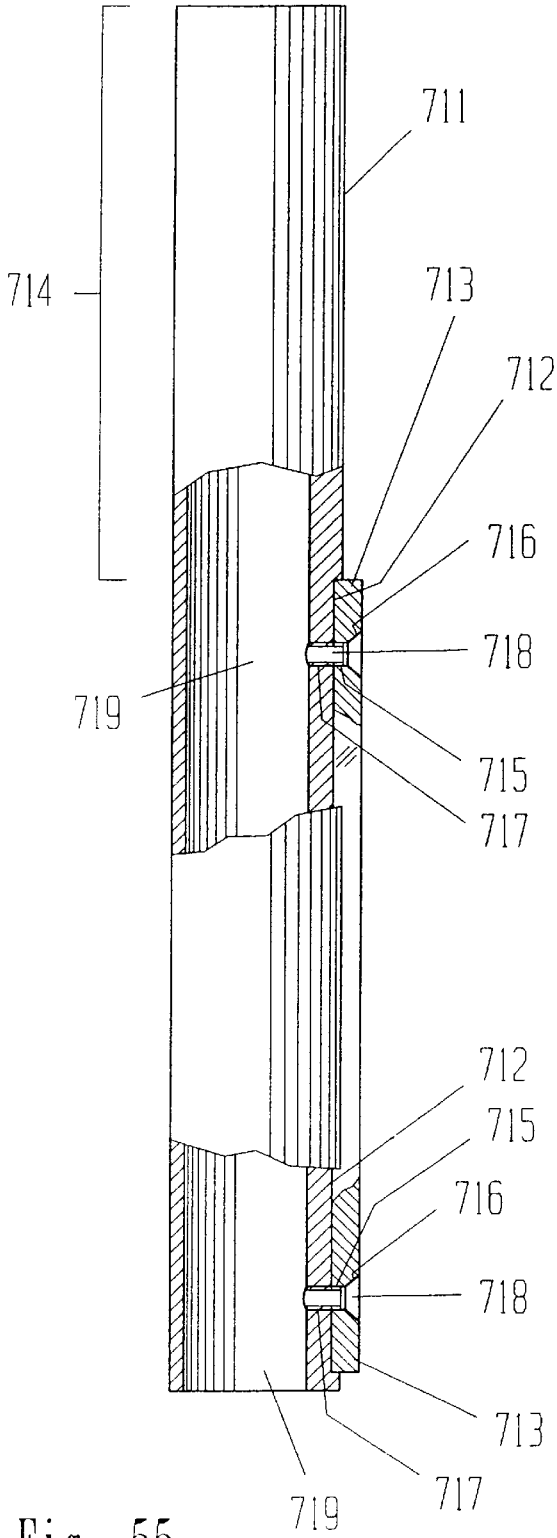

In FIG. 55 the yoke 710 is shown in partially broken up detail built from a tubular body 711 with cylindrical shape. In a longitudinal groove 712 with the axis parallel to the yoke 710 a feather key 713 is arranged which extends over slightly more than half of the length of the yoke 710. This is followed by a cylindrical section 714. The feather key 713 comprises several bores 715 each equipped with a depression 76. At each of the bore locations 715 the yoke 710 comprises internal threads 717. The feather key 713 is fixed in the longitudinal groove 712 by means of counter-sunk screws 718 engaging into the female threads 717.

Figure 56A:
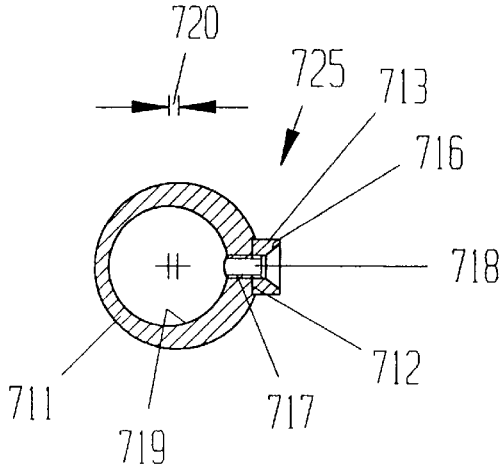

As is to be seen from FIG. 56A the yoke 710 comprises a longitudinal bore 719 which eccentrically passes through the yoke 710 in full length, whereby the eccentricity 720 is arranged in such way, that a larger material thickness remains on the side of the longitudinal groove 712 than on the side opposite to the longitudinal groove 712.

Figure 56B:
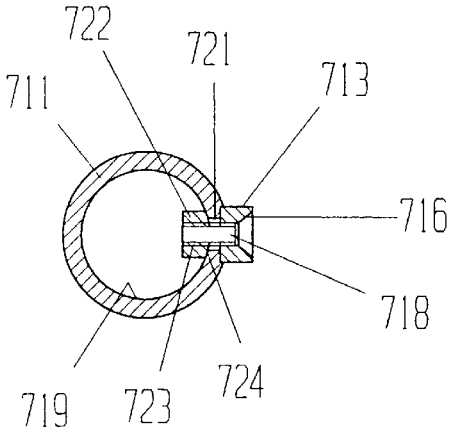

A further alternative of a yoke 710 is shown in FIG. 56B. The longitudinal bore 719 is co-axially arranged. Instead of internal threads 717, a number of through holes 721 are provided, which reach through by the counter-sunk screws 718. Nuts 722 are placed in the longitudinal bore 719 which each comprise an internal thread 723 and a radial contact surface 724 which enter into interaction with the longitudinal bore 719 when the counter-sunk screws 718 are tightened.

The clamping device 730 is shown in FIGS. 57 to 59. A clamping jaw 731 comprises a fixing bore 732 being surrounded by a clamping ring 733, which encircling encompasses and grips the yoke 710. In the fixing bore 732 a groove 734 is arranged which is in guiding interaction with the feather key 713.

The clamping jaw 731 further comprises a tension element 735 in the form of a tension screw 736, placed at 45° in relation to the groove 734, whereby on the one side the tension element 735 reaches through a saddle 737 of the clamping jaw 731 in a bore 738 and on the other side engages with its male thread 739 into an female thread 740. The saddle 737 comprises a slit 741 between the bore 738 and the female thread 740 extending into the fixing bore 732.

At the tension screw 736, a raised spherical surface 742*a* is arranged co-axially to the male thread 739. This is to be seen from FIG. 59, in which the clamping device 730 is shown in a fixing position 766. In the saddle 737, a hollow spherical surface 742*b* is arranged co-axially to the female thread 740, which enters into an equalizing interaction with the raised spherical surface 742*a* preventing lateral forces when actuating the tension element 735.

On the side opposite to the clamping ring 733, the clamping jaw 731 features two webs 743*a*, 743*b* which are each comprising a cheek 744*a*, 744*b* facing each other and forming a slit 745. The webs 743*a*, 743*b* each are interspersed by a cross-bore 746 in which a bolt 747 is arranged. Between the two webs 743*a*, 743*b* a peripheral surface 748 is placed.

The bolt 747 is secured by means of stud screws 749*a*, 749*b* which, depending on the shape of the stud screw heads, features a pointed or orbicular dimple 750*a*, 750*b*, in which the stud screws 749*a*, 749*b* engage.

A clamping foot 751 comprises two tabs 752*a*, 752*b* which are centrally forming a tension slit 753 with a pressure surface 754 at the bottom. The two tabs 752*a* and 752*b* are outside in guided interaction with the cheeks 744*a*, 744*b* of the slit 745 and are each interspersed crossways by an elongated hole 755*a*, 755*b*. The clamping foot 751 is borne on the bolt 747 and movable parallel to the yoke 710 via the elongated holes 755*a*, 755*b*.

Furthermore, an eccentric lever 756 is swivably borne on the bolt 747 in a bearing bore 757. A small oil bore 758 for maintenance purposes ends in the bearing bore 757. The eccentric lever 756 comprises a radial ride surface 759 placed eccentric to the bolt 747 which enters into interaction with the pressure surface 754 in the clamping foot 751 and moves the clamping foot 751 parallel to the yoke 710 towards the tensing direction 761 when the eccentric lever 756 is pressed down, as this is shown in FIGS. 58 and 59.

As is to be seen in FIG. 57, the eccentric lever 756 comprises a stop face 760 which rests on the peripheral surface 748 and represents a non-tensioned initial position 765, from which a clamping movement 762 directed into a tensing direction 761 parallel to the yoke 710 is transmitted to the clamping foot 751 by swiveling the eccentric lever 756 into a swiveling direction 763, and is shifted into the fixing position 766. The clamping foot 751 finally comprises a fixing surface 764 on the side opposite to the tabs 752*a*, 752*b*. Instead of the eccentric lever 763, the clamping foot 751 is also movable with another means of motion, which may carry out and hold a geometrical clamping movement 762.

The FIGS. 60 to 62B are showing the jaw block 770, which is comprising a means of pressure compensation 771 in the form of an elastically deformable elastomeric ring 772 which is effective in tensing direction 761. The means of pressure compensation 771 causes a geometrical compensation while actuating the clamping device 630 from the non-tensioned initial position 799*a* into the fixing position 799*b*.

Like the clamping jaw 730, the jaw block 770 also comprises a fixing bore 773, which is surrounded by a clamping ring 774 which encompasses encircling the yoke 710 and is actuable by a tension element 776 in the form of a tension screw 777. Furthermore, the fixing bore 773 comprises a groove 775 which is in guiding interaction with the feather key 713. The tension element 776 is arranged at a 45° inclined with respect to the groove in order not to apply lateral forces onto the groove while clamping. The tension screw 777 on the one side interspersed a saddle 778 of the jaw block 770 in a bore 779 and on the other sides engages with an male thread 780 into an female thread 781. The saddle 778 comprises a slit 782 between the bore 779 and the female thread 781 reaching up to the fixing bore 773. The tension screw 777 comprises a raised spherical surface 783*a* which is arranged co-axially to the male thread 780 as is especially to be seen from FIG. 61. With respect to the bore 779 a hollow spherical surface 783*b* is arranged co-axially in the saddle 778, which enters into an equalizing interaction with the raised spherical surface 783*a* while tensioning the tension screw 777 so that the entry of lateral forces on the tension screw 777 is avoided to a large extent.

On the side opposite to the fixing bore 773 the clamping jaw 731 comprises an eye 785 which is enlarging in hollow-arch form, going out from a web section 784. Inside the eye 785 a depression 786 is placed centrically at the upper side, which is interspersed at its bottom 788 by a bore 789 placed centrically with respect to the depression 786. A flat depression 790 is provided opposite. A guide pin 791 a pressure plate 792 intersperses the bore 789, whereby the pressure plate partly dips into the depression 786.

The pressure plate 792 comprises on the outside opposite to the guide pin 791 a pressure surface 793 and a centrically placed hole 794 for weight reduction. As is especially to be seen from FIG. 62 A the pressure plate 792 features on the side facing the bottom 788 an S-bended contour 796 with a raised arch 796*a* and a hollow arch 796*b*. An elastomeric ring 772 rests on the one hand close to the bottom 788 as well as in the depression 786 and on the other hand on the raised arch 796*a*, representing a neutral initial position 799*a*. This position is fixed by a securing ring 797 which is on the one hand in contact with the flat depression 790 and on the other hand is held in a groove 798 in the guide pin 791.

In FIG. 62B, the eye 785 of the jaw block 770 is shown in tensioned position 799*b*, accordingly with the eccentric lever 756 moved in swivel direction 763. It is clearly recognizable that the elastomeric ring 772 under the influence of the clamping movement 762 snuggly fits to the S-bended contour 796, to the bottom 788 and to the depression 786, whereby strain energy is applied to the elastomeric ring 772. The strain energy is well controllable via the shape of the contour 772 or the elastomeric ring 772 and by the material of the ring. At higher forces are applied, force storage elements in the form of spiral or belleville springs are usable.

The function of the holding device 700 is explained in summary by reference to FIG. 54. At the yoke 710, the clamping holder 600 is fixed with its clamping ring 621 by the means of fixation 631 in the cylindrical region 714.

The clamping jaw 731 of the clamping device 730 encircling encompasses the yoke 710 with its clamping ring 733, centered approximately in the area of the feather key 713 and is fixed with the tension element 735 to the yoke 710. The jaw block 770 encompasses the yoke 710 with its clamping ring 774 at the lower end in the area of the feather key 713 and is fixed at the yoke 710 with the tension element 776 in such way that, when slipped onto the table 701 a fixing gap 704 remains.

The holding device 700 is slipped onto the table 701 in the desired position and the eccentric lever 756 is actuated from above into swivel direction 763, whereby the clamping foot 751 is lowered. Hereby the fixing surface 764 gets into contact with the upper surface 702 of the table 701 on the one hand, and the pressure surface 793 of the pressure plate 792 with the lower surface 703 of the table 701 on the other hand, and the geometrical clamping movement 762 is converted at a uniform development of a tension force 799 into strain energy of the elastic means of pressure compensation 771. If the eccentric lever 756 is turned contrary to the swivel direction 763 until the stop face 760 is in touch with to the peripheral surface 748 and the non-tensioned initial location 765 has been reached, the holding device 700 is easily removable from the table 701 without damaging the surfaces 702, 703.

All operations necessary for setting up the holding device 700 are comfortably executable from above or from the side. If needed, the jaw block 770 is also placable upwards and the clamping device 730 downwards.

The container 200 with the closure cap 501 is surrounded in the clamping holder 600 by the arms 603, 604 the tension screw 615 is actuated and the clamping holder 600 held in tensioned position 686. The dosing unit 300 is inserted into the means of association 522. The notch collar 535 of the means of locking 532 is moved out from the recess 540 and the latching released. Thus, the closure 500 is now in the filling position 131. The means of actuating 502 is just before actuation, at which the means of holding 539 engages into the annular groove 309.

Figure 63:
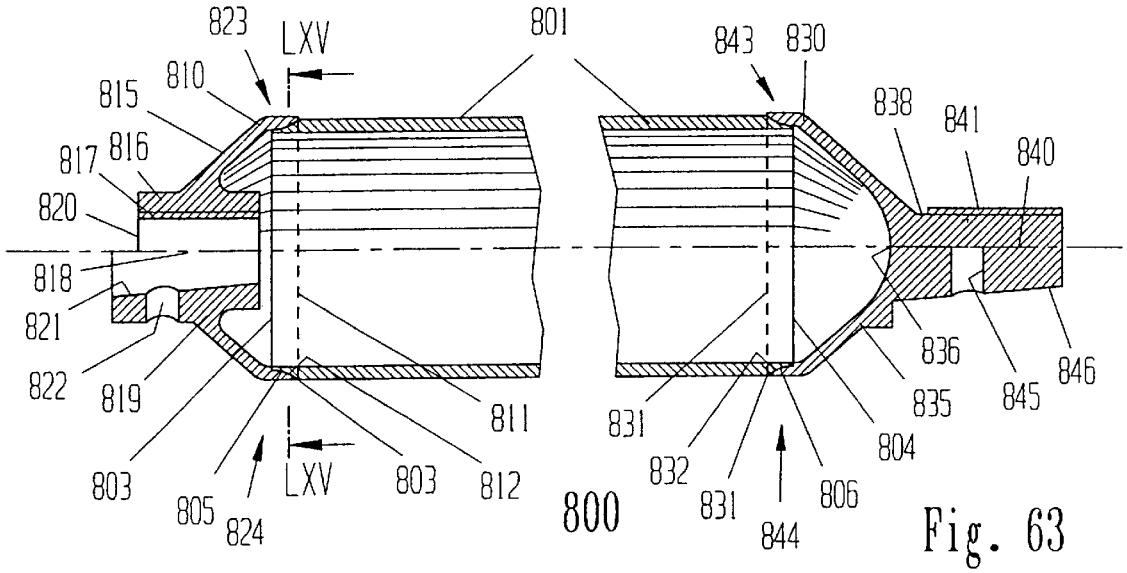
Figure 64:
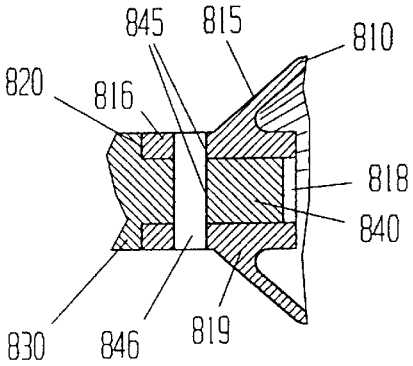
Figure 65:
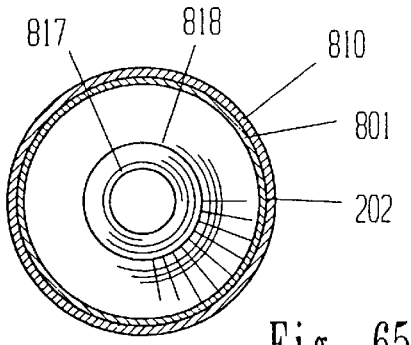

A further embodiment of the adhesive-joint 202 on a strut 800 is realized in FIGS. 63 to 66, in a lightweight construction part in the form of a strut 800 for a support structure. FIG. 64 shows the strut 800 with to different performed head-parts 810, 830. A tube body 801 is connected with a first head-part 810 and a second head-part 830 by means of an adhesive-joint 202. Both head-parts 810, 830 are comprising cone sections 815, 835 on the inside.

In a first embodiment (upper half-cut of FIG. 63) the cone section 815 passes each into a connection throat 816, which is interspersed by a bore 818 equipped with an female thread 817. A circulating load bridge 819 is arranged between the cone section 815 and the connection throat 816, whereby a frontal surface 820 is bordering the connection throat 816 perpendicular to the female thread 817.

The cone section 835 of the head-part 830 is terminated by a load dome 836, whereby a pin 840 aligned to the strut 800 is arranged opposite to the load dome 836, with a thread 841 which is provided with a thread groove 842.

In a second embodiment (lower half-cut of FIG. 60) the bore 818 of the head-part 810 comprises a cone 821 interspersed by a cross-bore 822. The pin 840 of the head-part 830 comprises a cone as holding element 846, whereby the cone angle is preferably composed in the range of 1:10 to 1:50. The cone connection is easily releasable by a screwdriver or the like inserted into the cross-bore 845.

In FIG. 64, a third embodiment of the head-parts 810, 830 is shown. The connection throat 816 is axially interspersed by a cylindrical bore 818 into which a cylindrical pin 840 engages. A holding element 846 in the form of a spring pin intersperse the connection throat 816 and the pin 840 in a cross-bore 845. As a holding element also split pins may be applied for a fast plug-in connection.

The struts are thus combinable with each other, by either bringing the head-parts into interaction with the threads 817 and 841 or via the cones 821 and 846 with each other, or with the known knot elements of support structures.

The tube body 801 comprises along a surrounding rim 803, 804 (frontal faces) each the half of a concave circle segment 805, 806 each, and the head-parts 810 and 830 along a surrounding rim 811, 831 each the half of a convex circle segment 812, 832, whereby the circle segments 805, 812 as well as 806, 832 are arranged facing each other. The circle segments 812 and 832 are comprising geometrical center point locations which are defined by intersection points 814, 834 of the surface normals 813, 833 being perpendicular to the circle tangents 813*a*, 833*a* with respect to the surrounding rim 803, 804 of the tube body 801. From FIG. 65 it is to be seen that the tube body directed inwards engages into the head-parts 810 and 830 respectively.

Figure 66:
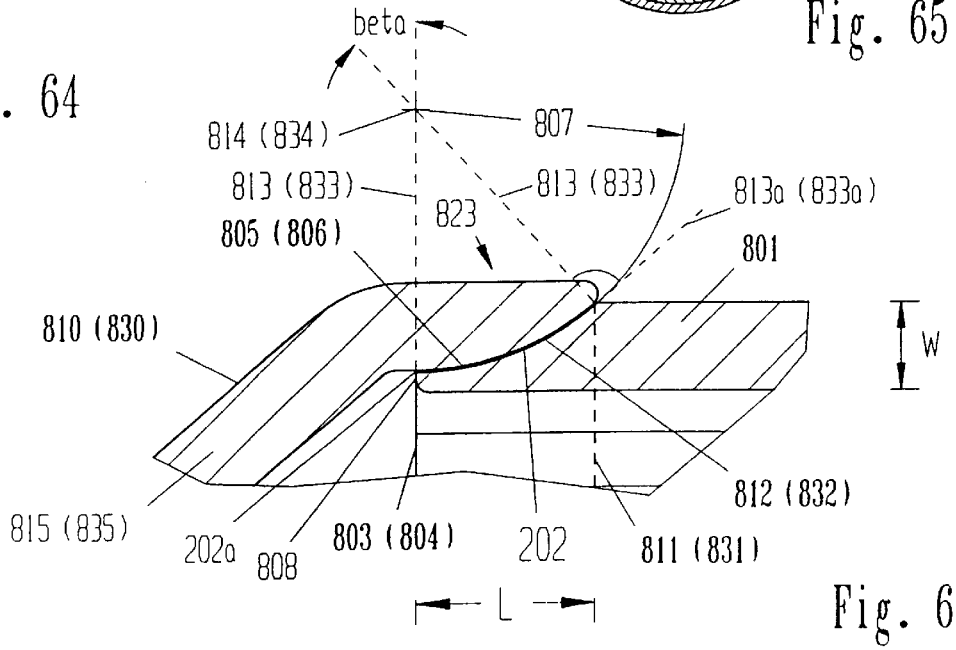
Figure 67:
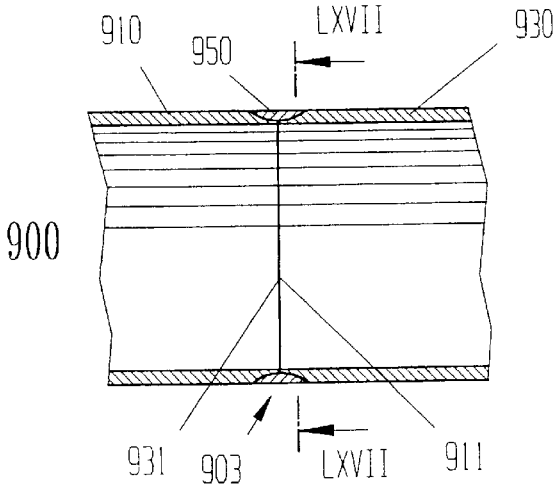
Figure 68:
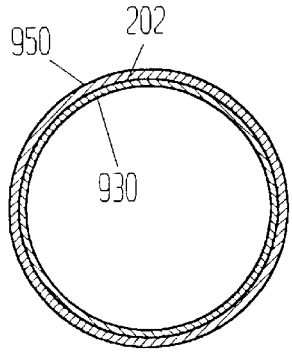

As is visible from FIG. 66, the circle segments 805 and 812 as well as 806 and 832 are entering with a radius 807 each perpendicular to the surrounding rim 811 and 831 into it, then follow an angle section beta and run out at the rim 811, 832 of the head-parts 810, 830. In this way, a secant-half length L is created which extends from one edge 803, 804 of the tube body 801 to the corresponding rim 811, 831 of the respective head-part. The extension of the secant-half length L is dependent on the wall-thickness W of the tube body 801 and may take at maximum the amount of radius 807.

At the surrounding rim 803, 804 remains a web 808 which in dependence of the radius 807 and a coefficient of correction Kx is following the equation (4), whereby Kx is in the range of about 0.01 to 0.5 and is dependent on the strength of the tube body 801, the head-part 810, 830 and of the structure-adhesive used. Since adhesive-joints are subject to a number of parameters a universal dimensioning is not to be provided. For an experimental initial situation with bigger tubes of a wall-thickness W of about 10 mm and more, the following values are appropriate: sector-half angle beta about 40°, radius 807 about 35 mm, secant-half-length L about 25 mm and Kx about 0.05.

The adhesive-joint 202 occurs between the congruent circle segments 805 and 812 as well as 806 and 832 through application of structure-adhesive, whereby a gluing gap 202*a* is to be dimensioned in accordance with the used adhesive.

The arrangement of the circle segments with the web 808 within the head-parts in general has the advantage that the adhesive-joint 202 is well protected by the encircling material of the head-parts from exterior influences such as strokes or climate.

In the upper half of FIG. 63, a clincher 823, 843 is arranged opposite the convex circle segments 812, 832, which serve to strengthen the adhesive-joint 202 against hit effects and protect it accordingly. In the lower half of FIG. 63 a flush passing 824, 844 in the web section 808 is shown.

A further embodiment of the adhesive-joint 202 on a tube 900 is shown in FIGS. 67 to 70B on the example of a tube 900 with two tube bodies 910, 930 which are connected to a connection element in the form of a circle segment ring 950. The tube bodies 910, 930 comprise along a surrounding rim 911, 931 (frontal faces) each one half of a congruent, concave circle segment 912, 932 facing each other, which together form a radially surrounding groove 903 in circle-segment shape.

The circle segments 912, 932 are comprising surface normals 913, 933 which jointly intersects at an intersection point 905 and constitute the geometrical center point location of the circle segments. The surface normals stand each vertical to the tangents 914 and 934 of the circle segments.

Figure 69:
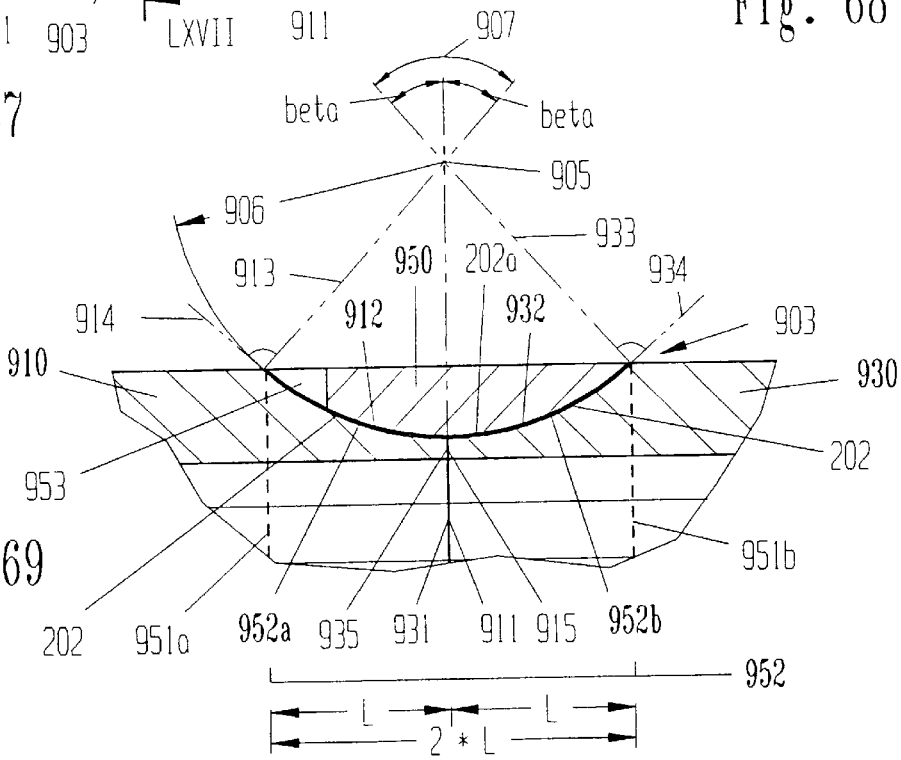

As is to be seen from FIG. 69, the concave circle segments 912, 932 each begin perpendicular at the surrounding rim 911 and 931. Each of the circle segments 912, 932 are following along an angle section beta with a radius 906 up to an edge 951*a*, 951*b* of the circle segment ring 950.

Figure 70A:
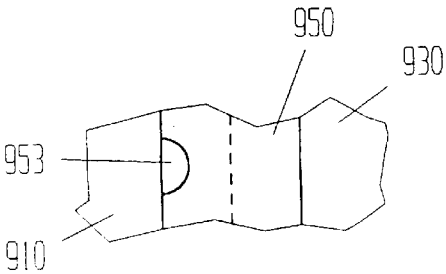

The groove 903 surrounding radially at the rims 911 and 931 is created by the two concave circle segments 912, 932 extending over the two of secant-half L lengths, reaching from the surrounding rim 911 to the edge 951 a and from the rim 931 up to the edge 951*b*. A circle segment ring 950 is arranged in the groove 903, which extends via a central angle 907 of 2 * beta from the edge 551*a* up to the edge 551*b* and features a circle segment 952 being congruent convex to the circle segments 912, 932 and symmetric to the surrounding rims 911, 931. The circle segment ring 950 is developed in endless ring-shape and is glued together in the groove 903 with the concave circle segments 912, 932 of the components 910, 930 by a structure-adhesive. The adhesive-joint 202 occurs between the congruent circle segments 912, 932 and 952 with a structure-adhesive. The circle segment ring 950 for this purpose comprises a filling hole 953 in the form of a half-circle bore, as shown in FIGS. 69 and 70A, into which the structure-adhesive is fillable leaving without protrusions.

Figure 70B:
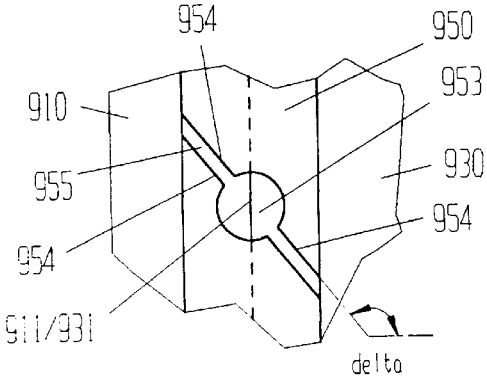

In FIG. 70B, the circle segment ring 950 having finite ring-shape is inserted in into the groove 903, whereby this is comprising at each end a bordering edge 954, which is saw-set at an angle delta. The bordering edges 954 form a joint 955 to which the filling hole 953 is symmetrically associated.

On the rims 911, 931 a web 915, 935 each remains at the tube bodies 910, which in dependence of the radius 906 and a coefficient of correction Kx is following the equation (4), whereby Kx is in the range of about 0.01 to 0.5 and is dependent on the strength of the tube bodies 910, 930, of the circle segment ring 950 and of the used structure-adhesive. At a viscous adjustment of the adhesive, it also passes through between the web 915, 935 and into the joint 954 respectively and results in a joint-sealed adhesive connection 202. The above mentioned is also valid for the dimensioning of the adhesive-joint 202.

If a static charge is undesirable, thus an anti-static additive is addable to the structure-adhesive, preferably in the form of nodular graphite, whereby the durability of the adhesive-joint is practically not derogated.

As a structure-adhesive for the adhesive-joint 202 disclosed here, a two-component adhesive with an adhesive consisting of methacrylat-ester and methacryl-acid and a hardener of a ketone-solvent and an amino-aldehyde-condensation medium is universally usable.

In the disclosure, the arrangement according to the invention for dosing substances is described at length and shown in the figures. Since the handling of dangerous substances in the form of propellants, explosives and the like also depends on numerous marginal conditions and circumstances, such as the site of use, the prevailing climate etc. and finally on the properties of the substance itself, it is up to the person skilled in the art to make the selection of the specific rendering according to the principles of the workers protection regulations. The embodiments shown in the FIGS. are to be understood as incitement and are combinable among one another.

The arrangement with means of holding is usable in particular when the hazard is insignificant, such as in laboratories with highly qualified specialists, whether the closure would be activated unintentionally, thus only the locking (means of holding 539) of dosing unit and closure is essential, as for achievement of precisely and rapidly repeatable quantities. Such a arrangement is preferably be operated according to the use shown in FIG. 41A.

If the closure is always in danger of being activated unintentionally, for instance in the field or the like, whereby no increased accuracy is required with respect to the repetitive accuracy of the quantity, but rather the transportation security and the availability of substance is of high priority, the with a means of unintentionally, thus only the locking (means of holding 539) of dosing unit and closure is essential, as for achievement of precisely and rapidly repeatable quantities. Such a arrangement is preferably be operated according to the use shown in FIG. 41A.

If the closure is always in danger of being activated unintentionally, for instance in the field or the like, whereby no increased accuracy is required with respect to the repetitive accuracy of the quantity, but rather the transportation security and the availability of substance is of high priority, the with a means of locking 532 is preferred. Such a arrangement is preferentially operated according to the use specified in FIG. 41B.

Figure 20:
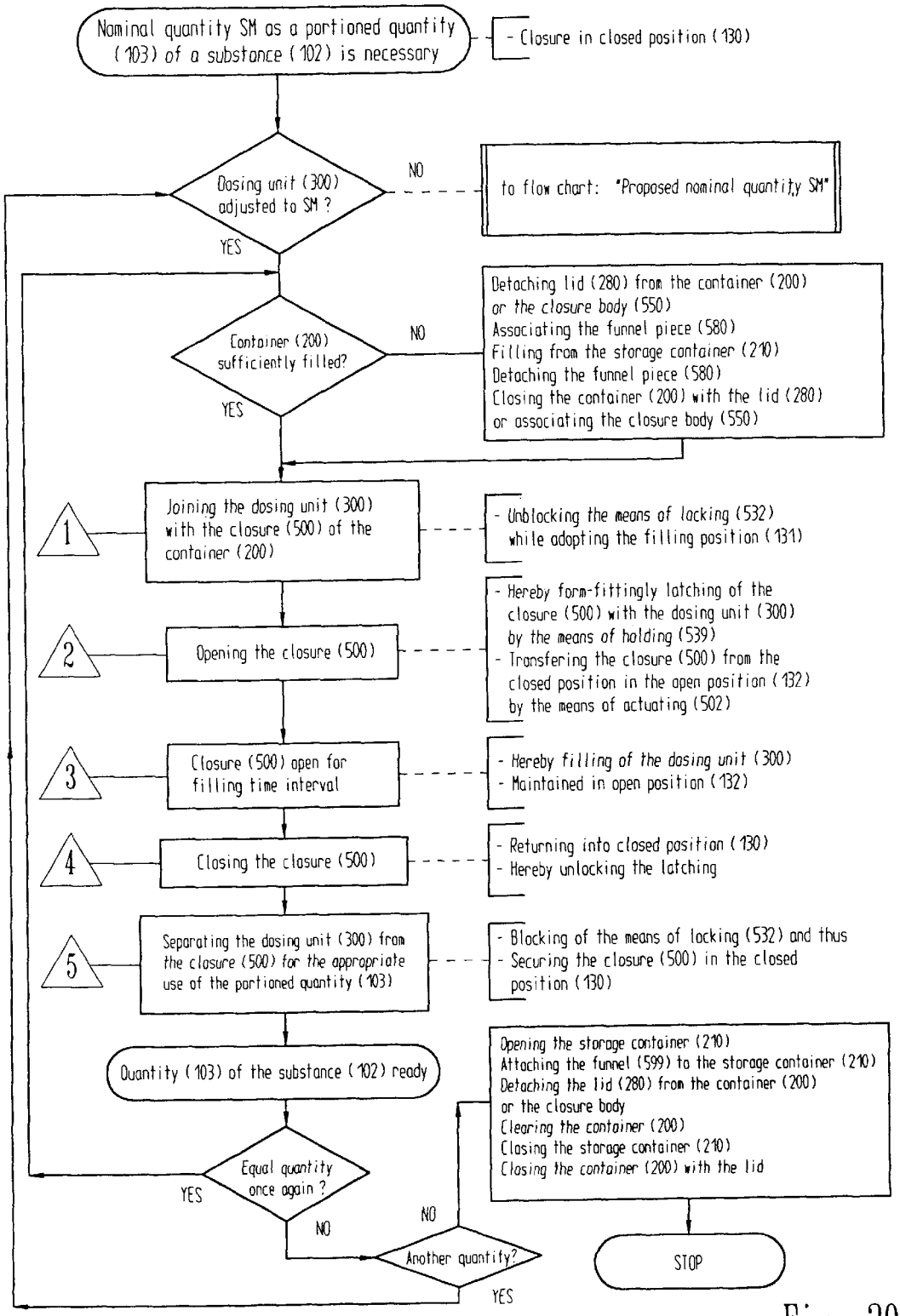

If, however, the hazard of unintentional releasing of substance is to be definitely excluded and simultaneously the requirement for precise quantities, being possibly uniform to one another and a highest degree of handling security, should be fulfilled, that is, the best arrangement provided with a means of locking and a means of holding and is operated according to the uses specified (FIG. 20).

All described examples of embodiments of the container of the arrangement have in common that towards the bleeding side, the inwards directed field of lateral force is constituted, which holds the filling pressure relatively constant and tendentiously cracks up clots. The further embodiment for instance of the head-, the bottom-part, the adhesive-joint or a one-piece type is to be determined, on the one hand, according to the substance to be dosed and on the other hand according to the desired batch sizes of the device. The one-piece solution requires at least an appropriate production tool, the multi-sectional design on the other hand is well suited for particularly precise devices in smaller piece number. The two developments are as such functionally equal to one another.

Furthermore, the container is preferably held in the disclosed clamping holder 600 and the latter held in the disclosed holding device 700 standing vertically with the closure 500 or with the closure piece 550, respectively set downwards in the optimal feed (field of lateral force) of the substance is guaranteed. The arrangement 100 is preferably operated according to the disclosed uses.

Accordingly, the present invention exhaustingly solves the problems occurring with the handling of pourable substances, particular such as propellants, explosives or gunpowder, as described at the beginning.

Although the description above contains many specificites, these should not be construed as limiting the scope of the invention but as merely providing illustrations of some of the presently preferred embodiments of this invention. Thus the scope of the invention should be determined by the appended claims and their legal equivalents, rather than by the examples given.

List of reference signs

| | |
|---|---|
| i | logic node no. first |
| ii | logic node no. second |
| iii | logic node no. third |
| iv | logic node no. fourth |
| v | logic node no. fifth |
| vi | logic node no. sixth |
| Kx | coefficient of correction |
| L | secant-half-length |
| SM | desired nominal quantity |
| RM | residual quantity |
| TM | partial quantity |
| VG | volume related piled weight |
| W | wall thickness |
| WV | effective volume (320) |
| alpha | angle of inclination |
| beta | sector-half angle |
| gamma | sector angle (1 to 8) |
| delta | fleam angle |
| 69 | cylindrical storage container |
| 70 | container body |
| 71 | lid |
| 72 | holding thread |
| 73 | valve body |
| 74 | connection thread |
| 75 | closure piece |
| 76 | operating device |
| 77 | passage-opening |
| 78 | connecting path |
| 79 | pressure spring |
| 80 | bore |
| 81 | outlet channel |
| 89 | measure of capacity |
| 90 | cylindrical tube |
| 91 | measuring chamber |
| 92 | slider |
| 93 | knurling |
| 94 | square cross-section |
| 95 | passage area |
| 96 | pressure screw |
| 97 | measuring scale |
| 98 | cap |
| 100 | device for dosing of a substance |
| 102 | pourable material |
| 103 | portioned quantity |
| 104 | connecting path |
| 105 | association path |
| 106 | connecting path |
| 107 | association path |
| 108 | connecting path |
| 109 | association path |
| 110 | connecting path |
| 112 | combination path |
| 114 | connecting path |
| 115 | connecting path |
| 116 | connecting path |
| 117 | connecting path |
| 118 | connecting path |
| 119 | connecting path |
| 120 | connecting path |
| 121 | connecting path |
| 123 | connecting path |
| 124 | connecting path |
| 130 | closed position |
| 131 | filling position |
| 132 | open position |
| 200 | container |
| 201 | container body |
| 202 | adhesive-joint |

-continued

| List of reference signs | |
|---|---|
| 202a | gluing gap |
| 203 | surrounding rim |
| 204 | concave circle segment |
| 205 | bleeding side |
| 208 | web |
| 210 | storage container |
| 211 | opening |
| 212 | tipping direction |
| 250 | head-part |
| 251 | uptake |
| 252 | internal area |
| 253 | tapered off section |
| 254 | filling pressure |
| 255 | field of lateral force |
| 256 | entrance cross-section |
| 257 | outlet cross-section |
| 258 | portion with constant cross section |
| 259 | expanding section |
| 261 | surrounding rim |
| 262 | half convex circle segment |
| 263 | surface normal |
| 264 | half concave circle segment |
| 265 | intersection point/center point location |
| 266 | radius |
| 267 | clincher |
| 268 | plane passage |
| 270 | bottom-part |
| 271 | funnel-shaped section |
| 272 | convex cone bow |
| 273 | opening |
| 274 | female thread |
| 275 | plane surface |
| 276 | male thread |
| 277 | throat |
| 278 | surrounding rim |
| 279 | half concave circle segment |
| 280 | lid |
| 281 | female thread |
| 282 | interior end |
| 283 | groove with radial cross section |
| 284 | sealant |
| 285 | ventilation bore |
| 286 | groove with radial cross section |
| 287 | O-ring |
| 290 | mooring surfaces |
| 300 | modular dosing unit |
| 301 | measuring chamber |
| 302 | female thread |
| 303 | plane surface |
| 304 | grooves |
| 305 | end surface |
| 306 | association collar |
| 307 | stop collar |
| 308 | stop face |
| 309 | surrounding annular groove |
| 310 | measuring cavity |
| 310a | cylindrical section |
| 310b | conical section |
| 311 | measuring part |
| 312 | large measuring part |
| 313 | base part |
| 314 | bung piece |
| 315 | fit bore |
| 316 | gap |
| 320 | effective volume (WV) |
| 321 | pick up female thread |
| 322 | thread groove |
| 323 | plane stop face |
| 324 | throat |
| 325 | measuring cavity |
| 326 | technical length |
| 330 | tenter tool |
| 331 | bore |
| 332 | plane surface |
| 333 | centering section |
| 334 | tapered arch contour |
| 335 | external annular groove |

-continued

| List of reference signs | |
|---|---|
| 336 | polymeric ring |
| 337 | tappet |
| 338 | polymeric strip |
| 340 | measure carrier |
| 341 | base body |
| 342 | means of measuring |
| 343 | locking device |
| 344 | uptake section |
| 345 | uptake bore |
| 346 | shank |
| 347 | outer thread |
| 348 | cone section |
| 349 | cone section |
| 350 | clearing turn |
| 351 | bores |
| 352 | longitudinal slots |
| 353 | lock nut |
| 354 | female thread |
| 355 | thread undercut |
| 356 | congruent cone |
| 357 | key surfaces |
| 358 | measuring rod |
| 359a, b | guides |
| 360 | stopper |
| 361 | pointer |
| 362 | scale |
| 363 | numeral dial |
| 363a | unit imprint |
| 363b | vernier |
| 363c | digital display |
| 364 | clamping device |
| 365 | connecting section |
| 366 | male thread |
| 367 | collar plane |
| 368 | depression |
| 369 | depression ground |
| 371 | plane surface |
| 372 | female thread |
| 373 | slider |
| 374 | stop face |
| 375 | thread pin |
| 376 | fixing bore |
| 377 | plate |
| 378 | plate surface |
| 379 | blind hole |
| 380 | tentering pin |
| 381 | cross-bore |
| 382 | male thread |
| 383 | securing ring |
| 384 | groove |
| 385 | female thread |
| 386 | tension screw |
| 387 | pressure surface |
| 388 | contact surface |
| 389 | flat depression |
| 390 | polygon-radial groove |
| 391 | rounded corners |
| 392 | shock-damping means of absorption |
| 393 | oblong rest |
| 394 | centering collar |
| 395 | centering surface |
| 400 | socket group |
| 401 | frontal surface |
| 402 | male thread |
| 403 | non supporting section |
| 404 | extension |
| 405 | female thread |
| 406 | induction driving face |
| 408 | relieve groove |
| 410 | socket |
| 411 | measuring cavity |
| 420 | socket |
| 421 | measuring cavity |
| 430 | socket |
| 431 | measuring cavity |
| 440 | socket |
| 441 | measuring cavity |

-continued

| List of reference signs | |
|---|---|
| 450 | socket |
| 451 | measuring cavity |
| 500 | closure |
| 501 | closure cap |
| 502 | means of actuating |
| 504 | swivable closure piece |
| 506 | depression |
| 507 | stud screw |
| 508 | bearing bore |
| 509 | closure piece pin |
| 510 | radial stop |
| 511 | spring-seat |
| 512 | spring unit, torsion spring, pressure spring |
| 513 | connecting pin |
| 514 | tappet pin |
| 515 | tappet bore |
| 516 | spring eye |
| 517 | spring pin |
| 518 | stop |
| 519 | end stop |
| 520 | opening direction |
| 521 | sweeping lip |
| 522 | means of association |
| 523 | centering body |
| 524 | outer thread |
| 525 | female thread |
| 526 | collar |
| 527 | opening |
| 528 | recessing guide surface |
| 529 | additional guide surface |
| 530 | key surfaces |
| 531 | pressure spring |
| 531a | pressure spring lead |
| 532 | means of locking |
| 533 | first inner bearing surface |
| 534 | second inner bearing surface |
| 535 | notch collar |
| 536 | notch plane |
| 537 | stop face |
| 538 | locking means' notch |
| 539 | means of holding |
| 539a | convex locking element |
| 540 | radial recess |
| 541 | pressure surface |
| 542 | longitudinal stop |
| 543 | sweeping bezel |
| 544 | swiveling range |
| 550 | closure body |
| 551 | connection thread |
| 552 | channel |
| 553 | closure slide |
| 554 | push button |
| 555 | pressure spring |
| 556 | passage aperture |
| 557 | centering bore |
| 558 | finger |
| 559 | guide bore |
| 560 | support shoulder |
| 561 | compensation bearing |
| 563 | guide bore |
| 564 | notch groove |
| 565 | locking means' throat |
| 567 | locking stud guide |
| 568 | holding-pin |
| 569 | cross bore |
| 570 | adjustable measure of capacity |
| 571 | circular collar |
| 580 | funnel piece |
| 581 | male thread |
| 582 | front surface |
| 583 | centering collar |
| 584 | centering surface |
| 585 | funnel bow |
| 586 | funnel cone |
| 587 | strengthening collar |
| 588 | opening |
| 589 | contact collar |

-continued

| List of reference signs | |
|---|---|
| 599 | funnel |
| 600 | clamping holder |
| 601 | object |
| 602 | holder body |
| 603 | arm |
| 604 | arm |
| 605 | slit |
| 606 | open space |
| 607 | continuous bow |
| 608 | thickening |
| 609 | cross bore |
| 610 | saddle |
| 611 | rigid bridge |
| 612 | end bow |
| 613 | spring element |
| 614 | through hole |
| 615 | tension screw |
| 616 | male thread |
| 617 | means of compensation |
| 618 | clasp nut |
| 619 | female thread |
| 620 | fixing bore |
| 621 | clamping ring |
| 622 | end of the clamping ring |
| 623 | additional saddle |
| 624 | additional cross bore |
| 625 | additional thickening |
| 626 | slit |
| 627 | female thread |
| 628 | means of clamping |
| 629 | tension screw |
| 630 | male thread |
| 631 | means of fixation |
| 632 | raised spherical surface |
| 633 | raised spherical surface |
| 634 | hollow spherical surface |
| 635 | hollow spherical surface |
| 636 | means of compensation |
| 641 | contact area |
| 642 | contact area |
| 643 | clamping sector |
| 644 | clamping sector |
| 645 | non-tightening area |
| 646 | non-tightening area |
| 647 | integral spring unit |
| 648 | integral spring unit |
| 650 | center point |
| 65! | radius |
| 652 | radius |
| 653 | horizontal distance |
| 654 | symmetry line |
| 660 | further center point |
| 661 | radius |
| 662 | radius |
| 663 | vertical distance |
| 665 | center point |
| 666 | center point |
| 667 | radius |
| 668 | radius |
| 669 | horizontal distance |
| 671 | center point |
| 672 | center point |
| 673 | vertical distance |
| 675 | radius |
| 676 | radius |
| 681 | gap |
| 682 | gap |
| 685 | non-tensioned initial position |
| 686 | tensioned position |
| 687 | continuous curvature |
| 690 | four-point bearing |
| 691 | tension force |
| 692 | outside diameter |
| 700 | holding device |
| 701 | table |
| 702 | upper surface |
| 703 | lower surface |

-continued

| List of reference signs | |
|---|---|
| 704 | fixing gap |
| 710 | yoke |
| 711 | tubular body |
| 712 | longitudinal groove |
| 713 | feather key |
| 714 | cylindrical region |
| 715 | bores |
| 716 | depressions |
| 717 | female thread |
| 718 | flat-head screws |
| 719 | longitudinal bore |
| 720 | eccentricity |
| 721 | through holes |
| 722 | nuts |
| 723 | female thread |
| 724 | contact surface |
| 725 | great material thickness |
| 730 | clamping device |
| 731 | clamping jaws |
| 732 | fixing bore |
| 733 | clamping ring |
| 734 | groove |
| 735 | tension element |
| 736 | tension screw |
| 737 | saddle |
| 738 | bore |
| 739 | male thread |
| 740 | female thread |
| 741 | slit |
| 742a | raised spherical surface |
| 742b | hollow spherical surface |
| 743a, b | webs |
| 744a, b | cheek |
| 745 | slit |
| 746 | bore |
| 747 | bolt |
| 748 | peripheral surface |
| 749a, b | stud screws |
| 750a, b | dimple |
| 751 | clamping foot |
| 752a, b | tab |
| 753 | tension slit |
| 754 | pressure surface |
| 755a, b | elongated hole |
| 756 | eccentric lever |
| 757 | bearing bore |
| 758 | oil bore |
| 759 | radial ride surface |
| 760 | stop face |
| 761 | tension direction |
| 762 | clamping movement |
| 763 | swivel direction |
| 764 | fixing surface |
| 765 | non-tensioned initial position |
| 766 | fixing position |
| 770 | jaw block |
| 771 | means of pressure compensation |
| 772 | elastomeric ring |
| 773 | fixing bore |
| 774 | clamping ring |
| 775 | groove |
| 776 | tension element |
| 777 | tension screw |
| 778 | saddle |
| 779 | bore |
| 780 | male thread |
| 781 | female thread |
| 782 | slit |
| 783a | raised spherical surface |
| 783b | hollow spherical surface |
| 784 | web section |
| 785 | eye |
| 786 | depression |
| 788 | bottom |
| 789 | centrically bore |
| 790 | flat depression |
| 791 | guide pin |

-continued

| List of reference signs | |
|---|---|
| 792 | pressure plate |
| 793 | pressure surface |
| 794 | hole |
| 796 | S-bended contour |
| 796a | raised arch |
| 796b | hollow arch |
| 797 | securing ring |
| 798 | groove |
| 799 | tension force |
| 799a | neutral initial position |
| 799b | tensioned position |
| 800 | strut |
| 801 | tube body |
| 803 | surrounding rim |
| 804 | surrounding rim |
| 805 | half concave circle segment |
| 806 | half concave circle segment |
| 807 | radius |
| 808 | web |
| 810 | head-part |
| 811 | surrounding rim |
| 812 | convex circle segment |
| 813 | surface normal |
| 813a | circle tangent |
| 814 | intersection point, center point location |
| 815 | cone section |
| 816 | connection throat |
| 817 | female thread |
| 818 | bore |
| 819 | load bridge |
| 820 | frontal surface |
| 821 | cone |
| 822 | cross bore |
| 823 | clincher |
| 824 | flush passing |
| 830 | head-part |
| 831 | surrounding rim |
| 832 | convex circle segment |
| 833 | surface normal |
| 833a | circle tangent |
| 834 | intersection point/center point location |
| 835 | cone section |
| 836 | load dome |
| 840 | pin |
| 841 | thread |
| 842 | thread groove |
| 843 | clincher |
| 844 | flush passing |
| 845 | cross bore |
| 846 | holding element |
| 900 | tube |
| 903 | circulating groove |
| 904 | circle segment |
| 905 | intersection point/center point location |
| 906 | radius |
| 907 | central angle |
| 910 | tube body |
| 911 | surrounding rim |
| 912 | concave circle segment |
| 913 | surface normal |
| 914 | circle tangent |
| 915 | web |
| 930 | tube body |
| 931 | surrounding rim |
| 932 | concave circle segment |
| 933 | surface normal |
| 934 | circle tangent |
| 935 | web |
| 950 | circle-segment-ring/connecting element |
| 951 | convex circle segment |
| 951a, b | edges |
| 952 | convex circle segment |
| 953 | filling hole |
| 954 | bordering edges |
| 955 | joint |

What is claimed is:

1. Arrangement for dosing granular substances, including propellants, explosives, gunpowder and other pourable granular substances, comprising a container for holding said granular substances, a dosing unit for defining a measuring chamber to receive said substances from said container and an association device for connecting said dosing unit to said container in a filling position for dosing said granular substances from said container into said dosing unit; wherein is further included:

a closure mechanism that includes a closure, a self-powered mechanism for holding the closure in a closed position to prevent passage of said granular substances from said container into said dosing unit, and an actuating mechanism for being actuated to move the closure to an open position for thereby allowing passage of said granular substances to said dosing unit; and a locking mechanism for locking the closure in the closed position to prevent release of substance from the container, said locking mechanism being releasable by the dosing unit being connected with the container via the association device to attain a filling position so as to ensure that the closure remains in the closed position until the dosing unit substantially achieves the filling position.

2. Arrangement according to claim 1, wherein the association device, the closure mechanism and the locking mechanism form an association assembly in which the locking mechanism cooperates with the actuating mechanism of the closure mechanism for locking and releasing the closure.

3. Arrangement according to claim 1, wherein said actuating mechanism includes a holding mechanism that engages said dosing unit when said actuating means is actuated to move said closure to the open position for retaining said dosing unit in the filling position when said closure is in the open position.

4. Arrangement according to claim 3, wherein the locking mechanism interacts in the closed position of said closure with the holding mechanism so as to achieve a mechanical operational reliability which is as high as possible and a compact structural form.

5. Arrangement according to claim 3, wherein the holding mechanism engages with measuring body.

6. Arrangement according to claim 1, wherein the dosing unit comprises a measuring body for defining a cavity and a measuring carrier assembly including a measuring carrier for being attached to said measuring body, whereby the measuring body and said measuring carrier assembly, attached together, define said measuring chamber.

7. Arrangement according to claim 6, wherein the measuring carrier assembly includes a measuring device having a measuring member that extends into said cavity of said measuring body for defining said measuring chamber.

8. Arrangement according to claim 7, wherein the measuring body comprises at least first and second measuring parts, each having a subcavity, wherein the first measuring part is a connecting section between the measuring carrier and the second measuring part, wherein the volume of a subcavity of at least one of the first and second measuring parts is at least one multiple integer (k-fold multiples) of a maximum effective volume of the measuring chamber, with k=1 to n.

9. Arrangement according to claim 8, wherein the measuring body comprises more than two measuring parts, each having a subcavity, wherein the volume of the subcavity of at least one of the measuring parts is substantially one multiple integer (k-fold multiples) of a maximum effective volume of the measuring chamber, with k=1 to n.

10. Arrangement according to claim 7, wherein the measuring body comprises at least one measuring part having a cavity volume of WV into which said measuring member extends, and wherein a measuring range of the arrangement is WV.

11. Arrangement according to claim 6, wherein the measuring carrier comprises at least one shock-damping means of absorption, the shock-damping means of absorption being a shock-absorbing body contained in a polygon-radial groove arranged in the measuring carrier, said polygon-radial groove having rounded corners.

12. Arrangement for dosing granular substances, including propellants, explosives, gunpowder and other pourable granular substances, comprising a container for holding said granular substances, a dosing unit for defining a measuring chamber to receive said substances from said container and an association device for connecting said dosing unit to said container in a filling position for dosing said granular substances from said container into said dosing unit; wherein is further included a closure mechanism that includes a closure, a self-powered mechanism for holding the closure in a closed position to prevent passage of said granular substances from said container into said dosing unit, and an actuating mechanism for being actuated to move the closure to an open position for thereby allowing passage of said granular substances to said dosing unit, wherein said actuating mechanism includes a holding mechanism that engages said dosing unit when said actuating means is actuated to move said closure to the open position for retaining said dosing unit in the filling position when said closure is in the open position.

13. Arrangement according to claim 12, wherein the closure is detachably connected with the container.

14. Arrangement according to claim 12, wherein the association device is detachable connected with the closure.

15. Arrangement according to claim 12, therein the dosing unit is positioned immediately adjacent the closure in the filling position so as to achieve as precise a substance measurement as possible.

* * * * *